United States Patent [19]

Dyer et al.

[11] Patent Number: 4,828,257

[45] Date of Patent: May 9, 1989

[54] ELECTRONICALLY CONTROLLED EXERCISE SYSTEM

[75] Inventors: Richard A. Dyer, Leucadia; Michael J. Knauer, Oceanside; Berle E. Rabenberg, Julian; Arthur C. Bentley, Rossmoor, all of Calif.; Richard O. Keelor, Houston, Tex.

[73] Assignee: Powercise International Corporation, Houston, Tex.

[21] Appl. No.: 154,482

[22] Filed: Feb. 3, 1988

Related U.S. Application Data

[63] Continuation of Ser. No. 865,258, May 20, 1986.

[51] Int. Cl.[4] ..... A63B 21/00

[52] U.S. Cl. ..... 272/129; 272/DIG. 5

[58] Field of Search ..... 272/129, 130, 73, DIG. 5, 272/DIG. 6

[56] References Cited

U.S. PATENT DOCUMENTS 3,364,736 1/1968 Bathurst et al. .

(List continued on next page.)

FOREIGN PATENT DOCUMENTS 095832 12/1983 European Pat. Off. .
152995 8/1985 European Pat. Off. .
230504 10/1909 Fed. Rep. of Germany .
2045215 2/1971 France .
2016934 9/1979 United Kingdom .
2094647 9/1982 United Kingdom .
2157578 10/1985 United Kingdom .

OTHER PUBLICATIONS

Chernyak & Gisin, "Formalization of Training Loads for Automatic Computer Analysis", *Yessis Review*, Sep. 1978, pp. 64–66.

Ariel, "Computerized Dynamic Resistive Exercise", *International Congress of Physical Activity Sciences*, Jul. 11–16, 1976, Book 6, pp. 45–51.

*Corporate Fitness & Recreation*, Dec./Jan. 1986, p. 64.

N. Stedman, "Electric Sportsman", *Health*, Jan. 1984.

R. Curtis & J. Engalitcheff, Jr., "A Work Simulator for Rehabilitating the Upper Extremity—Preliminary Report", *Journal of Hand Surgery*, Sep. 1981, pp. 499–501.

R. Gates, "Muscles by Micro", *Coaching Review*, Jan./Feb. 1984, pp. 20–23.

Ricke, "Future Jock", *Womensports*, Feb. 1977, pp. 46–50.

Dr. Tom Pipes, Sports Doctor article.

Toro Corp., Power Curve brochure.

*Primary Examiner*—Leo P. Picard

*Attorney, Agent, or Firm*—Pravel, Gambrell, Hewitt, Kimball & Krieger

[57] ABSTRACT

A system and method for providing an exercise program at a desired pace throughout each repetition and which applies resistance against a user's efforts based upon user performance history and user demographics. A central controller stores user demographics and performance information, and provides this information as well as program criteria and evaluations to any of a plurality of exercise stations. The exercise stations each include a magnetic brake for producing the desired resistance levels. A central processor unit (CPU) controls the exercise program at each station. The initial brake resistance is established based upon user demographic information and initial user performance of an exercise. The brake resistance is represented by lights in an LED stack simulating weights which move up and down along a run in conformity with position of a movement arm which the user moves. A pacer light moving adjacent the LED weight stack guides the user at a desired pace throughout each repetition. User performance including rate and limb extension is monitored and resistance is changed during the exercise period as performance corresponds to selected criteria. The user's performance is evaluated based on performance history and demographically-based criteria to provide coaching comments to the user and to propose changes to the exercise program. Selected educational and instructional material relevant to the particular user may also be provided. In addition, by monitoring user parameters such as weight and percent body fat, and in view of user demographic and performance information, diet control information may also be provided.

96 Claims, 28 Drawing Sheets

U.S. PATENT DOCUMENTS

| | | | |
|---|---|---|---|
| 3,366,903 | 1/1968 | Searle et al. . | |
| 3,395,698 | 8/1968 | Morehouse . | |
| 3,454,942 | 7/1969 | Chamberlin, Jr. et al. . | |
| 3,465,592 | 9/1969 | Perrine . | |
| 3,487,263 | 12/1969 | Pahlavan . | |
| 3,518,985 | 7/1970 | Quinton . | |
| 3,572,700 | 3/1971 | Mastropaolo . | |
| 3,675,640 | 7/1972 | Gatts | 73/379 |
| 3,712,613 | 1/1973 | Feather et al. . | |
| 3,731,922 | 5/1973 | Jungreis . | |
| 3,735,101 | 5/1973 | Stewart . | |
| 3,744,480 | 7/1973 | Gause et al. . | |
| 3,797,010 | 3/1974 | Adler et al. . | |
| 3,848,467 | 11/1974 | Flavell . | |
| 3,869,121 | 3/1975 | Flavell . | |
| 3,973,251 | 8/1976 | Stephas . | |
| 3,984,666 | 10/1976 | Barron . | |
| 4,039,956 | 8/1977 | Shimanek et al. . | |
| 4,063,726 | 12/1977 | Wilson . | |
| 4,112,928 | 9/1978 | Putsch | 272/73 |
| 4,138,106 | 2/1979 | Bradley . | |
| 4,163,971 | 8/1979 | Morin et al. . | |
| 4,170,225 | 10/1979 | Criglar et al. . | |
| 4,184,678 | 1/1980 | Flavell et al. . | |
| 4,192,000 | 3/1980 | Lipsey . | |
| 4,235,437 | 11/1980 | Ruis et al. . | |
| 4,261,562 | 4/1981 | Flavell . | |
| 4,323,237 | 4/1982 | Jungerwirth . | |
| 4,354,676 | 10/1982 | Ariel . | |
| 4,358,105 | 11/1982 | Sweeney, Jr. . | |
| 4,360,345 | 11/1982 | Hon | 434/262 |
| 4,408,183 | 10/1983 | Wills . | |
| 4,443,008 | 4/1984 | Shimano . | |
| 4,493,485 | 1/1985 | Jones . | |
| 4,518,163 | 5/1985 | Bruder . | |
| 4,544,154 | 10/1985 | Ariel . | |
| 4,556,216 | 12/1985 | Pitkanen . | |
| 4,569,518 | 2/1986 | Fulks | 272/129 |

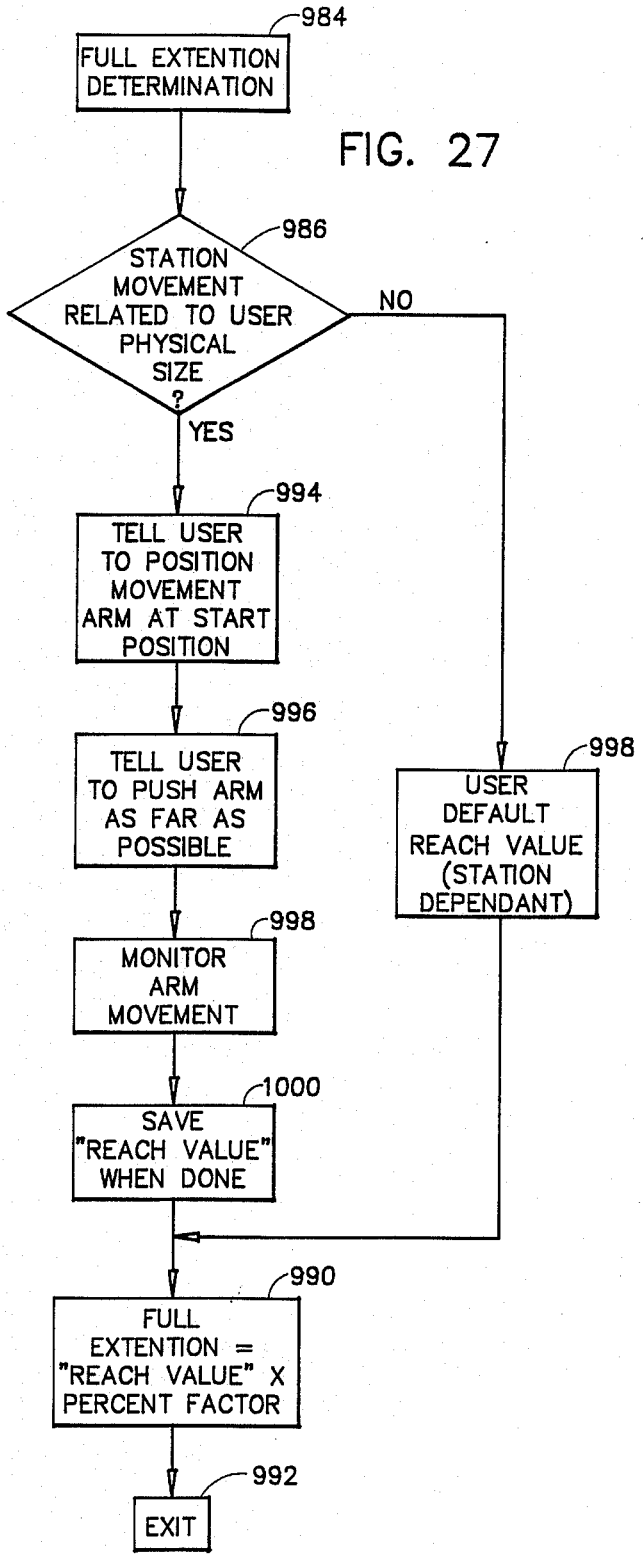
FIG. 27
FIG. 28
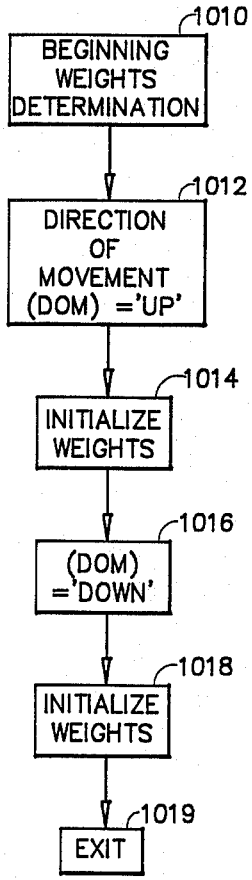

| AGE | FEMALE CP | FEMALE BP | MALE CP | MALE BP |
|---|---|---|---|---|
| 0–25 | 30 | 20 | 80 | 70 |
| 26–30 | 40 | 30 | 90 | 80 |
| 31–40 | 35 | 25 | 80 | 70 |
| 41–50 | 30 | 20 | 70 | 60 |
| 51–60 | 20 | 10 | 50 | 40 |
| 61–+ | 15 | 10 | 40 | 30 |

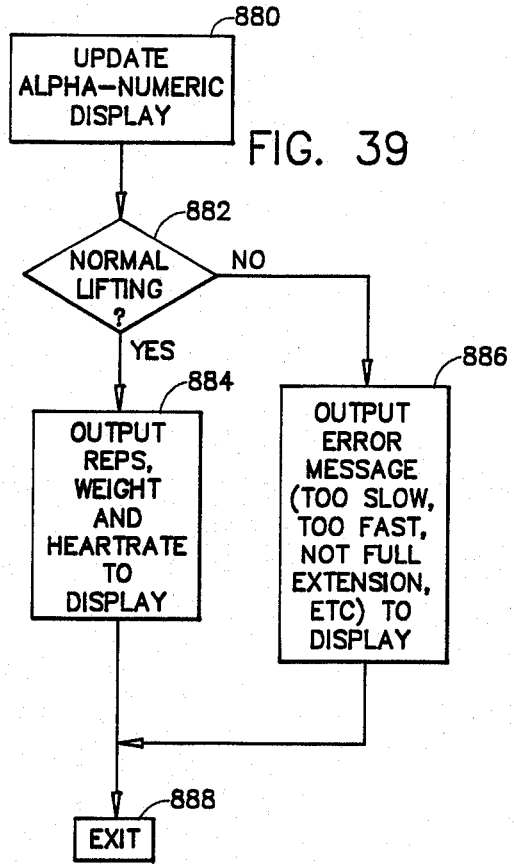
FIG. 39
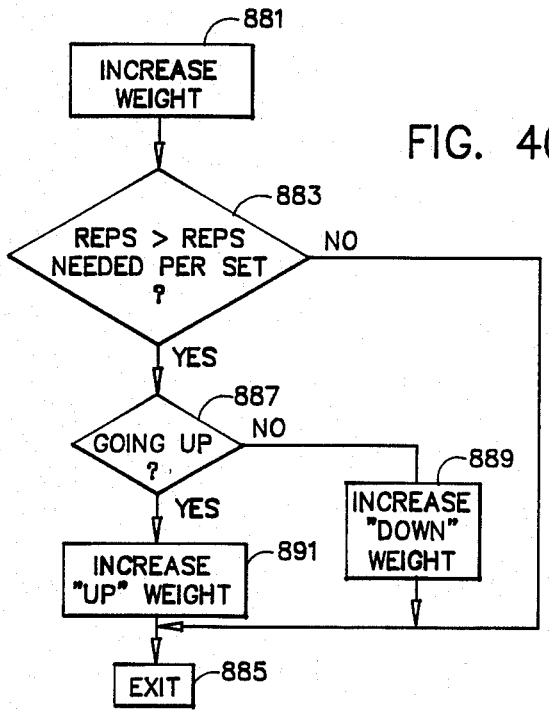
FIG. 40
FIG. 41
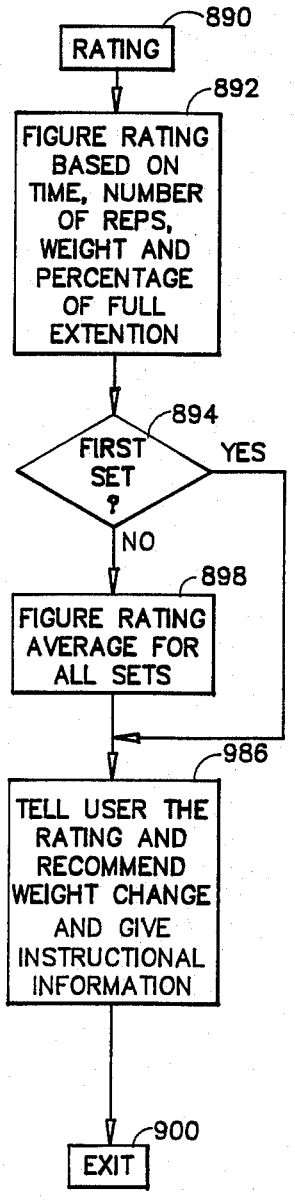

ELECTRONICALLY CONTROLLED EXERCISE SYSTEM

This is a continuation of co-pending application Ser. No. 865,258, filed on 5/20/86.

BACKGROUND OF THE INVENTION

1. Field of the Invention

This invention relates generally to improvements in physical conditioning devices and in exercise systems. More particularly, the present invention relates to a computer-controlled, user interactive system and method for simulating mechanical weight exercising systems, for communicating personalized instructional and educational information to a user, and for providing an electronically paced exercise regimen which is automatically adjusted to meet the needs of a user of the equipment.

2. The Prior Art

Programs for development, improvement, or rehabilitation of the human body through physical exercise have long been in use. Historically, these programs have included use of weight lifting devices such as bar bells, dumb bells and weight-pulley machines. Numerous embodiments of weight-pulley machines have been developed for accomplishing specific objectives of exercising, conditioning, or strengthening body parts. In some cases, one machine may define several different exercise configurations for accomplishing a number of different types of exercises.

More recently, devices and systems have been developed to replace the weights and pulleys with electronically controlled resistance which simulates the weights and pulleys. A number of systems have also been developed which provide information permitting the user to evaluate his performance after completing his exercise session. Information provided by such systems may include an indication of a parameter such as elapsed time in the exercise session, heart rate to be maintained, or an indication of prior performance levels reached by the user The user uses this information along with feedback of corresponding current information such as number of repetitions completed or heart rate in adjusting his efforts in an attempt to meet his particular objective. The continuing efforts made by the user in attempting to adjust his performance to reach a stable exercising pace or desired exercise condition often involve undesirable exercise conditions wherein the user is vacillating between overexertion and underexertion in his attempts to reach the stable condition.

Although the performance information described above is helpful to the user, more benefit could be obtained by providing the user with ongoing comprehensive evaluations of his performance as changes occur during the immediate exercise period, instructions on how to improve his performance, and pacing means for assisting the user to maintain a constant pace throughout each repetition of the exercise. By pacing the performance of repetitions, in addition to receiving evaluations and instructions, the user could maintain a uniform exercising condition which minimizes overshooting and undershooting of his exercise efforts. Accordingly, the desired exercise system should provide assistance to the user on a constant basis so that he may quickly adjust and maintain his performance of the exercise repetitions to conform to performance parameters which guide the user through all portions of each exercise repetition.

Exercise systems such as those described above have historically been used in performing exercise programs developed by the users or operators of the systems. These programs are typically changed based upon the performance history of the user, in order to continue to challenge the user and to provide benefit to the body portions being exercised. The updated performance criteria in these programs is derived manually, and then the necessary changes to the equipment, such as increasing the weight or resistance are made by the operator. Although this practice does tend to accomplish its purpose, it becomes burdensome and requires extensive record keeping and review of the records in order to determine the appropriate changes to be made to the exercise program. It would be very helpful to provide an exercise system and method which retains a history of prior performance data, and which automatically evaluates the performance data and changes the exercise program based upon both upon demographic data of the user, and upon the user's performance history.

Such a system would be even more valuable if it were to communicate this type of information to the user in the form of evaluation of his performance and instructions on improving his performance, as well as providing other educational information relevant to the user. The ability of the user to receive and benefit from the information would be greatly enhanced by communicating it to him by both audio and visual means, so that his attention and learning capacities could be best served.

Over the years, it has also become common practice to provide several types of exercise stations for customer use at establishments such as gymnasiums or health spas. There may be several identical exercise stations, or there may be stations of various types to accomplish particular types of exercise regimens. It would be beneficial if such systems could be centrally controllable and could provide to any interconnected station evaluation information relating to past performance on any other interconnected station, as well as other information such as proposed changes to exercise programs and instructions or information which may be of interest to the user of the equipment.

As is apparent from the above discussion, what is needed in the technology is an exercise system and method which not only varies resistance of the exercise system to optimize the benefit obtained by the user during an exercise period, but which provides pacing assistance to the user in order to maintain the desired aerobic or other exercise condition by minimizing any overshooting or undershooting of the desired exercise repetition profile. A further improvement in the art would be to provide an exercise system and method which evaluates user performance on a real-time basis with respect to performance criteria established during the current exercise period. Still a further improvement in the technology would be to provide such a system which retains a history of user performance, and which evaluates that performance to provide changes to the user's exercise program in light of the past performance and demographic characteristics of the user. Another improvement in the technology would be to provide such a system which communicates evaluation and instructional information to the user during the exercise session as a form of coaching, with the benefit of this improvement being increased by providing this communication to the user via a plurality of communication media, such as visual and audio. Still further improvement in the technology would be achieved by providing such an exercise system which incorporates control by a single central processor for a plurality of different exercise stations so that the exercise stations may perform the exercise program in a stand-alone mode, but with user performance history and evaluation data readily accessible to any of the exercise stations from the central control location.

BRIEF SUMMARY OF THE INVENTION

The present invention comprises a novel exercise system and method for automatically updating a user's exercise program based upon his performance history and personal demographic characteristics; for automatically providing the updated exercise program to any of a number of exercise stations; and for optimizing the value of the exercise session by controlling resistance applied to the exercise equipment and by providing pacing information and real-time performance evaluations and coaching instructions to a user of the exercise equipment.

The system includes at least one exercise station configured so that a user performs repetitive cycles of one or more given exercises. An electromagnetic brake system is electronically controlled by a microprocessor programmed to adjust resistance of the system to a desired level in each of a plurality of segments of the exercise cycle. A torque curve defines the resistance applied in each of these segments to optimize the physical benefit of the exercise program to the user. The torque curve can be designed to fit the particular physiological needs of the user.

User performance during the exercise period is visually depicted by a group of light bars which simulate weights moving up and down in conventional weight-pulley equipment. The number of moving light bars corresponds to the amount of weight which is selected by the user and which is simulated by the resistance produced in the electromagnetic brake system. An additional series of light bars are sequentially lighted to define a pacer signal which guides the user through each repetition of the exercise to help the user maintain a consistent and optimally beneficial exercise session. The pacer signal functions at a given rate based upon the needs and objectives of the user. Resistance levels are established at the time of first use of the equipment by the user, and are based on his personal demographic information and physical ability. The resistance may be changed during the course of an exercise period to simulate adjustmnnts in weight in response to changes in current user performance levels. For example, resistance levels may change after the initial setting based on the actual strength of the user as evidenced by his ability to move the "weight," or the resistance may change during the exercise sessions in response to changes in the user's performance due to fatigue.

Each exercise station is electrically interconnectable to a central control unit comprising a computer system which maintains personal information relating to the user, as well as records of user performance in the exercise programs of the interconnected exercise stations. When a user desires to use a particular exercise station, identifying information is provided to the station, which then accesses the appropriate user information from the central controller. This user information is used in developing any recommended changes in the user's exercise program. At the end of each exercise period, current performance data is transmitted to the central control unit to update the user's records. This information is available from the central controller to any of the interconnected exercise stations. User information and exercise programs of a selected number of the most recent users are maintained in the exercise station which was used, so further use of the station can be initiated by one of those users, without requiring further communication with the central controller.

The interconnection with the central controller also permits communication to users at exercise stations of information which may be of interest to the user. Such information may be provided via a printer and may include results from the exercise or workout session, coaching or educational tips, news reports, new developments in the exercise area, bulletins from the health spa, and the like, as well as business information such as billing data, and the like.

During any given exercise period, user performance is continuously evaluated in comparison with the pacer signal, and with other parameters such as the user's level of limb extension, breathing rate, heart rate and the like. Visual and audio instructions and evaluation information are provided to the user during the exercise period to further assist the user in exerting the appropriate amount of force to achieve the desired aerobic or other condition during the exercise period. These instructions and evaluation information are preferably communicated to the user audibly to provide verbal motivation to the user similar to that received in a live coach/participant situation. A group of lights configured to simulate moving facial features is synchronized in operation with the audible communication to further enhance the simulation of the coach/participant situation and to provide the machine with a more human quality.

In some situations, multiple exercise stations may be located in close proximity in a given area. Audible communications occurring simultaneously at different stations in this situation could cause confusion among the users. Accordingly, each station in a given area is provided with a voice generator which produces an audible voice having different characteristics from other nearby stations. These differences in characteristics are based on differences in such things as pitch, inflection, accent, and so forth, which thereby assist the user in identifying audible communications coming from the system he is using.

Following the exercise period, evaluation information which rates the perfomance of the user is provided to the user, as well as any recommendations for changes to the user's exercise program based upon the user's performance history and physiological data.

In light of the above, it is seen that the system and method disclosed herein accomplish important improvements in the exercise equipment technology by providing a system which assists the user through each repetition of the exercise in a manner which minimizes overshooting and undershooting of the amount of force to be exerted by the user, and which provides on-line, real-time evaluation and instructions to the user regarding performance of his exercise program, as well as educational information and performance tips pertinent to the given user. The real time performance evaluation and user instruction are provided in a simulated coach/participant situation, utilizing several different communication mediums for creating this simulated situation. The system additionally provides for automatically producing changes to the user's exercise program in view of the user's performance history and demographic or physiological information. Access to this information is available to any of a plurality of exercise stations which are interconnected to a central controller, with the controller containing information updated after each use of any exercise station by the user.

These and other advantages and features of the present invention will become more fully apparent from the following description and appended claims taken in conjunction with the accompanying drawings.

BRIEF DESCRIPTION OF THE DRAWINGS

FIGS. 8–29 and 31–41 are flow diagrams illustrating operation of the system and method of the present invention.

FIG. 30 is an illustration of one presently preferred embodiment of a look-up table containing data used for initially establishing weight levels to be used in an exercise program.

DETAILED DESCRIPTION OF THE PREFERRED EMBODIMENT

The invention is best understood by reference to the figures wherein like parts are designated with like numerals throughout.

1. The Apparatus.

Figure 1:
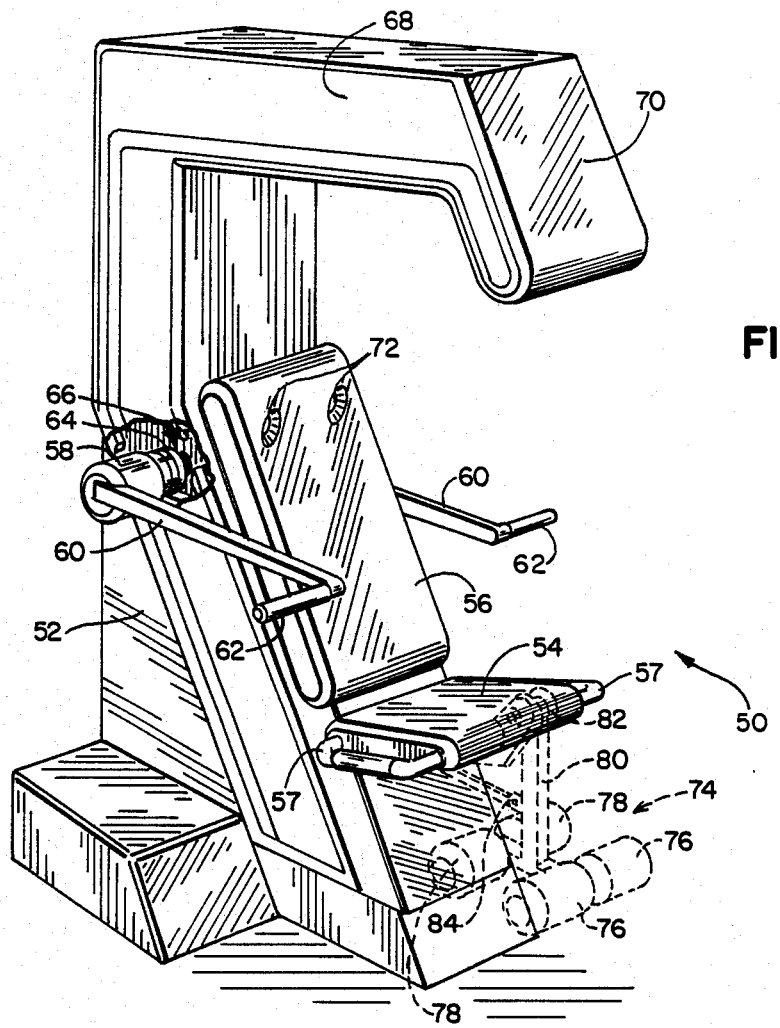
FIG. 1 is a fragmentary perspective view of a presently preferred embodiment of an exercise station of the present invention.

FIG. 1 illustrates one preferred embodiment of an exercise apparatus embodying the present application and comprising a combination shoulder-press and pull-down exercise station generally indicated at 50. Exercise station 50 is one of numerous configurations of exercise devices which can be used in conjunction with the present invention. Accordingly, the embodiment illustrated in FIG. 1 is provided merely for the purpose of describing the invention, but the invention should not be construed as being limited to this particular embodiment.

The exercise station 50 includes a support structure 52 which houses various components of the system, and provides structural support for the exercise equipment. Secured upon a surface of structure 52 are a seat member 54 and a back member 56. Seat member 54 and back member 56 are positioned to comfortably secure a user in a seated position on the system while he is using the exercise station. Optionally, seat belts (not shown) may be secured to the structure 52 and configured to hold a user in a seated position on seat member 54 and, optionally, adjacent back member 56 while he is using the exercise station positioned in the upper portion of back member 56 so as to be near each side of the user's head are a pair of stereo speakers 72 for communicating audible instructions and music to the user. Optionally, positioned so as to extend from the side of seat 54 are handles 56 which may be used by the exercising person to maintain himself in the seat while doing certain exercises.

Rotation hubs are rotatably secured so as to extend within the side surface of support structure 52 at approximately shoulder height on both sides of a seated user. Extending outwardly in a forward direction from the hubs 58 are arm members 60 which are mounted for rotation about an axis defined by the rotation hub 58. Affixed to the forward end of the arm members 60 and extending in an outwardly direction approximately perpendicular to the arm members 60 are handgrips 62. The grips 62 provide a point of contact for the user whereby the user may push the arm members upwardly, or pull them downwardly during an exercise period. Optionally, handgrips 62 as well as handles 57 may support monitoring devices such as pulse monitors which are sensitive to the user's pulse which is detected through the grip of the user's hands. This pulse information may be communicated electrically from the handles 57 or grips 62 to detection equipment at locations which are remote from the sensors.

Rotation hub 58 is axially secured to a central axis of a magnetic brake 64 of a type which provides controlled resistance to movement of its axis, in accordance with control signals applied to the brake 64. One preferred embodiment of an electromagnetic brake for use in conjunction with the present invention comprises a Fastep® model number PFC-15, manufactured by Simplatrol®, 11 Gore Road, Webster, Mass., 01570. Brakes of this type are well-known and commercially available in the marketplace.

Figure 2:
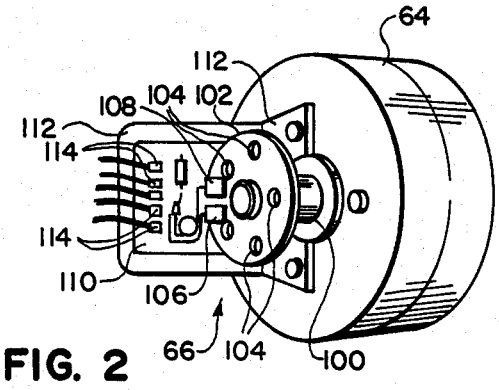
FIG. 2 is a perspective view of one presently preferred embodiment of an electromagnetic brake and position detector system for use in the present invention.
Figure 3:
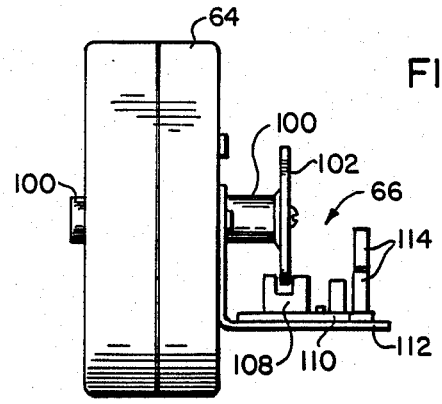
FIG. 3 is a front elevational view of the electromagnetic brake and position sensor of FIG. 2.

Brake 64 is also connected about its axis to a position sensing system 6 which is more fully explained hereafter with respect to FIGS. 2 and 3.

In operation, a user seated on members 54 and 56 grasps handgrips 62 and pushes upwardly thereon, causing arm members 60 to rotate about the axis of rotation hub 58. Resistance to the shoulder-press action is provided by brake 64, at preselected resistance levels causing forces to be exerted on grips 62 in an amount simulating the lifting of a selected amount of weights. The speed and direction of movement of handles 62 may be monitored by the position detection system 66 in a manner to be described hereafter.

When the user has reached full limb extension in the upward movement of grips 62 he pulls down again on those grips, causing resistance to be applied to the axis of rotation hub 58 in a reverse direction, so that the activity of the user corresponds to a pull-down exercise. Again, the amount of resistance experienced by the user in attempting to pull down the grips 62 is defined by the amount of resistance applied to the axis by brake 64, and is designed to simulate the pulling down of a selected amount of weights in a weight-pulley system. The resistance aplied in both the upward and downward movement of the equipment may be made different in selected positions of the exercise equipment in order to optimize the benefit of the exercise to selected body parts of the user.

A portion of the support structure 52 comprises a canopy 68 which extends over the head of the user, and has a downwardly extending lip portion 70 which is positioned so that controls and visual displays may be positioned on the interior surface of the canopy in easy viewing range of the user.

For purposes of illustration, equipment defining a leg extension and leg curl embodiment of the exercise station is illustrated in phantom lines generally designated at 74. Specifically, equipment 74 includes a first pair of roll members 76 and a second pair of roll members 78 which are positioned to engage shin and calf surfaces, respectively, of the legs of an exercising person operating the station 50. Each of the first and second roll members 76 and 78 is mounted for rotation about an axis by means of arm member 80 which is mounted at its upper end to a pivot member 82 positioned on the front of the seat member 54. In use, the axis of rotation of the arm member 80 and roll members 76 and 78 moving therewith are substantially coaxial with the axis of rotation at the knees of the person operating the exercise station 50.

Resistance is applied to the leg extension and leg curl equipment 74 by means of a rod 84 which is pivotally connected at its forward end to a lower portion of the bar 80, and is connected at its rearward end to a plate (not shown) mounted upon the axis of an electromagnetic brake such as the one illustrated at 64. As the leg extension and leg curl equipment 74 is moved rod 84 relays the force to the interconnected plate, causing it to drive the shaft of the brake in one direction or the other. The brake is controlled to add selected resistance to the shaft, thereby producing the desired resistance forces in movement of the leg curl and leg extension equipment 74.

The arrangement for detecting position, speed and direction of movement of the exercise equipment can best be explained by reference to FIGS. 2 and 3. Referring initially to FIG. 2, it is seen that the electromagnetic brake 64 has a central shaft 100 which extends outwardly from the brake. A plate 102 is mounted at its center upon the shaft 100 in a configuration such that its flat faces are perpendicular to the longitudinal axis of shaft 100. A plurality of holes 104 extend through the plate 102 at spaced locations near the outer periphery of the plate.

A pair of sensing devices 106 and 108, respectively, are positioned near the outer periphery of the plate 102 to detect the presence of holes 104 as they rotate past the sensors 106 and 108. The positioning of the photosensors 108 with respect to plate 102 may be more clearly understood with reference to FIG. 3. Sensors 106 and 108 may comprise conventional photosensitive or infrared sensors which are activated when the holes permit transmission of optic or infrared signals between sensing and detecting elements positioned adjacent opposite faces of the plate 102. The sensors 106 and 108 are secured in position by a plate 110 upon which they are mounted, with plate 110 being itself attached to a mounting bracket 112. Bracket 112 is secured in position by attachment to a surface of the electromagnetic brake 64.

Electrical connectors 114 are also positioned upon plate 110 to facilitate the electrical connection of sensors 106 and 108 to power sources and monitoring devices, thereby communicating the status of sensors 106 and 108 to interconnected monitoring and control equipment for use in a manner to be described hereafter.

The position sensing system 66 of FIGS. 2 and 3 detects movement of the exercise equipment attached to the axis of brake 64. Specifically, as the axis 100 is rotated by movement of the equipment, one of the holes 104 will move past one of the sensors 106 or 108. Spacing between the holes 104 is great enough that when a hole is detected by a first sensor such as 106, no other hole can move past either of the sensors 106 and 108 until the hole which has just passed 106 has either moved past sensor 108, or has passed 106 again going the opposite direction. Thus, if a selected hole moves past sensor 106, and then moves past sensor 108, the system knows that the exercise equipment is moving in a first direction. Alternatively, if a hole first passes sensor 108, and then passes sensor 106, the system knows that the exercise equipment is being moved in a second direction. On the other hand, if a hole is detected as it moves past sensor 106, and then a hole is again detected moving past sensor 106 without any holes being detected moving past sensor 108, it is apparent that the equipment has changed directions and that sensor 106 has detected the same hole moving past it first in one direction, and then in the other direction.

The position of the exercise equipment is determined by means of a counting circuit (not shown) connected to the position sensing system 66 via electrical connectors 114. With the exercise equipment in an initial start position, the counter is initialized at a given value which corresponds to that position. As holes pass by the sensors 106 and 108, the counter increments or decrements its value depending upon the direction in which the equipment is moving, and by this means provides an indication of the position of the exercise equipment at any given time.

Communication of control data and information between the user and the exercise station 50 may be accomplished through use of a conventional keyboard for inputting control data to the station, and through use of visual means for receiving information communicated from the station. One preferred configuration for facilitating such communication in the exercise station 50 may be described by reference to FIG. 4, wherein a communications terminal generally indicated at 130 is positioned on the interior face of the lip portion 70 of canopy 68. Communications terminal 130 is preferably positioned in this location so that it may be easily viewed by the user while he is in the exercise position in the exercise station 50. This position of the communications terminal 130 also is sufficiently close to the user so that the terminal may be readily accessed by the user for physically inputting appropriate information by means of a keyboard arrangement 132.

In addition to the keyboard, the communications terminal includes a visual display section 134. By means of the keyboard 132 the user communicates information to the exercise station 50, which in turn communicates information to the user by means of the visual display section 134 and, optionally, the stereo speakers 72 of FIG. 1.

Included in the visual display section 134 is a 16 segment scrolling display which communicates information in alpha-numeric form to the user. Display 136 can function in conjunction with an audio system in the exercise station 50 to visually present information which is audibly presented to the user via speakers 72. Specifically, the exercise station includes a voice generator (not shown) which verbally communicates various information such as exercise instructions and performance evaluations to the user. This verbal information is communicated at approximately the same time as the visual signal is presented on the 16 segment display 136.

The visual display section also includes a group of light emitting diodes (LED'S) which are organized in a configuration which defines an LED face 138. By turning on and off appropriate LED'S, the mouth of the LED face may be given the appearance of moving in a speaking manner. Likewise, LED'S representing eyes may be made to turn on and off to simulate winking and blinking. The LED face 138 is operated in conjunction with the audio messages communicated to the user so that the user may visualize a person speaking to him and relaying the audio information he is receiving through speakers 72. The LED face 138 thus unctions to add a somewhat humanizing effect when operated in conjunction with the computer generated voice of the exercise station 50.

Another group of light bars are positioned on the face of the visual display section 134 in a stacked configuration to define an LED weight stack generally indicated at 140. The weight stack 140 simulates a stack of weights connected in the manner well-known in the weight-pulley-type of exercise equipment. Specifically, in conventional weight-pulley exercising equipment, the amount of force to be exerted by a user in his exercise program is directly related to the amount of weight which is connected to the exercise equipment by a pulley arrangement. As the user desires to exert more force in his exercise program, more weights are added to the pulley. Typically, these weights are configured in a stacked arrangement and are contained within a run so that as the user exercises, the stack of weights move up and down within the run.

The individual light bars in the LED weight stack 140 represent units of weight corresponding to the weight bars of the conventional weight-pulley exercise equipment. As the user of the exercise station 50 determines the amount of "weight" which he wishes to move in his exercise program, he indicates his choice by inputting the information in keyboard 132. This information is used to set the amount of resistance to be applied by brake 64 and it also causes one or more of the light bars in weight stack 140 to be illuminated. Accordingly, the LED weight stack 140 presents a visual representation of the "weights" which the user is moving in his exercise program.

As the user commences his exercise routine, the light bars of weight stack 140 are illuminated and turned off in a manner such that the stack "weights" appear to move up and down in unison in the same manner that the stack of weights would move up and down in the conventional exercise equipment during the exercise routine of the user. The position of the illuminated light bars in the weight stack at any given time is a representation of the position of the exercise equipment. Thus, for example, the amount of extension of the user's limbs and the pace of the user's exercise repetitions, may be visually represented.

Another group of light bars are also positioned on the face of visual display section 134 in a stacked configuration adjacent to the LED weight stack 140, defining an LED pacer stack generally indicated at 142. The light bars of the pacer stack 142 are illuminated only one at a time and in a sequence which defines upward and downward motion along the pacer stack to indicate a particular exercise pace. The rate at which the pacer stack 142 produces the upward and downward moving signal may be selected manually as part of the exercise program, or it may be defined by the system. In one embodiment of the invention, this pacer rate may also be adjusted during the exercise period based upon selected criteria such as user fatigue detected by a reduced exercising rate of the user, or inability of the user to attain full extension, as evidenced by the position of the lights in the weight stack.

The pacer stack 142 is utilized by the user in attempting to conform his exercise efforts to the desired pace. Thus, the user attempts to control the upward and downward movement of lights in the weight stack 140 to conform to the upward and downward movement of the lights in the pacer stack 142. Not only does the rate of user exercise come into play here, but the amount of extension of the user in his exercise program is reflected by the height reached by the lights in the weight stack 140 during each repetition of the exercise period. The user attempts to make the lights in the weight stack 140 move not only in rate synchronism with the lights in the pacer stack 142, but also in conformity with the height of the pacer signal in the pacer stack 142. By means of this pacing arrangement, a very uniform repetition rate and extension amount may be achieved during an exercise period. This uniformity reduces unnecessary stress and strain on the user and permits the maintenance of a desired aerobic or other condition, while permitting changes in rate or extension amount to be made at appropriate times without significant overshooting or undershooting of the desired pace and extension amount by the user.

Figure 5:
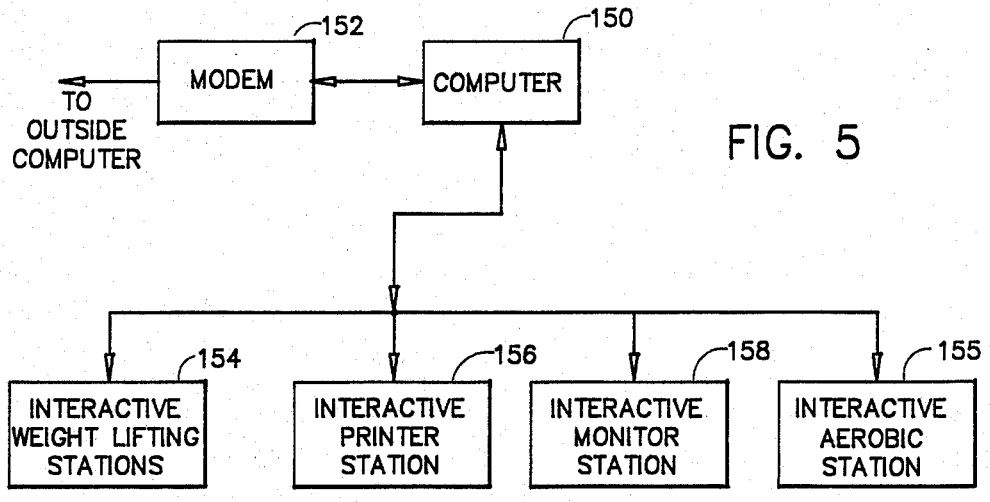
FIG. 5 is a block diagram generally illustrating one preferred embodiment of the exercise station interconnection and control scheme of the present invention.

By reference to FIG. 5, the general configuration of one preferred embodiment of an exercise system in accordance with the present invention may be described. Specifically, a central computer 150 such as an IBM PC, comprises a central control device for communicating information regarding individual users, including their personal demographics and past performance history, as well as their exercise program, to individual exercise stations. The system additionally receives modified information such as updated performance histories, and changed exercise programs from the exercise stations for storage in a central memory associated with the computer 150. Computer 150 may also be used for purposes of transmitting desired communications through selected exercise stations to individual users, as well as for initializing the various exercise stations and making any programming changes necessary for control and operation of individual exercise stations.

The computer 150 is electrically connected to a modem 152 through which data and information are communicated between the computer 150 and other devices such as outside computers (not shown) via telephone communication systems. This connection feature permits control of the computer 150 from the outside computer for updating control and operational data and information such as news and educational information in the computer 150. Of course, this connection feature also permits remote access via the outside computer to user information which can be transferred to central controllers of other exercise systems corresponding to the one controlled by computer 150.

The computer 150 is connected via an RS 485 communication link 153 through a two-wire cable set to an interactive weight lifting station 154 such as the station described in connection with FIGS. 1–4. As indicated above, information and data necessary for use of the weight lifting station 154 may be communicated from the computer 150 to station 154 via communication link 153. Conversely, information for purposes of updating records and the like may be communicated from station 154 through the communication link 153 to the computer 150.

Computer 150 is also optionally connected via the communication link 153 to an interactive printer station 156 which provides users an opportunity to request information from the computer such as performance history and evaluation data. This data is accessed via the computer 150 and is communicated to the printer station 156 wherein it may be produced in hard copy for the user.

Computer 150 is also optionally connected via the communication link 153 to an interactive monitor station 158 comprising a device such as a weight scale for receiving data from that station indicative of the user's weight. Of course, the monitor station could comprise, for example, a body fat monitor for indicating the percent of body fat of the user. Control or change in a user's weight is often a goal in exercise programs. The use of a weight scale station in conjunction with the exercise program provides weight information to the computer 150 which can be used in updating the user's exercise program, and can be reported to the user either via the communications capabilities of the weight lifting station 154 or in hard copy through printer station 156, along with evaluation comments or instructions relating to the weight information. Other types of monitors such as body fat monitors can comprise station 158, for use in the manner described above.

Computer 150 could also optionally be connected to other stations such as an interactive aerobic station 155 comprising a treadmill, bicycle or the like, having a controlled resistance, for purposes of control and information storage similar to the function of computer 150 in conjunction with the weight lifting station 154.

The general configuration of one preferred embodiment of an interactive weight lifting station 154 may be described by reference to FIG. 6. The station 154 includes a central processor unit (CPU) 160 comprising, for example, a Zilog Z-80 A unit. The CPU 160 is connected to a memory 162 for both reading and writing data and information for use in station operation, as well as for use in updating and evaluating user information.

CPU 160 is additionally electrically connected to a speech output system 164 for audibly communicating information in verbal, speech format to a user. Preferably, the speech output system 164 is organized to output speech having different characteristics for different stations so that users of stations located nearby each other can easily distinguish the audible communication from their station, based on these differences in voice characteristics. The differences create different voices based on changes in pitch, inflection, accent, sex, and so on. CPU 160 is also connected to an LED display system 166 comprising, in one preferred embodiment, a 16 segment display for scrolling communications in alphanumeric form for visual communication to a user.

Figure 4:
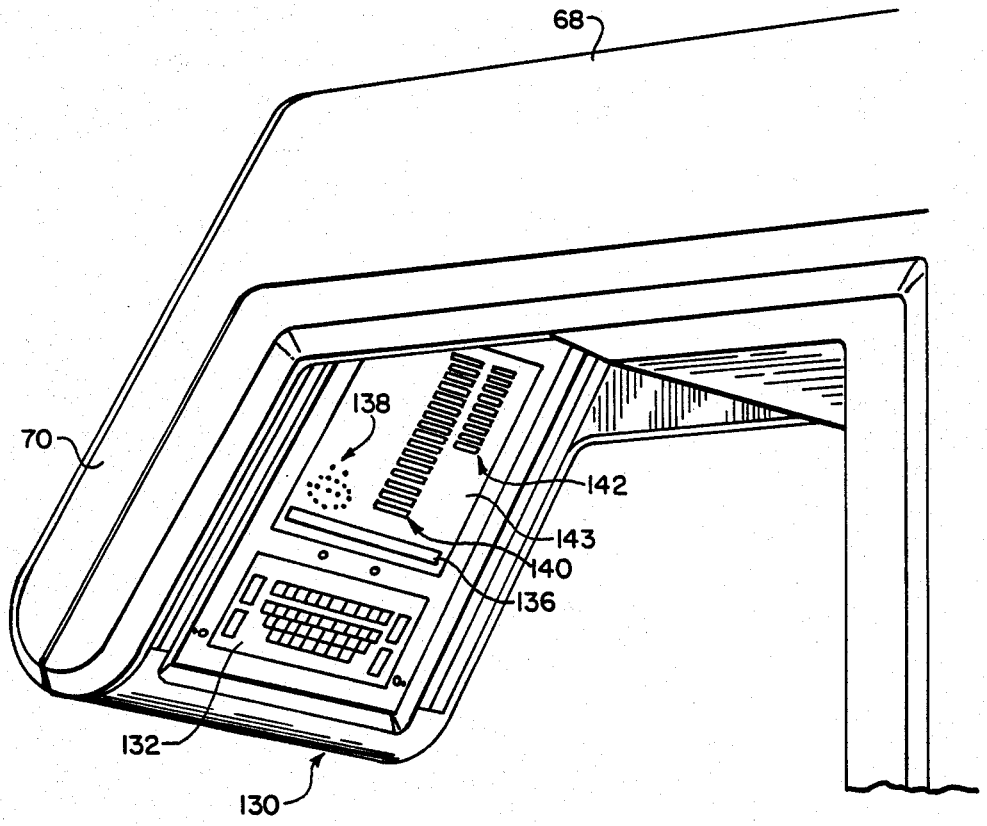
FIG. 4 is a perspective view of one preferred embodiment of an exercise station control panel positioned to face the user on the inward facing canopy surface of the exercise station illustrated in FIG. 1.

CPU 160 is additionally connected to an LED face system 168 for controlling the LED face 138 described in reference to FIG. 4. The CPU 160 is also connected to an LED weight stack system 170 which controls the LED weight stack 140 and pacer stack 142 of FIG. 4. An optional printer 172 may also be connected to the CPU 160 for providing hard copy output of information from the exercise station in a manner similar to the hard copy output which could be provided via printer station 156 of FIG. 5 with respect to data from computer 150. A monitor station comprising, for example, digital scale 174 may also optionally be conected to the CPU 160 for providing monitored information such as the weight of the user to the CPU 160.

The CPU 160 is additionally connected to control a magnetic brake system 176 which functions to control the magnetic brake 64 described with reference to FIGS. 1–3. A heart rate monitor system 178 for monitoring user heart rate via monitors positioned on handles 57 or grips 62 is also connected to the CPU 160. In addition, a keyboard system 180 for controlling the alpha-numeric keyboard 132 of FIG. 4 is also connected to the CPU 160. A position detection system 181 comprising the position sensing system 66 of FIGS. 2 and 3 is also connected to the CPU 160 for providing information as to the position and movement of the exercise equipment. Communications between the CPU 160 and the computer 150 are achieved via an RS-485 interface 182 connected to the CPU 160.

The various components of the weight lifting station as described with reference to FIG. 6 may be described in somewhat more detail by reference to FIG. 7. It is seen in FIG. 7 that the CPU 160 includes an address decode section 190 for use in communicating with the various components of the station. Interconnected to the CPU 160 are components which comprise the memory 162 of FIG. 6. Specifically, these components include a memory decode device 192 such as a Texas Instruments part number 74LS138 which decodes signals from CPU 160 and then uses then to read and/or write into appropriate locations in one of several 8K×8 RAM/ROMS 194 or a 32K×8 ROM 196. Preferably, the ROMS 194 and 196 comprise erasable, programmable ROMS (EPROMS) such as a Hitachi 2764, 8K EPROM devices for ROM 194, and a Hitachi 27256, 32K EPROM for ROM 196. Where devices 194 comprise RAM, they are preferably RCA 6264, 8K RAMS.

Figure 6:
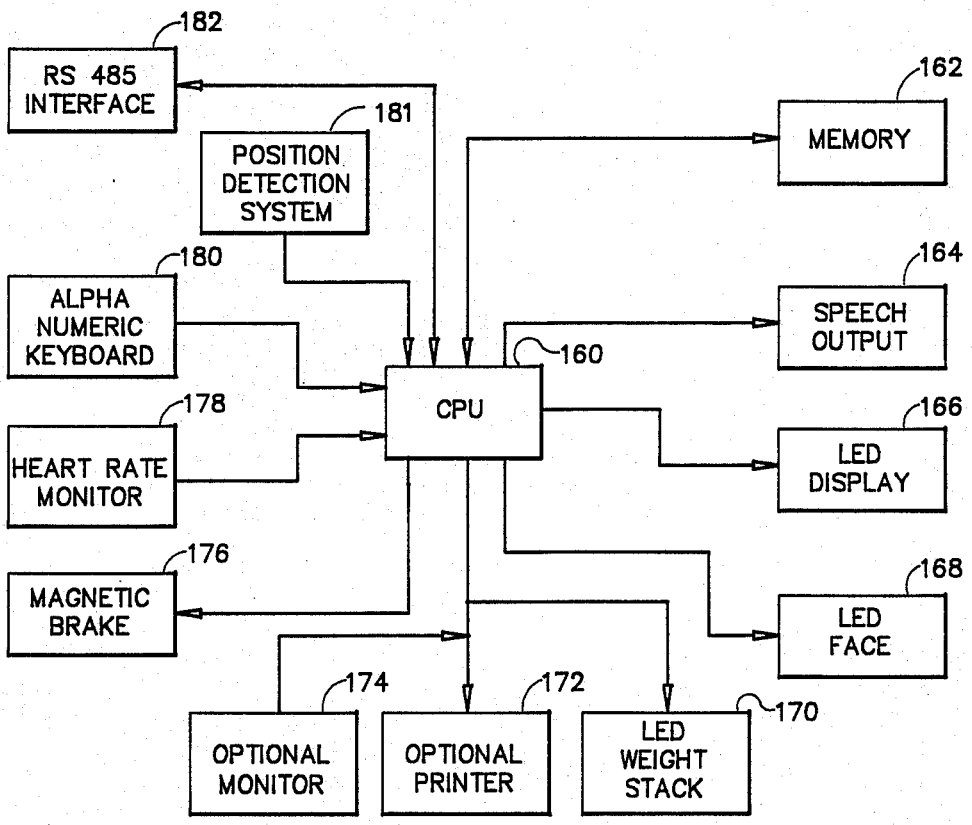
FIG. 6 is a block diagram illustrating one preferred embodiment of the overall exercise system of the present invention.
Figure 7:
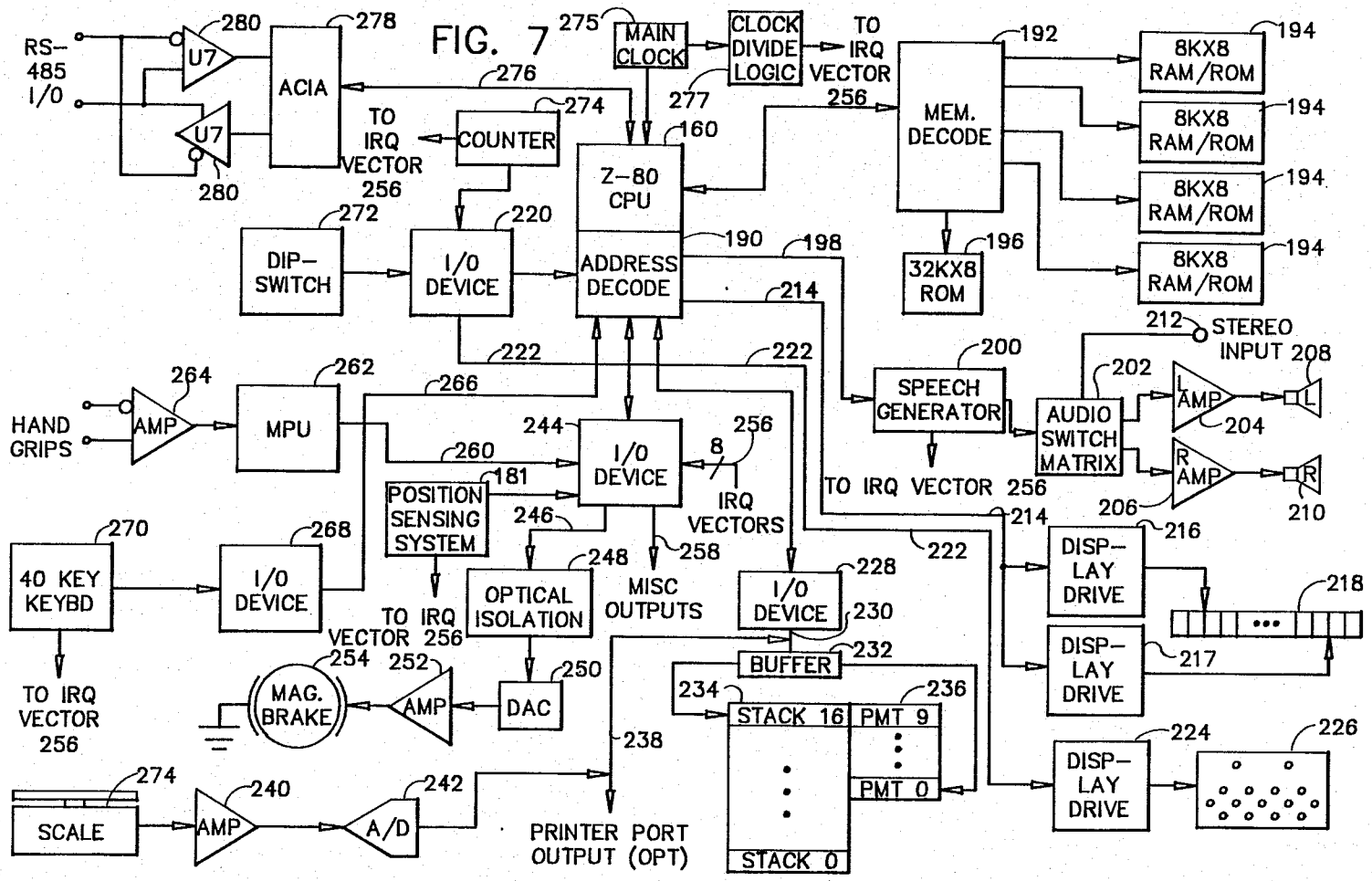
FIG. 7 is a block diagram illustrating components of one preferred embodiment of the exercise system of the present invention.

The speech output system 164 of FIG. 6 is interconnected via line 198 to the address decode 190. Speech output 164 includes a speech generator 200 which responds to signals received from the CPU 160 to generate selected voice data. Speech generator 200 may comprise one of many commercially available speech generators such as, for example, the phonetic speech generator part number 263 made by Solid State Scientific, Inc. Speech generator 200 is also connected to the address decode 190 via an interrupt request vector (IRQ) 256 through an input/output (I/O) device 244. I/O device 244 preferably comprises a programmable peripheral interface manufactured by Intel and identified in the commercial marketplace by part number M8255.

When the speech generator is ready for more data from the CPU 160 for developing speech, it sends an interrupt signal via the IRQ vector 256 notifying the CPU 160 of this ready status. Data is transmitted from speech generator 200 to an audio switch matrix 202 comprised of, for example, a National Semiconductor part number LM1037. The switch matrix 202 sends the signals to left and right amplifiers 204 and 206, respectively, from whence the signals pass to left speaker 208 and right speaker 210, corresponding to speakers 72 of FIG. 1.

A stereo input 212 is also connected to the audio switch matrix 202 to receive music or other information from external sources and to play this over the speakers to a user. In operation, a stereo option may be selected by the user, and the stereo program is interrupted by the audio/switch matrix upon receipt of appropriate information from the CPU 160 through the speech generator 200.

The LED display 166 of FIG. 6 is connected to the address decode 190 of FIG. 7 via line 214. The LED display comprises display drives 216 and 217 which may each preferably comprise part number ICM7243, manufactured by Intersil, which device is available in the commercial marketplace. Display drives 216 and 217 function to drive an alpha-numeric display 218 and, in one preferred embodiment, to scroll visual information in alpha-numeric format across th display 218. The alpha-numeric displays 218 correspond in one preferred embodiment to the 16 character display 136 of FIG. 4, with each display drive 216, 217 driving 8 of the 16 characters.

The LED face system 168 of FIG. 6 is connected to the address decode 190 of FIG. 7 through a conventional input/output device 220 via line 222. Line 222 is electrically connected to a display drive device 224 such as a Sprague, part number ULN2803which is available in the commercial marketplace. The display drive device 224 responds to signals from the CPU 160 to drive an LED face 226 which corresponds, in one preferred embodiment, to the LED face 138 of FIG. 4.

The LED weight stack 170 of FIG. 6 is connected to the address decode 190 of FIG. 7 via an I/O device 228, preferably comprising a programmable peripheral interface manufactured by Intel and identified in the commercial marketplace by part number M8255. Device 228 is electrically connected via line 230 to a buffer 232 which, at any given time, contains information received from CPU 160 identifying which light bars of the weight stack and of the pacer stack are to be illuminated. This information is communicated from buffer 232 to the weight stack 234 in causing the appropriate light bars of the weight stack 234 to be illuminated. Weight stack 234 corresponds to one preferred embodiment of the weight stack as illustrated at 140 in FIG. 4. Information regarding the pacer lights is communicated from buffer 232 to the pacer stack 236 to cause the appropriate light bar in stack 236 to be illuminated. Again, pacer stack 236 corresponds to one preferred embodiment of that stack as illustrated at 142 of FIG. 4.

The I/O device 228 is also connected via line 238 to a printer port output for interconnecting the optional printer 172 of FIG. 6. In addition, line 238 is connected to receive information from an optional digital scale as illustrated at 174 of FIG. 6. Specifically, scale 174 is connected to an amplifier 240 which itself is connected to an analog-to-digital converter 242 for providing a digital signal to line 238 which corresponds to the weight of the user as identified on scale 174.

The magnetic brake system 176 of FIG. 6 is also connected to the address decode 190 of FIG. 7 via input/output device 244. Input/output device 244 is also connected via line 246 to an optical isolation device 248 comprising, for example, a General Instruments part number 6N139, which is available in the commercial marketplace. Optical isolation device 248 provides a safeguard for the CPU 160 by filtering out voltage spikes which could be produced by the magnetic brake. Optical isolation device 248 is connected to a digital-to-analog converter 250, which transmits the signals via amplifier 252 to the magnetic brake 254. Brake 254 adjusts the loading or resistive force upon its central shaft depending upon the signals received from the CPU 160. Brake 254 responds quickly to signals received from the CPU 160, so that various amounts of resistance are provided based upon the orientation of the shafts of the brake 254 as detected by the position detection system 181 of FIG. 6.

The position detection system 181 is connected to the address decode 190 via the I/O device 244 to provide current information to the CPU 160 as to current orientation and travel direction of the shafts of the brake 254. The detection system is also connected to two of the IRQ interrupt vectors 256, with sensor 106 connected to one IRQ vector and sensor 108 connected to the other IRQ vector. When passage of a hole 104 is detected by one of the sensors 106 and 108, an interrupt signal is transmitted via its interconnected IRQ vector, causing the CPU 160 to receive the current sensor data for updating the orientation information. The resistance of the brake 64 is updated based upon this shaft information in a manner described hereafter with reference to FIG. 35.

I/O device 244 is also connected to various other outputs via line 258. The outputs connected to line 258 include, for example, the audio switch matrix 202 which is controlled to select between transmission of signals from the stereo input 212 and the speech generator 200.

The address decode 190 is also connected to the heart rate monitor system 178 of FIG. 6 through input/output device 244 of FIG. 7, via line 260. The heart rate monitor 178 includes a microprocessor unit 262 such as an Intel Programmable Microcontroller, part number P8748H. This microprocessor unit 262 receives signals from a high gain amplifier 264 connected thereto. The signals are then digitally filtered in the microprocessor unit 262 so as to identify and throw away random pulses which do not conform to a heart rate. Amplifier 264 is directly connected to sensors positioned in locations such as handgrips 62 or handles 57 of FIG. 1.

The alpha-numeric keyboard system 180 of FIG. 6 is connected to address decode 190 of FIG. 7 via line 266. The alpha-numeric keyboard system 180 includes an I/O device 268 connected to line 266, and comprising, in one preferred embodiment, an RCA single chip keyboard controller identified as part number CDP1871CE-1. This input/output device 268 provides anti-static protection and direct coding of the depressed key into the ASCII format. Input/output device 268 is connected to the keyboard 270 which, in one preferred embodiment, corresponds to a 40 key keyboard as illustrated at 132 of FIG. 4. The keyboard 270 is also connected to the I/O device 240 via an IRQ vector 256 so that when data is to be transmitted from keyboard 270, an interrupt signal is transmitted via vector 256 to notify the CPU 160 of the presence of the data.

Address decode 190 is additionally connected through input/output device 220 to a conventional dip switch 272 which defines a station identification address specific to a given station. This addrss is used by the CPU for identifying a particular station which is to be accessed for polling, or other PC communication. Likewise, this address identifies the particular station responding to a polling signal when information is to be communicated from the station to the CPU 160. A timer counter 274 is also connected through I/O device 220 to the address decode 90. Timer counter 274 is used to count the time between detection of holes by the position sensors 106 and 108 of FIG. 2. The timer/counter 274 is additionally connected to one of the IRQ vectors 256 for transmitting an interrupt signal when the timer/- counter overflows. A main clock 275 is also connected to the CPU 160, and functions to coordinate the various operations of the CPU 160, in combination with the address decode 190 and memory decode 192. The main clock typically operates at a rate of about 4 MHz. Main clock 275 is also connected to clock divide logic 277 which generates a lower frequency signal such as 30 Hz for providing timing values for system features such as time-out counting. This clock divide logic is also connected to the IRQ vectors 256 for communicating interrupt signals to CPU 160 for timing purposes.

The CPU 160 is interconnected on a communication line with the central computer 150 of FIG. 5 via line 276 of FIG. 6 and through an asynchronous serial interface adapter (ACIA) 278. The ACIA comprises, in one preferred embodiment, part number WD8250 manufactured by Western Digital. The ACIA 278 takes parallel data from the CPU 160 and converts it to serial data, and vice versa. It additionally accomplishes a number of functions such as parity checks and providing appropriate transmission speed control. The ACIA is connected to a pair of amplifiers 280 which comprise, in one preferred embodiment, Fairchild part numbers UA96176. Amplifiers 280 provide the ACIA 278 with proper electrical signals to run on the RS-485 bus.

2. The Method.

a. Overview of Usage.

Having explained the mechanical aspects of the invention, it is possible to give a general overview of how the system is used. When a new user desires to use the equipment, he will first be asked to pick a personal code number consisting of his first name plus four alphanumeric digits. This number, along with the user's full name, will be input to the central computer or controller 150 by an instructor. This can be accomplished either at the central computer 150 or at any local station from which the information is uploaded to the central computer. Any other pertinent data which needs to be remembered can also be entered, such as the user's address and telephone number, personal demographic information such as age and sex, and when user fees are due. As used herein, demographic data or information of the user comprises personal information which represents characteristics, or features of the user such as age, sex, weight, height, physical condition and so on. Upon receiving this information, the computer allocates space in which to store this information as well as future data which will be developed during use of the exercise stations.

To initiate use, the user types in his name and code number on the keyboard 132 of FIG. 4. The computer 150 scans its memory to see if this user has previously used the particular exerciser. If the user has used the station before, the computer recalls the user's old file and tells the user what he did the last time he used the station. Included in this information is the number of repetitions of the exercise, the weight which was selected, and the resulting performance rating generated by the computer. If the user has not used the machine before, a new data base for the user will be set up and initialized. If the computer 150 cannot find the user's file, it assumes that either the name or the code number was incorrect and will give the user another try to correctly enter the name and code.

For a new user, the initial weight to be simulated by the magnetic brake is determined by the system. Demographic information such as age and sex is provided to the station by the user, and then a series of exercise repetitions are performed at various weight levels until user performance indicates an appropriate level is reached. This weight level is updated automatically prior to each new initialization of an exercise session, based on the personal user information, and most recent as well as previous performance history.

After recognizing and accepting a previous user, the exercise station CPU 160 examines all pertinent data, such as previous weight lifted, previous number of repetitions, time since the equipment was last used, demographic information of the user and what kind of results the user is looking for (for example, strength, bulk or definition). From this information, the CPU 160 updates the weight value to be used in the current session, and provides output to the user, telling him the weight and number of repetitions that he should do during this exercise period. If the user does not wish to use the suggested settings, he may override the computer by going into a manual mode and entering a desired weight level. After the weight is input, the actual resistance to be put on the magnetic field of the brake 64 for the various points of the exercise repetition is determined. This is accomplished by multiplying the desired weight by a set of information defining a torque curve. The torque curve comprises percentages which define the amount of resistance to be applied in that portion of the exercise repetition. Thus, a mechanical cam is produced electronically.

The torque curve which simulates the mechanical cam defines a selected number of points for a given exercise. For example, a leg extension station goes through a motion of 140°. The predetermined torque curve for this exercise comprises 70 points. Each point defines a portion of the maximum weight which is to be applied to the magnetic field of the brake 64 in that segment of each exercise cycle. This allows the station CPU 160 to update the resistance on the magnetic field for each 2° of brake shaft movement. This movement is determined through use of the position sensor system 66 wherein the small holes 104 on plate 102 are positioned so that they will pass over the sensors with each 2° of rotation.

By comparing the time between holes and identifying which sensor first detected the holes, the CPU 160 can determine which direction the plate 102 is traveling, and exactly where the lifting mechanism is at in order to output the magnetic field for the correct weight. If no holes pass the sensors in a predetermined time, such as 1/5th of a second, it is assumed that the user is having difficulty lifting the weight, and the selected weight is reduced by a selected amount. If no holes pass the sensors within a predetermined time, such as 3 seconds, it is assumed that the user has ended his exercise. If it is determined that the direction of movement has changed as a result of detecting a change in the direction of holes passing between sensors, the computer will say something to the user, such as the number of the repetition which he is doing. If the computer senses that the user did not lift the bar high enough, the computer will tell the user that he must achieve a full extension. The CPU 160 will also cause the speech generator to advise the user if he is going too fast or too slow, and will periodically give the user positive reinforcement. This advice to the user is given both verbally, using the speech generator 200, and visually, using the alphanumeric display 218.

The light bar graphs described previously, as well as the 16 character display and the LED face, provide visible feedback for the user.

At the end of the exercise session, the CPU 160 produces data which tells the user how many repetitions of the exercise he did, and how long it took him to do them. The CPU 160 will then calculate a performance rating for the just completed exercise. The performance rating will be based upon criteria such as whether the user achieved full extensions for certain percentage of the repetitions, as well as whether the user maintained an appropriate pace for the repetitions. For example, if the user did not do full extensions for 25% of the repetitions, then he will be told to concentrate on full extensions and his rating on a scale of 1-to-10 will be decreased. If the user did very few repetitions at a high weight setting, he will be told to decrease the weight. If the user did a lot of repetitions at a low weight setting, he will be told to increase the weight in the next exercise session, and points will be deducted from his rating. The same is also true if the user does not keep up with the rate of the pacer stack.

At the end of the exercise session, the station will send all of the data which was developed for that station to the central computer 150 FIG. 5. This data includes the position versus time information of the arm 60, the resistance actually used, the extent to which full extension on the exercise cycles was actually achieved, the number of repetitions completed and any other desirable information for evaluating user performance and compiling a user history. The central computer 150 will update the main data base to include this information. Whenever the user wishes, he may request the central computer for a printout on the interactive printer station 156 of FIG. 5 providing him with the accumulated data as well as evaluation comments. These evaluation comments include comments as to whether the user is doing the repetitions too fast, too slow or is not reaching full extension, is jerking during portions of his movement, or is othewise not smooth in his routine or any other flaws or mistakes in the user's routine. The entral computer 150 will also explain why each flaw is undesirable and suggest ways to improve the user's technique, thereby increasing the user's recognition and acknowledgment of problems.

The user information and data developed at the given station during the exercise session are also retained in memory at the station for a limited number of users which comprise the most recent users of the system. Thus, as the information from the most recent user is stored, the information from the user who has gone the longest time since using the station is dropped from memory. By retaining this information, the user may return for further exercise and access his current exercise program and data without requiring involvement of the computer 150 in reloading the station. This situation also allows use of the local station even when communication between the CPU 160 and computer 150 is not possible, as when the computer 550 is inoperative or when the communication link is broken.

b. Central Computer Operation.

Figure 8:
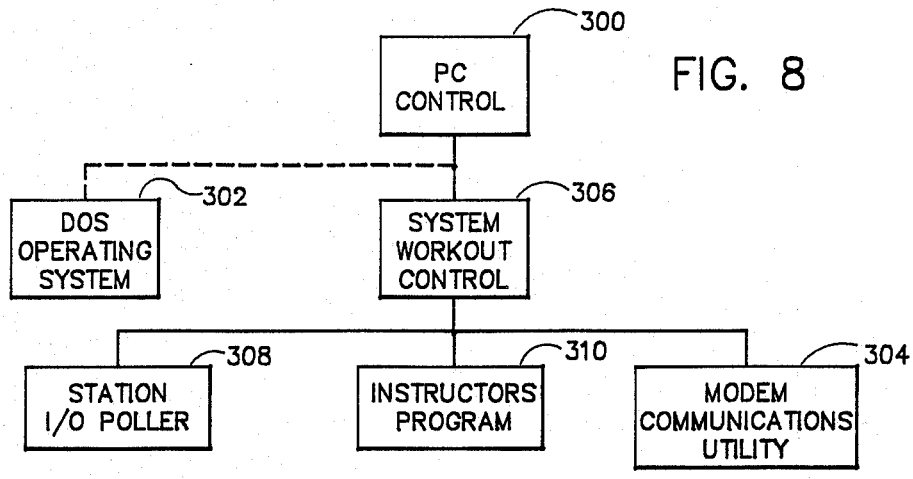

The various functions accomplished by the central computer 150 or PC "central controller" can be described generally by reference to FIG. 8. The system PC control illustrated at 300 involves interfacing with two main entities. These include optionally interfacing with a DOS operating system illustrated at block 302, and maintaining system level control of the exercise stations for accomplishing exercise sessions or "workouts" as indicated in block 306.

The system workout control function involves servicing the various local exercise stations through a station input/output poller operation illustrated at block 308. The system workout control block 306 is also used in introducing new users into the system, developing new exercise programs and the ike through use of an instructor's program feature illustrated at block 310. The workout control block 306 also handles the modem communications utility illustrated at block 304 for interfacing the system to outside computers via telephone lines. The functions of blocks 304, 308 and 310 are accessed by the workout control block 306 in a time share configuration, wherein each of these functions 304, 308 and 310 are polled in turn by workout contrll block 306 to accomplish operation of the station individually, as needed. The specific operation of the system workout control as it relates to the station I/O poller in block 308, the instructor's program of block 310, and the modem communications utility of block 304 will each be described in somewhat more detail below.

Attention will first be directed to the station I/O poller function of block 308. The station I/O poller takes care of all communications between the central computer or controller 150 of FIG. 5 and the local stations 154, 156, 168 such as the exercise station 50 of FIG. 1. In the communication configuration of the preferred embodiment, the controller 150 and the local station CPU's 160 operate normally in a master/slave relationship wherein the controller 150 polls the local station CPU's 160, at which time any communications occur between the controller and selected CPU. Thus, the polling scheme is controlled by the controller 150 which puts on the buss section 153 of FIG. 5 the station number it wants to talk to. Each station checks to see if it is the station's number. If it is not, the ACIA 278 of FIG. 7 is disabled for a set time and the CPU 160 can do other local station functions. After the set time, the ACIA 278 is re-enabled to again check for the station number. If the station number from the controller 150 corresponds to the station number of the CPU 160, then the CPU 160 receives a header which defines the communication which is to occur.

The two specific cases handled in regard to this communication are first, the controller 150 asking the station if it has any data for the PC, and second, the controller 150 telling the station that it has data for the station. In the first case, the controller 150 will send out the station number and a header which the station will interpret as a request for data. The controller 150 will then wait for a period of time on the order of 100th of a second to see if that station responds. Normally the station will either send back the modified user's file or it will request that the controller initialize a new user, sending over all of the new user data such as name, age, sex, user ID and the like.

In the second case, the cotroller 150 will send the station number, the header and then the data. The local exercise station 50 will interpret the header as a data transmission from the controller 150 to the station 50 and it will receive all of the data. The data sent to the station will be in one of two forms. Either a user file consisting of ASCII code or a code modification consisting of assembly language code. All error checking is handled by the hardware and if an error is detected all of the data will be retransmitted.

Figure 9:
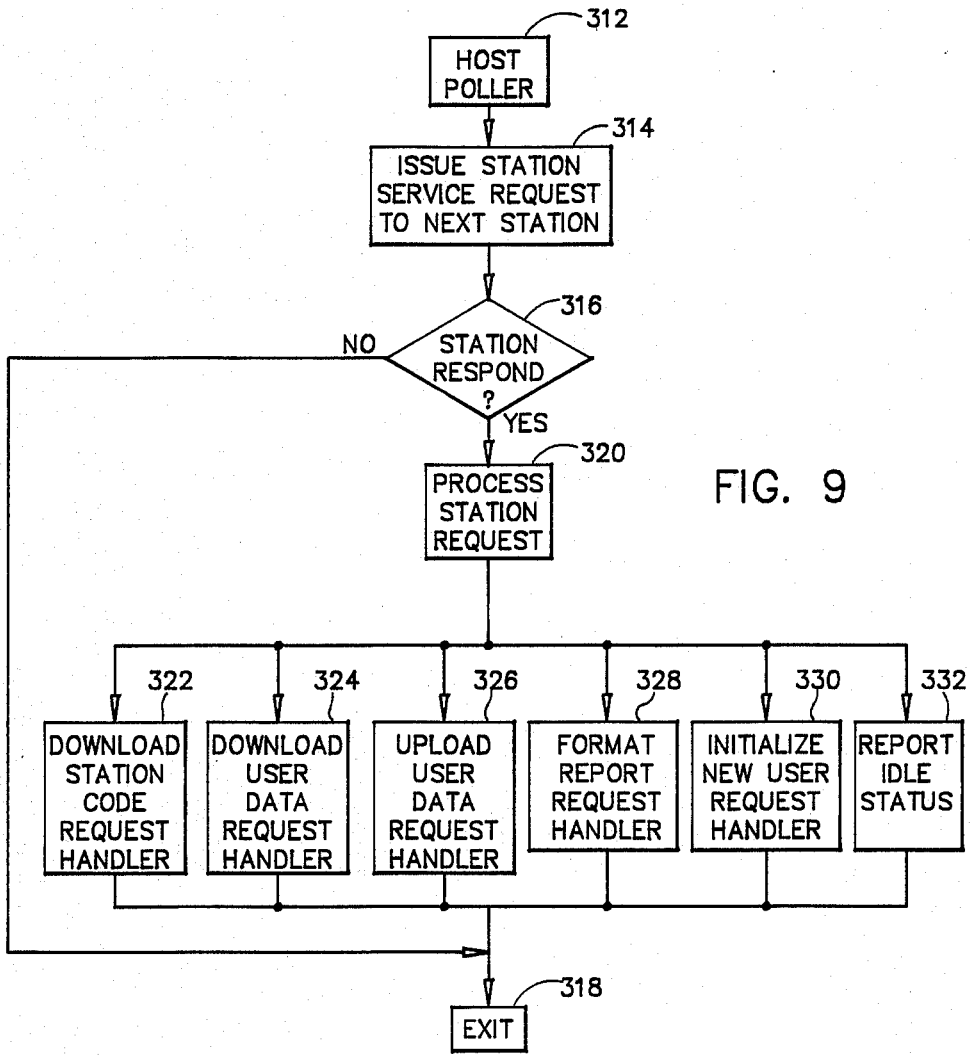

The station I/O poller function of block 308 can be described in flow chart form by reference initially to FIG. 9. Upon initiating host poller operation in block 312, the central controller 150 moves to block 314 and causes a station service request to be issued to the next exercise station. The controller 150 next moves to block 316 and listens for a station response to the station service request. If no response is received after a given period of time the controller 150 passes from block 316 to block 318 and exits the routine illustrated in FIG. 9. If a response to the station service request is detected in block 316 the controller 150 moves to block 320 and processes the station request.

The station request processed in block 320 may comprise any of several different requests. The block to which the controller 150 passes from block 320 will depend upon the particular station request. For example, if the request comprises a download station code request handler, the system passes to block 322. For a download user data request handler, the system passes to block 324. An upload data request handler moves the system to block 326, while a format report request handler moves the controller 150 to block 328. In the case of an initialize new user request handler the controller passes to block 330, while a report idle status causes the controller to move to block 332. In each case, following the servicing accomplished in the particular block 322–332, the controller 150 moves from that block to block 318 and exits the module of FIG. 9. A discussion of the activities within each of the service blocks of FIG. 9 is described below.

Figure 10:
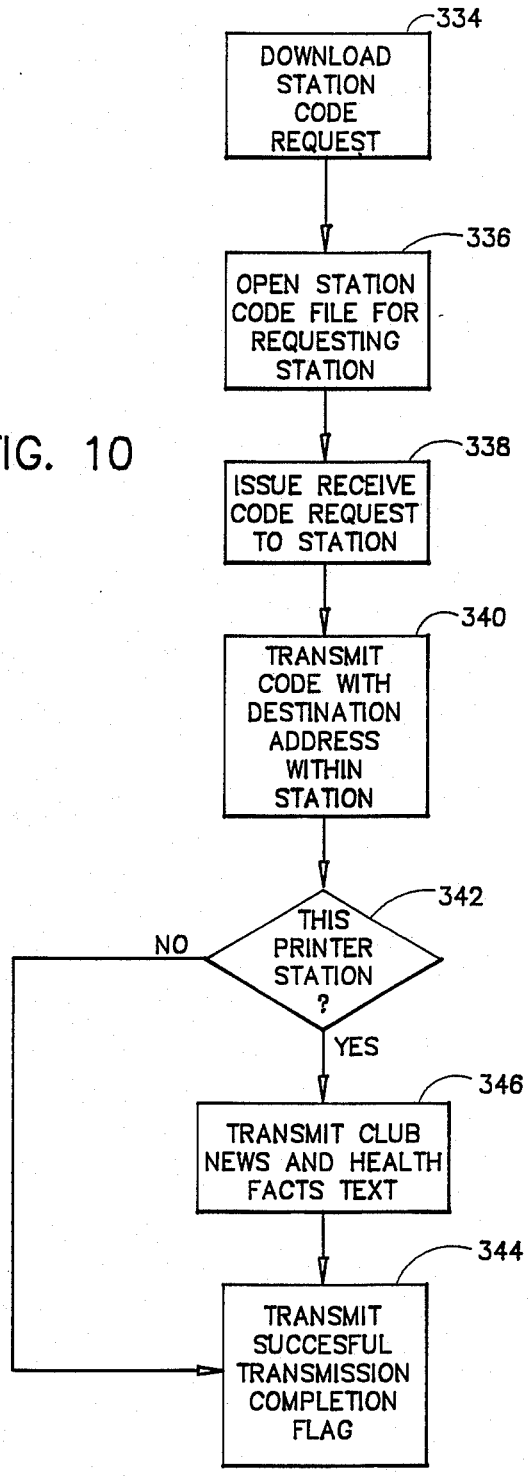

With reference initially to FIG. 10, it is seen that upon receiving a download station code request handler in block 322 of FIG. 9, the controller 150 accesses the download station code request 334 and then moves to block 336 wherein a station code file is opened for the requesting exercise station. The code which is transferred in conjunction with this request comprises information pertinent to the operation of the particular station receiving the information, but does not include information comprising data from a user's record.

With the station code file open, the controller 150 moves to block 338 and issues a receive code request to the exercise station. The controller 150 then moves to block 340 and transmits code which includes a destination address within the particular exercise station being accessed. The controller 150 then moves to block 342 and checks its files to determine whether the particular station is a printer station.

If the accessed station is not a printer station, the controller moves from block 342 to block 344 and transmits a successful transmission completion flag. If the station is a printer station, the controller moves from block 342 to block 346 and transmits any additional information which has been provided for transmission, such as news and articles. From block 346 the controller passes to block 344, transmits a successful transmission completion flag, and returns to block 322 of FIG. 9 prior to exiting the module of FIG. 9.

Figure 11:
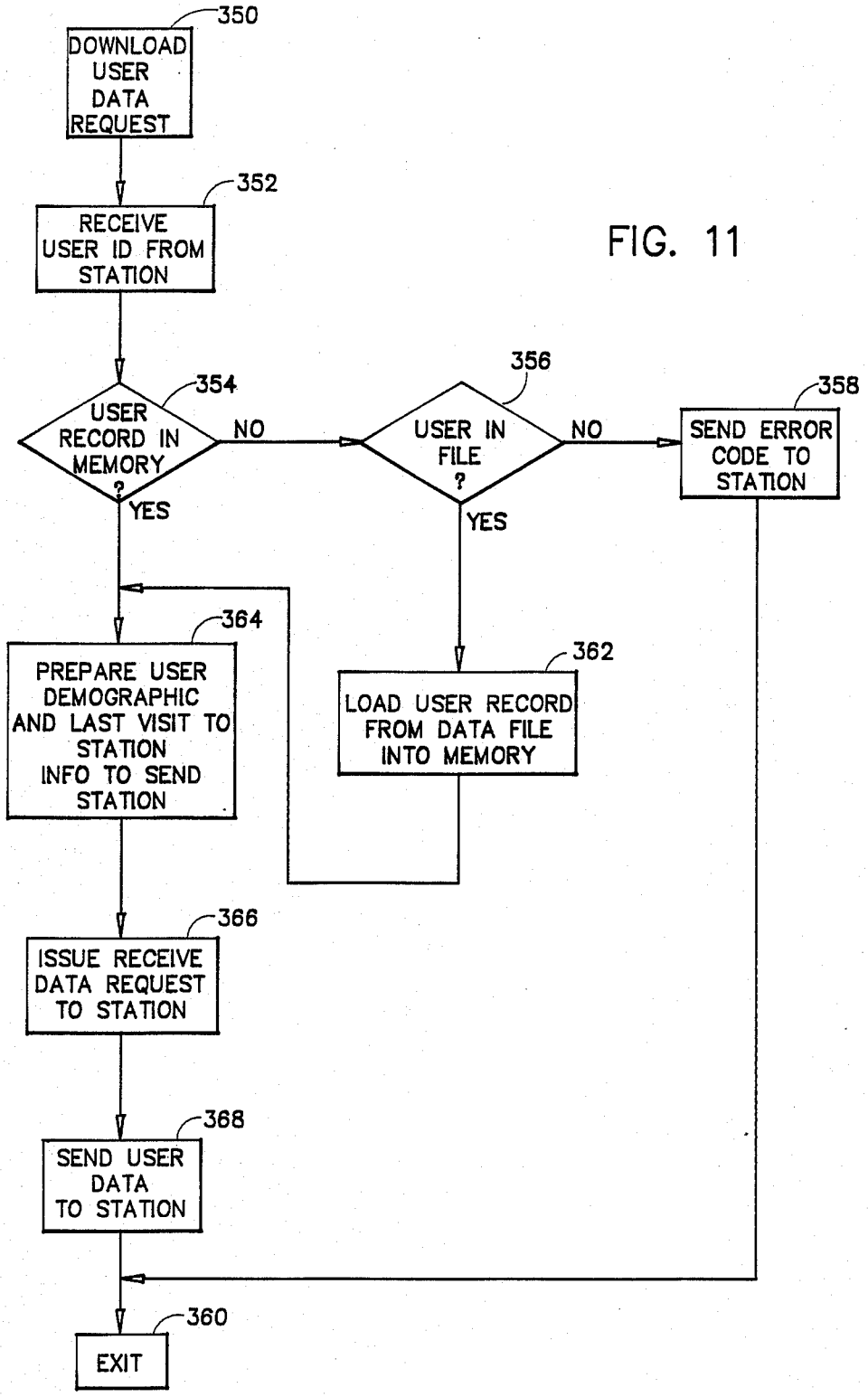

If the controller 150 moves in FIG. 9 to the download user data request handler of block 324, the controller 150 initiates the necessary servicing by accessing the download user data request block 350 of FIG. 11 and moving to block 352. As used herein "user data" comprises the record of information specifically relating to the indicated user. In block 352 the controller 150 receives the user ID for the current user from the local station and then passes to block 354 where the user ID is compared with data stored in memory to determine whether the indicated user's record is contained in memory.

If it is determined in block 354 that the user's record is not contained in memory, the controller 150 passes from block 354 to block 356 and searches the user index which is stored in files comprising disks to see whether or not the user is in that file. If the user record is not found in that file, then the controller 150 passes to block 358 and sends an error code to the local station, indicating that the user record has not been found. The controller then passes to block 360 and returns to the download user data request handler block 324 prior to exiting at block 318 of FIG. 9.

If, while in block 356, the user's record is found in the file, the controller passes to block 362 and loads the user record from the data file into the memory. The controller passes from block 362 or from block 354 if the user record was found in memory, to block 364. In block 364 the controller 150 prepares user demographic information as well as information from the user's last visit to the station for transmission to that station. Other information such as dietary information produced in block 391 of FIG. 12, as described more fully hereafter, is also prepared in block 364 for communication to the user. The controller 150 then passes to block 366 and issues a RECEIVE DATA request to the station, preparatory to actually sending the data. The controller 150 then passes to block 368 and sends the user data prepared in block 364 to the appropriate local station. From block 368 the controller passes to block 360 and returns to the download user data request handler block 324 of FIG. 9 from whence it exits the module of FIG. 9 via block 318.

Figure 12:
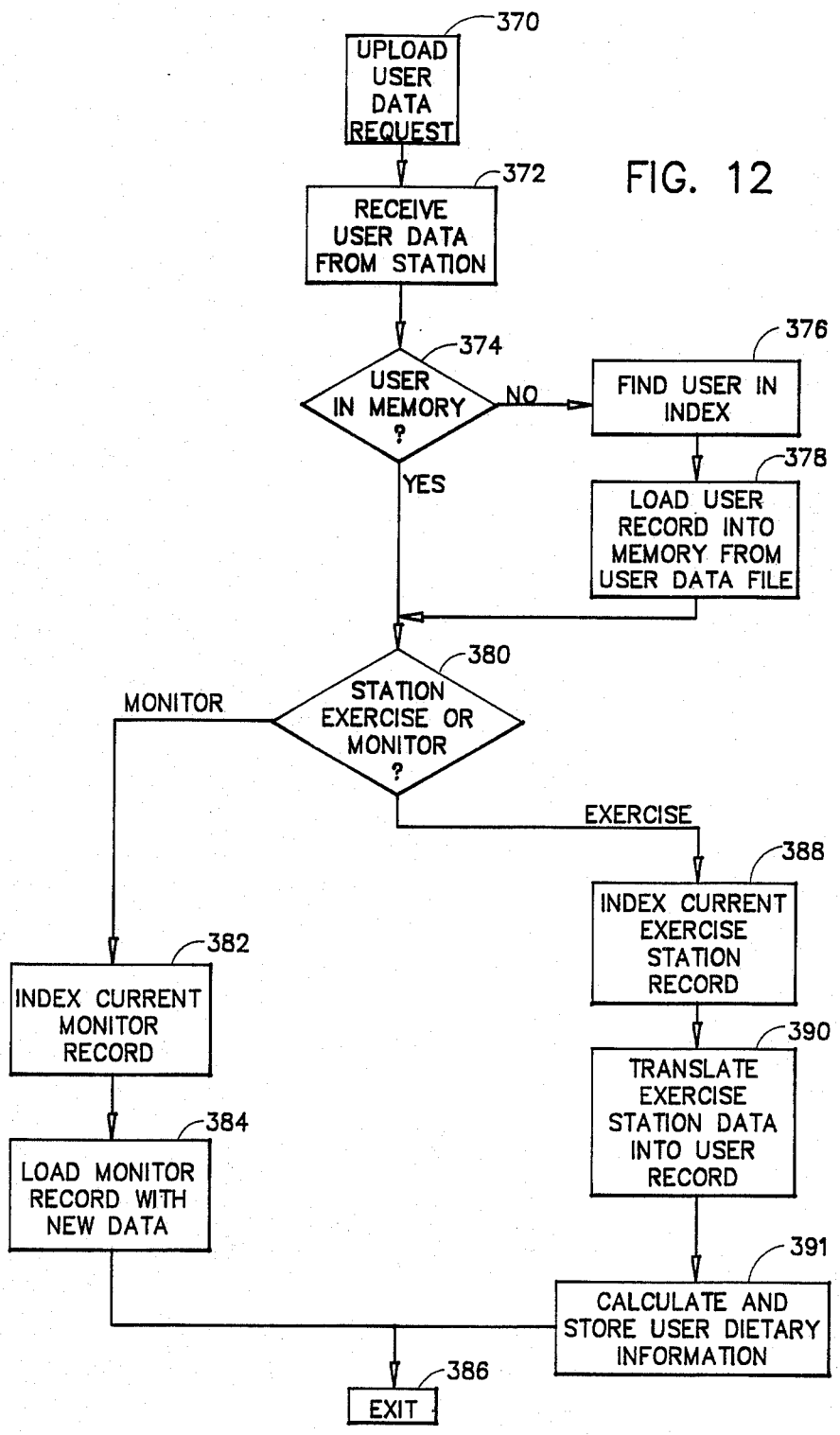

The upload user data request handler illustrated in block 326 of FIG. 9 is performed by the controller 150 moving to the upload user data request block 370 of FIG. 12, and then passing to block 372. In block 372 the controller 150 receives user data from the local station, and then passes to block 374 where the memory is searched based on the data received in block 372 to determine whether the user's information is stored in memory. If the user's information is not found in the memory the controller 150 moves to block 376 and uses the data from block 372 to find the user informatin in the index file stored on disks. Upon finding the user information the controller passes to block 378 and loads that user record into memory from the user data file.

The system next passes from block 378 or, if the user was discovered in memory, from block 374 to block 380. In block 380 the controller 150 evaluates the address information identifying the local station to determine whether this is an exercise station, an interactive printer station, or a monitor station such as a digital scale or body fat measuring device, for example. The interactive printer and monitor stations comprise interactive, intelligent devices which respond to polling signals to communicate information between the CPU and the selected station. If it is a monitor station the controller passes from block 380 to block 386 and indexes a current monitor record. The system next passes to block 384 and loads the monitor record with new data received from the monitor station. Following this, the system passes from block 384 to block 386 and returns to the upload user data request handler 326 of FIG. 9 from whence it exits the module of FIG. 9 via block 318.

In block 380 of FIG. 12 if it is determined that the station is an exercise station, the system passes to block 388 and indexes a current exercise station record. The controller next passes to block 390 and translates the exercise station data received from the station into the user record. Following this, the controller 150 moves from block 390 to block 391 wherein it utilizes the current user record information to calculate and store information comprising diet plans to assist the user in reaching his goals.

Because the central computer 150 can be tied to a weight station and obtain the user's weight as a regular part of the routine, diet and weight control can be performed by the system. In accomplishing the function of block 391, the central computer 150 determines the energy expended or calories consumed by the user in his exercise routine, both the current routine and the projection based on future sessions. The central computer 150 also knows the user's physiological factors such as height and weight which generally determine the metabolic rate and the user's job and other non-exercise session activities. Using this data, the central computer 150 then determines the total energy expended and to be expended by the user. The central computer 150 then maps this into the desired weight control plan for the user, increasing if a gain in muscle is desired, or a reduction if the user is in the beginning portions of a toning program, to determine the optimum number of calories to be consumed by the user to achieve the desired weight in an optimal time. The central computer 150 then suggests diet plans and sometimes even entire meal plans to allow the user to attain his desired goals with a minimum of effort and will power. This allows the user to accomplish several goals at once and creates a coordinated central control of several very interrelated variables, to ease the information and learning requirements of the user, enabling much easier attainment of the user's physical conditioning goals.

The information describe above is communicated to the user along with information and instructions prepared in block 364 of the download user data request routine of FIG. 11. From block 391 of FIG. 12, the controller 150 moves to block 386 and returns to the upload data request handler block 326 of FIG. 9 from whence it exits the module of FIG. 9 via block 318.

Figure 13:
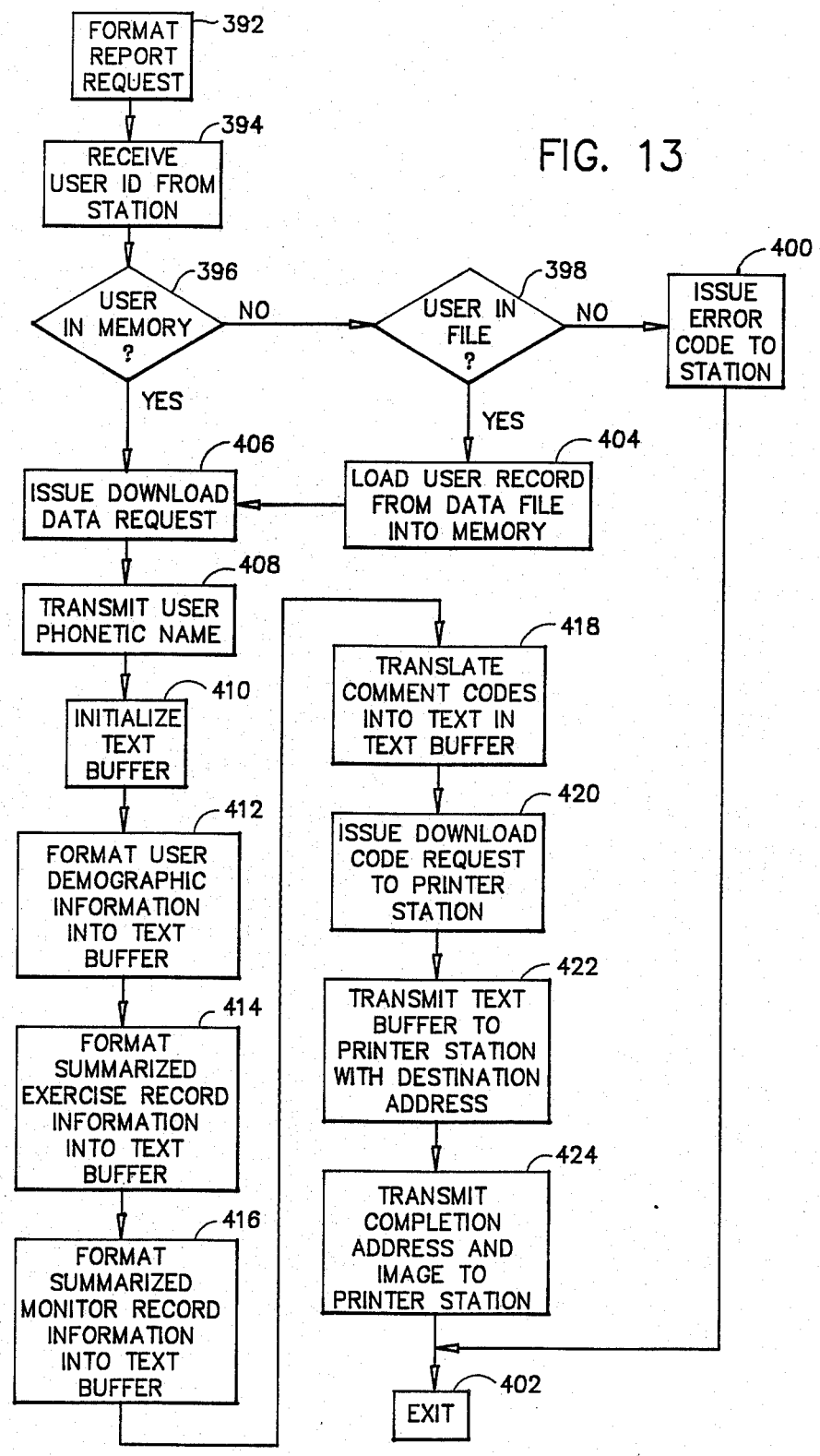

In servicing the format report request handler in block 328 of FIG. 9, the controller 150 passes to block 392 of FIG. 13 and then passes to block 394 wherein it receives the user ID from the local station which is currently being polled.

From block 394 the controller passes to block 396 and searches the memory based on the identification received from the station to determine whether the user is identified in the memory. If the user is not identified in the memory, the controller passes to block 398 and conducts a search of the user index to determine whether the user is identified in that file. If the user is not identified in that file then the controller passes to block 400 wherein it issues an error code to the station and then passes to block 402 from whence it returns to block 328 of FIG. 9 prior to exiting the module of FIG. 9 via block 318.

If, in block 398, it is found that the user was identified in the file the controller passes to block 404 and loads the user record from the data file into the memory. Then from block 404 or, from block 396 if the user was found in memory, the controller passes to block 406 and issues a download data request to the local station. The controller next passes to block 408 and transmits the user phonetic name to the local station. The user phonetic name may not be identical to the user name, but may be spelled differently in order to correspond to the way in which the user's name is correctly pronounced. The spelling of this phonetic name is received from the user at the time his information is initially entered into the system. The process for entering the user phonetic name is defined in more detail hereafter with reference to FIG. 22. After the user phonetic name is transmitted, the controller moves to block 410 and initializes the text buffer.

With the text buffer initialized, the controller moves to block 412 and formats user demographic information into the text buffer. This information may include such things as name, age and sex of the particular user. Following this, the controller moves to block 414 and formats summarized exercise record information from the memory into the text buffer. This exercise record information comprises data such as the initial weight to be simulated by the resistance system, the number of sets of a given exercise performed, and the total number of repetitions of the exercise performed. For purposes of clarifcation, a "set" is defined herein as a period of substantially continuous exercise wherein the user does not stop for more than a given, limited time period, such as 3 seconds. The controller next moves to block 416 and formats summarized monitor record information into the text buffer. The monitor record information comprises data such as weight or percent body fat collected during prior monitored periods. The information is typically organized to be output from the text buffer in a graphical format. Following this action, the controller moves to block 418 and translates comment codes into text in the text buffer. The comment codes comprise numerical data which identify particular text stored in memory. The text consists of comments or instructions such as those made by a coach to a trainee. The codes identifying particular desired text are selected by the CPU 160 based upon the performance of the user. The comment codes are then translated into text in block 418 as described above.

With the text buffer loaded, the controller passes to block 420 and issues a download code request to the printer station. The controller then passes to block 422 and transmits the text buffer to the printer station along with the destination address in preparation for that information to be printed out for the user. The controller then passes to block 424 and transmits the completion address and image to the printer station indicating that all text has been transmitted so that the printer recognizes that the transmission is complete. At this point, the printer can prepare a printed document including the above-described information transferred from the text buffer. The printer will also print any other information such as health club news and the like, previously downloaded to the printer for general distribution. From block 424, the controller passes to block 402 and returns to the format report request handler block 328 of FIG. 9 from whence it exits the module of FIG. 9 via block 318.

Figure 14:
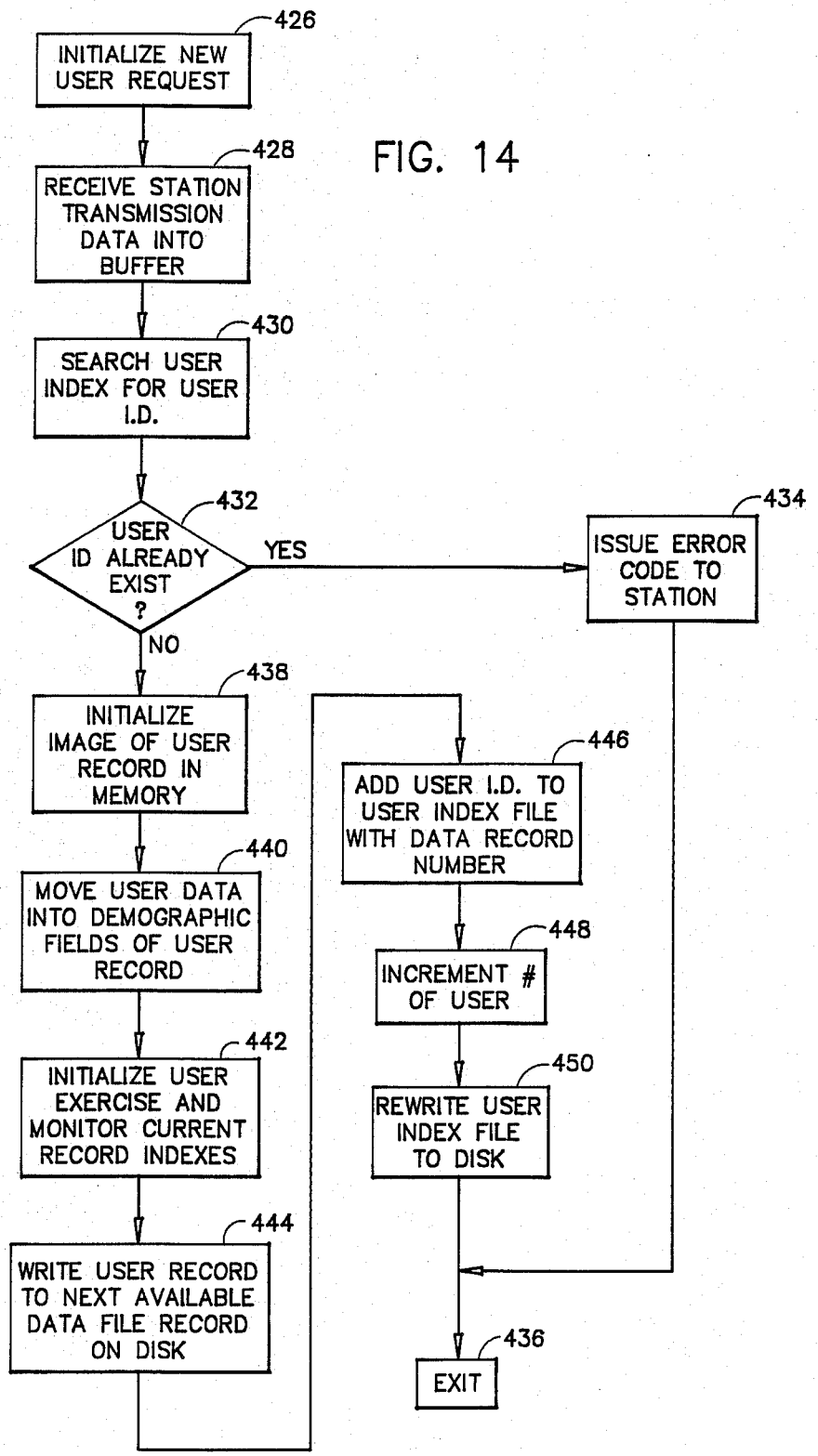

To execute the initialize new user request handler of block 330 in FIG. 9, the controller passes to block 426 of FIG. 14 and then moves to block 428. In block 428 the controller 150 receives station transmission data into a buffer. Following this, the controller moves to block 430 and searches the user index for the user ID. From block 430 the controller passes to block 432 and if the user has been found to exist in the user index, the system passes to block 434 wherein it issues an error code to the station. From block 434 the controller passes to block 436 and returns to the initialize new user request handler block 330 of FIG. 9 prior to exiting the module of FIG. 9 via block 318. If n user ID was found to exist in block 430, the decision in block 432 causes the controller to pass to block 438 and initialize an image of user record in the memory. The controller next moves to block 440 wherein it moves user data from the buffer into demographic fields of the user record.

The controller next passes to block 442 and initializes user exercise and user monitor record indexes. With these indexes initialized, the controller passes to block 444 and writes the user record to the next available data file record on the disk. The controller next passes to block 446 and adds the user identification to the user index file with the data record number. Following this, the controller passes to block 448 and increments the number of the user in preparation for receiving another new user. The controller then passes to block 450 and rewrites the user index file to the disk to complete processing of the new user. The controller next passes from block 450 to block 436 from whence it returns to the initialize new user request handler block 330 of FIG. 9 prior to exiting the module of FIG. 9 via block 318.

In block 332 of FIG. 9, the control services the report idle status. In this block, the controller receives an idle status code indicating that the station which was accessed is not requiring servicing at the present time. Thus, no further servicing is accomplished in block 332 and the controller passes to block 318 from whence it exits the module of FIG. 9.

Having described the various activities of the central control system involving the station I/O poller function of block 308 in FIG. 8, attention is now directed to the activity of the instructor's program defined by block 310 of FIG. 8. The instructor's module of block 310 comprises the execution of any function that an instructor would need to accomplish. This is a menu-driven system wherein the menu is made available to the instructor for accomplishing things such as adding new users, updating user records such as exercise programs, and removing user records.

With exception of selected options to be described hereafter, the instructor's program block 310 of FIG. 8 is executed only through operator interface at the central controller 150. The instructor's program block 310 may best be described by reference to FIG. 15. Initially, the instructor's system main menu is presented in block 460 of FIG. 15. After presenting the main menu, the controller 150 passes to block 462 wherein all files are opened and index arrays are loaded. The controller next passes to block 464 wherein the main menu selections are displayed and an input prompt signal is generated. The controller next passes to block 466 wherein the input option is received from the station. Upon receiving the input option the controller passes to block 468 where it processes the option. The result of processing the option causes the controller to pass to one of several parallel blocks to perform particular options. These options include displaying the system status in block 470, adding a new user in block 472, listing user records in block 474, updating user records in block 476, removing user records in block 478, locating user records in block 480, and shutting down system operation in block 482. The option of adding a new user in block 472 or of updating the user record in block 476 can be accomplished through operator or user interface at either the central controller 150 or the station CPU 160.

So long as the system remains in the instructor's program 310, the controller 150 will continue to return from any of blocks 470–480 to the display of main menu selections block 464 to receive further input options from the user. If, however, the system is to be shutdown in block 482, the controller passes from block 482 to block 484 and closes all files. The controller next passes to block 486 and issues a signal directing all stations to go to the stand-alone mode. The controller then passes to block 488 and exits to the DOS (Disk Operating System).

Figures 15, 16:
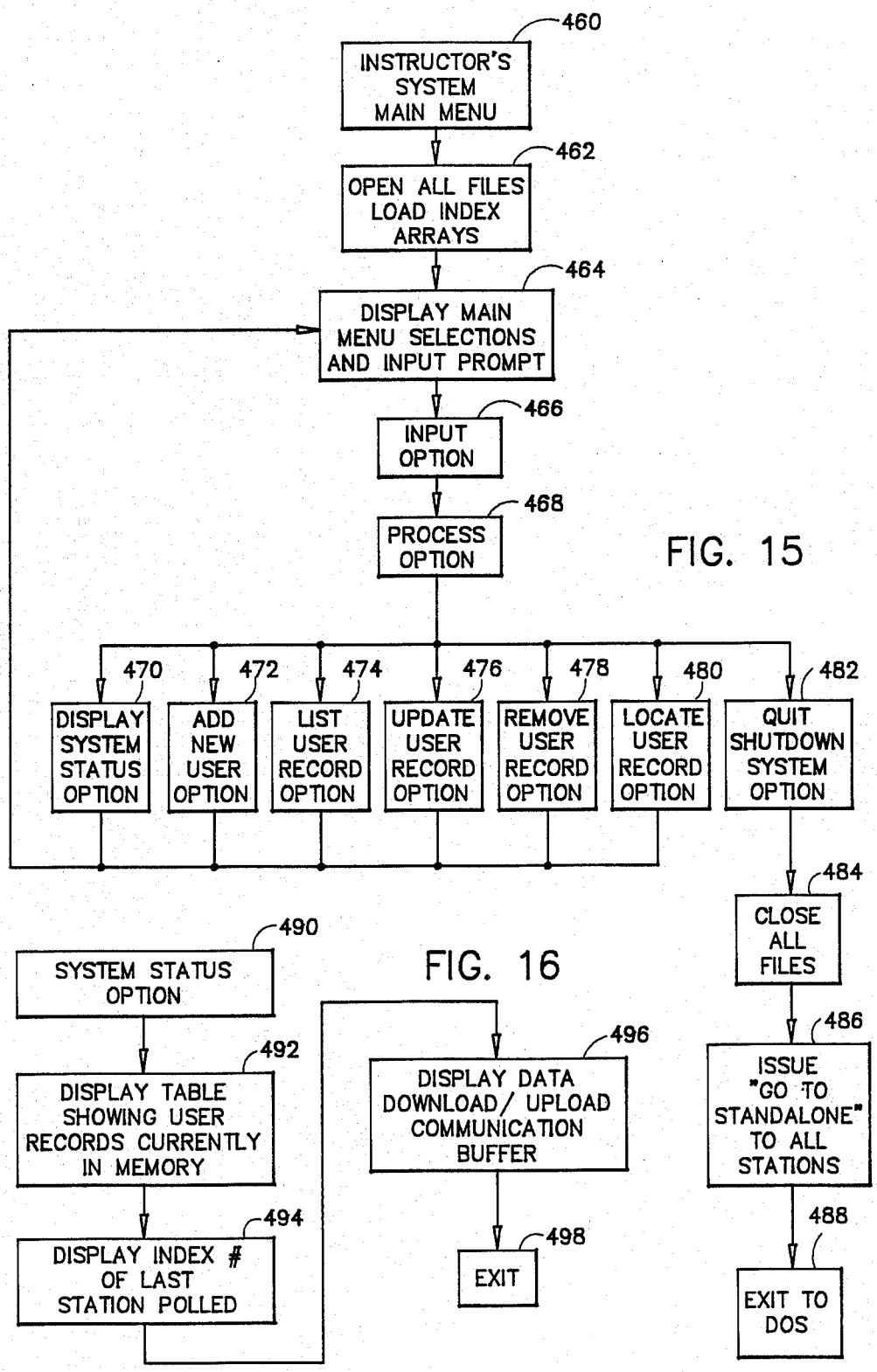

The operation of the various options presented in blocks 470–480 of FIG. 15 will now be presented in somewhat more detail. Referring to FIG. 16, it is seen that the controller 150 passes from block 470 to the system status option block 490, from whence it passes to block 492 and displays a table showing the user records which are currently located in the memory. The controller next passes to block 494 and displays the index number of the last station which was polled. Following this the controller passes to block 496 and displays the data contained in the download/upload communication buffer. Having provided the information necessary to determine the system's status, the controller passes to block 498 from whence it exits block 470 of FIG. 15 by returning to block 464 and displaying the main menu selections and input prompt.

The activities of the controller 150 accomplished in block 472 of FIG. 15 comprise adding a new user module to the system. In accomplishing this, a new file on disk is created and initialized. The instructor is then prompted for all pertinent information relating to the new user. This information may include the phonetic name of the user, the user access code, the user sex, the type of training program desired, when club dues expire, and so forth. The specific way in which the controller 150 accomplishes the functions block 472 with the instructor providing input at the location of the controller 150 may be described by reference to FIG. 17.

Figure 17:
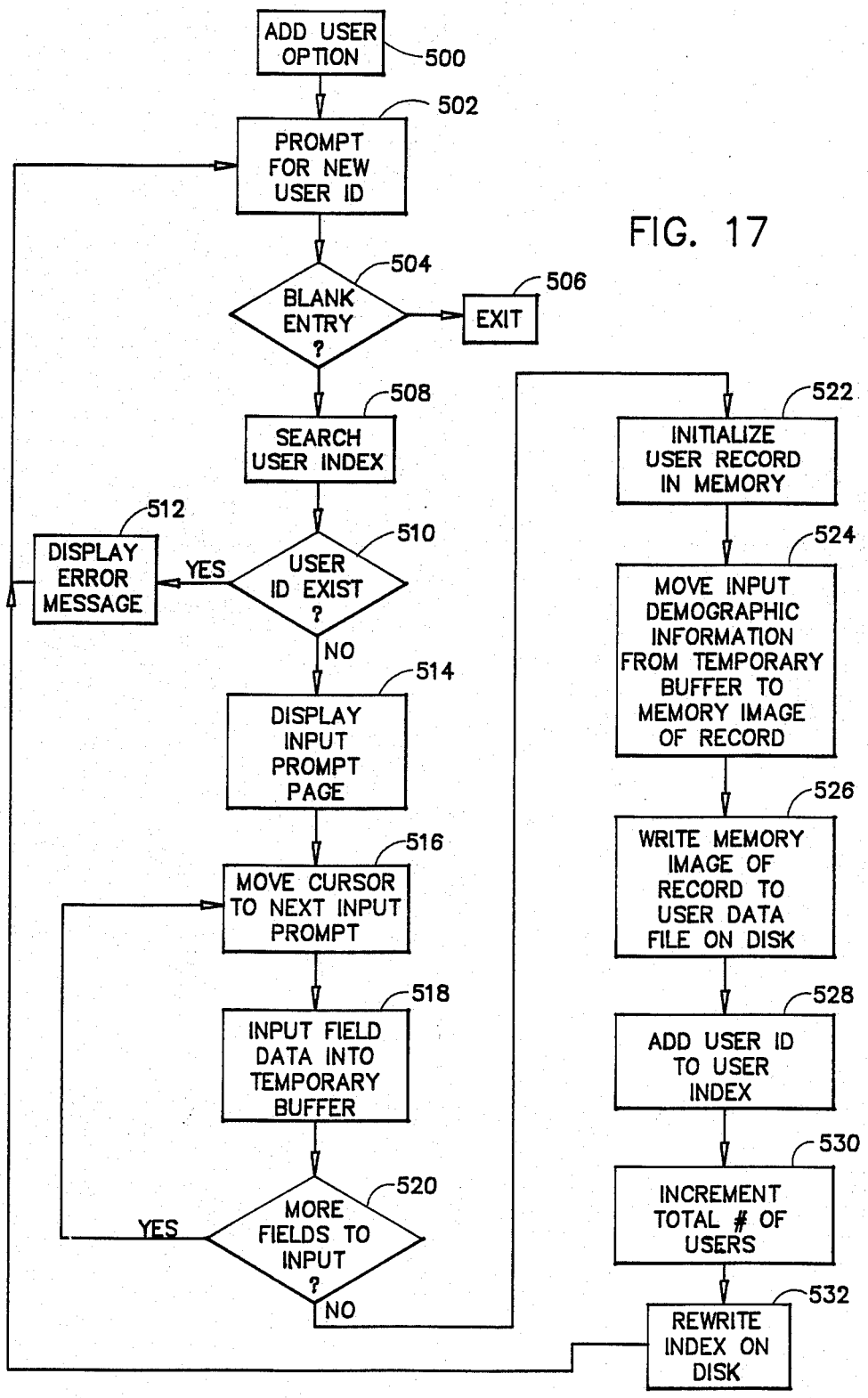

In FIG. 17, the controller first enters block 500 and then passes to block 502 where it prompts for input of a new user ID. Upon receiving the input, the controller passes to block 504 and determines whether the input was a blank entry. If the entry was blank, the controller passes to block 506 and exits execution of the module of FIG. 17. Conversely, if the entry detected in block 504 was not blank, then the controller passes to block 508 and searches the user index to determine whether a corresponding user ID is already in use. From block 508, the controller passes to block 510 and examines the result of the index search.

If the user identification is already in existence, the controller passes from block 510 to block 512 and displays an error message. From block 512 the controller returns to block 502 and generates a prompt signal requesting another user ID. If the results of the query in block 510 indicate that the user ID does not exist, the controller passes to block 514 and displays an input prompt page. The system next passes to block 516 and moves the cursor to the next input prompt, after which the controller passes to block 518 and inputs field data into a temporary buffer. Field data comprises demographic information of the user which is received from the input in a group of fields, with each field being separately designated by identifiers such as "age,"

"sex," "weight" and the like. From block 518 the controller moves to block 520 and determines whether more fields are to be input. If the answer to this query is yes, the controller returns to block 516 and proceeds as described above. If the answer to the query in block 520 is no, the controller passes to block 522 and initializes the user record in memory.

The controller next passes to block 524 and moves the input demographic information from the temporary buffer to the memory image of the record. The controller then moves to block 526 and writes the memory image of the record to the user data file on the disk. After loading this information on the disk, the controller moves to block 528 and adds the user ID to the user index and then moves to block 530 where it increments the total number of users. The controller next moves to block 532 and rewrites the user index onto the disk, after which it returns to block 502 and generates another prompt for a new user ID. The controller continues in this fashion until no entries are discovered as indicated in block 504, after which it exits block 506 and returns to block 464 of FIG. 15 to receive further instructions from the user.

Referring again to FIG. 15, the option in block 474 of listing the user record functions similarly to the option in block 472 of adding a new user. However, in this case no new file is created, but rather the data is merely displayed for review by the requesting party. Particularly, the operation of block 474 is accomplished by prompting for the appropriate user identification, and determining whether the user identification is in the file. If the user identification is located in memory or in the file, then the appropriate demographic information, table of exercise data, and table of monitor station history is accessed and displayed for the requesting party.

The option of updating the user record indicated in block 476 is also similar to the option of adding a new user. In this case, the user is prompted for identification and the system determines whether the user identification is in memory or is in the file. Upon locating the appropriate information, the input prompt page is displayed with the current information. The cursor is moved to the next input prompt and field data is temporarily input to the buffer for updating the particular field. Following the update of the desired field, the data is rewritten in the data file on disk, and the execution of this option is complete. Thus, the update of user records merely comprises reviewing the user records and replacing data in a manner well-known in the technology.

The option of removing a user record defined by block 478, uses the same process of user identification input and searching to identify the user information. In this case, a prompt signal is generated to verify that the user wishes to have information removed from the system. Following the prompt, the user data is removed from memory, the total number of users is decremented, and the user's index is removed from the system. Following the removal of the user's record, the controller 150 passes from block 478 and functions as previously described.

In accomplishing the operation of the LOCATE USER RECORD option as defined by block 480, the user's full name is input and a binary search is undertaken to compare the user's full name with the user name index file. All exact matches are displayed. If there were no exact matches, the closest three matches are displayed. In this manner, a user's record may be located in the system even though his particular ID code may have been forgotten or otherwise become unavailable.

Figure 18:
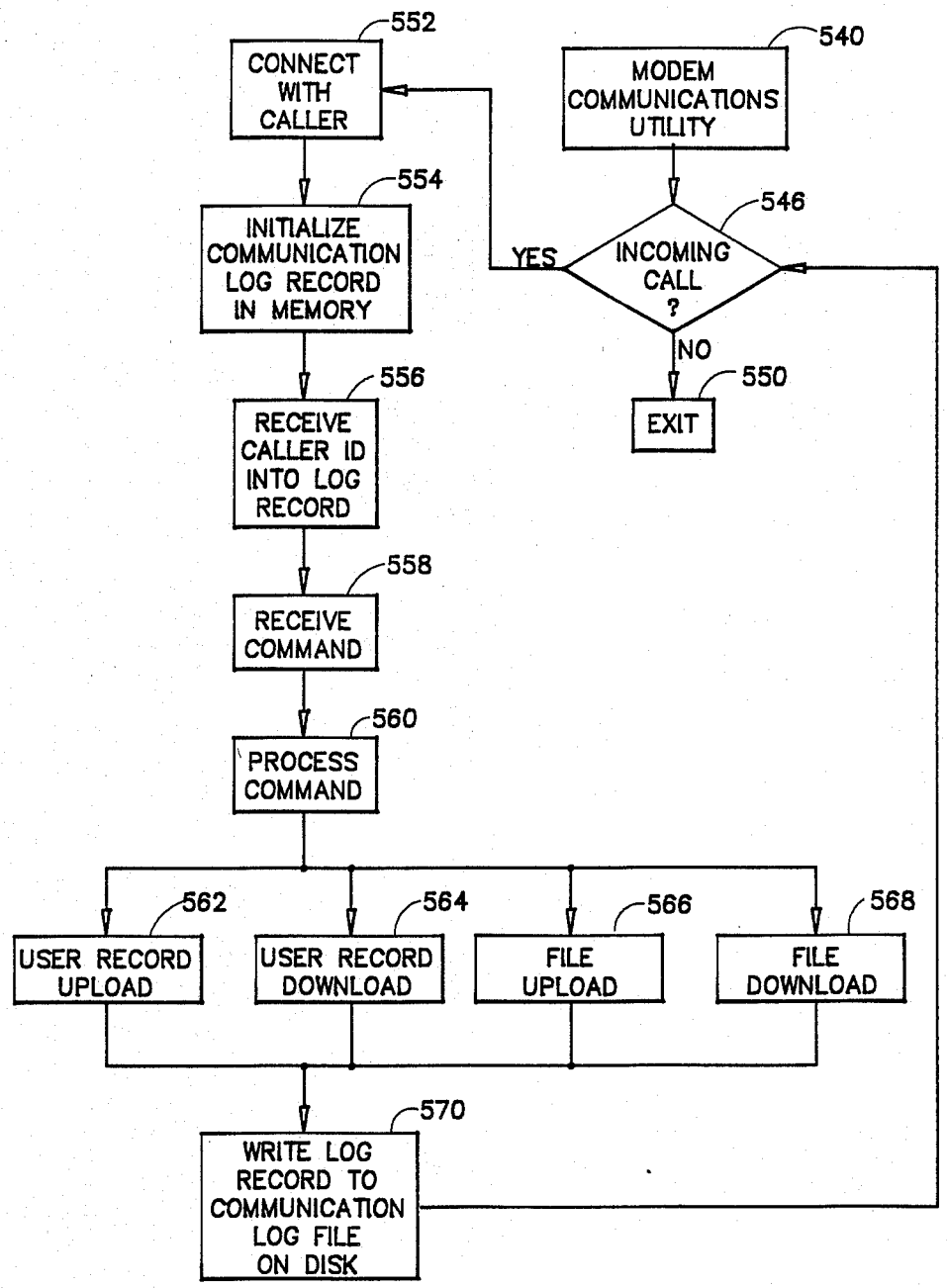

The modem communications utility feature defined by block 304 of FIG. 8 accomplishes the transfer of user information between the central controller and other outside controllers. The modem communications utility defined by block 304 can be more clearly described by reference to FIG. 18.

From the modem communications utility 304 of FIG. 8, the controller 150 moves to block 540 and initiates operation of the modem communications utility. From block 540, the controller passes to block 546 and polls a modem communication port on the PC 150 to detect the presence of an incoming call. If no incoming call is detected the controller passes to block 550 and exits operation of the modem communications utility module.

If an incoming call is detected in block 546, the controller passes to block 552 and connects the central control system with the calling source. The controller then passes to block 554 and initializes a communication log record in memory. With the log record initialized, the controller passes to block 556 and receives the caller identity of the calling source into the log record. The controller then passes to block 558 and receives the command from the calling source. Following this, the controller passes to block 560 and processes the command.

The processed command will instruct the controller to move to one of four different blocks to facilitate transmission of user records or station code files. The user records comprise data specific to the user, while station code files comprise information pertinent to the operation of the particular station, and not including information comprising data from a user's record. Specifically, if a user record is to be uploaded from the central controller to the calling source, the controller passes from block 560 to block 562. The user record is uploaded in block 562 by first receiving the user ID from the calling source, and then searching the user index to locate the corresponding user ID. If the user ID is not contained in the user index, an error code is transmitted to the calling source and the system waits for a new user ID. If the user ID is identified in the index, then the user record is loaded from the user file on disk into the memory. The user record is then transmitted to the calling source and the user data record number is added to a log record identifying which user data records were accessed by a calling source.

If the command processed in block 560 instructs the controller to download the user record from the calling source to the central controller, the controller passes to block 564. The user record is downloaded in block 564 by first receiving the user records ID from the calling source into the memory of the central control system. The system then searches the user index to identify the corresponding user ID. If the user ID exists, a portion of the user record is changed to indicate that the record has been updated in memory. If the user ID is not found to exist, that identification code is added to the user index and the user record from the calling source is added to the user file on the disk. The user record number is also added to the log record to indicate the user's record was downloaded on the given date. After receiving all user records into the memory and updating the user index, the user index is rewritten to the disk, and the operation of the function of block 564 is complete.

If the command processed in block 560 requires that the station code file be uploaded from the central controller to the calling source, the controller passes to block 566. In block 566 the controller receives the file specification from the calling source, and opens the file. If an error is detected, such as the fact that the file does not exist, an error code is transmitted to the calling source and operation in block 566 is terminated. If no error exists, the buffer of the control system is loaded with the file contents and then the contents of this buffer are transmitted to the calling source. This activity is continued until the end of the file is reached, at which time the file specification is added to the log record and execution of block 566 is terminated.

If the command processed in block 560 requires that a file be downloaded from the calling source to the central controller 150, then the controller passes to block 568 to accomplish this function. This function comprises a means by which the operation of a station or central controller may be modified by updating parts of the station or central control code by transmitting the updates from a calling source. In block 568 the file specification is received from the calling source and the file is opened. The file contents are then received from the calling source into the buffer. During this transmission, as the buffer is being filled, its contents are being written to the disk. Once an end of file is detected and the buffer contents have all been written to the disk, the controller adds the file specification to the log record and terminates operation of block 568.

After finishing operation in any of blocks 562, 564, 566, or 568, the controller passes to block 570 and writes the log record which has been updated in the previous block to the communication log file on the disk. With these records all updated and stored, the controller returns to block 546 to determine whether another incoming call is present. The system continues operation from block 546 in the manner described above.

c. The Local Station.

The operation of one preferred embodiment of a local station of the system can best be described by reference to FIGS. 19–40.

Figures 19, 20:
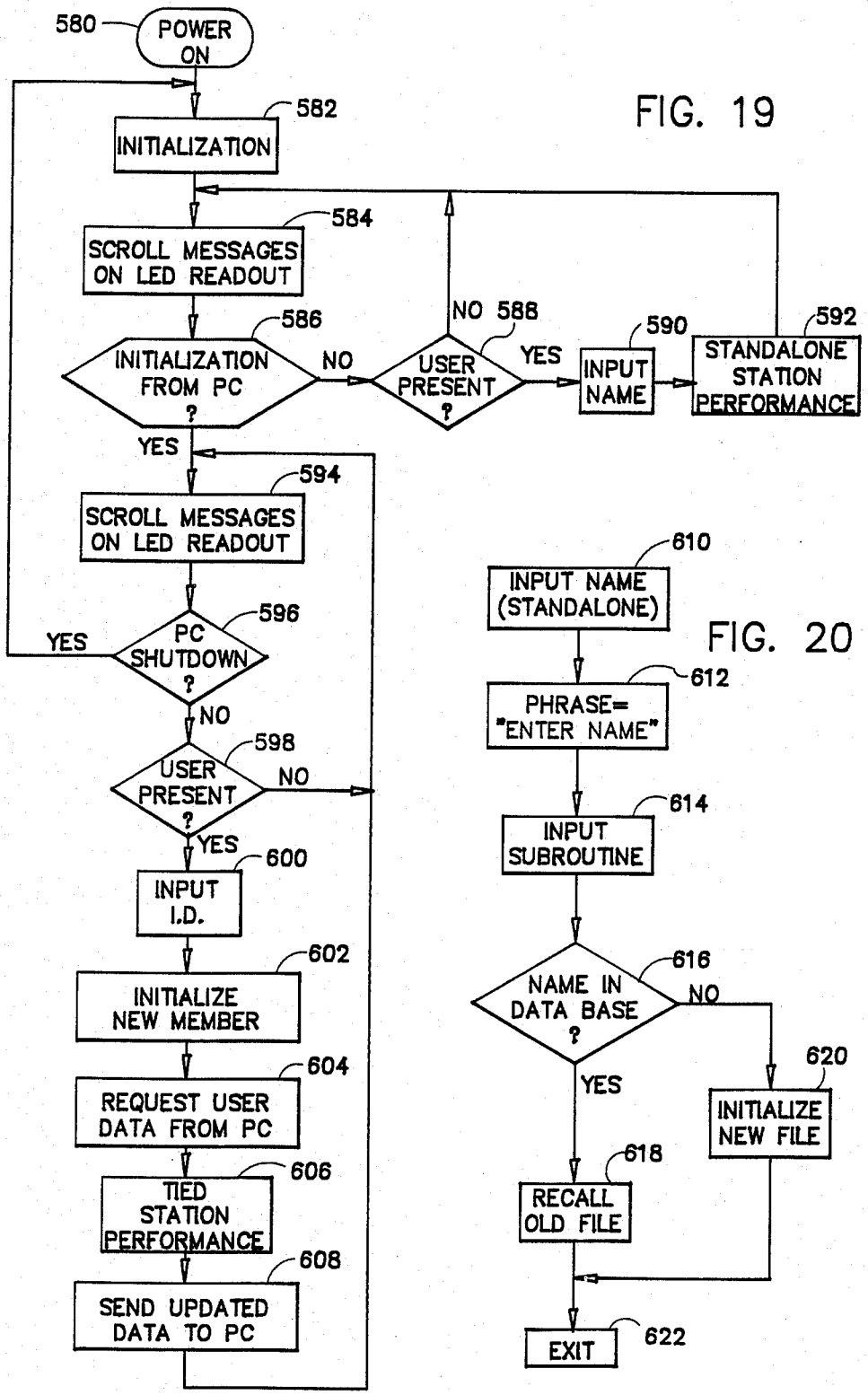

A general understanding of the functioning of the local station can best be achieved by reference to FIG. 19. In FIG. 19, it is seen that operation of the local station is accomplished by turning the power on as indicated in block 580. With the power on, the CPU 160 of the local station moves to block 582 and initializes and boots up the varoous components of the station, so that they are at a preselected operating condition.

Having initialized the system, the CPU moves to block 584 and scrolls any messages which were stored in the ROM memory and designated to be scrolled on the LED readout of the station. The CPU next moves to block 586 and determines whether initialization signals have been received from the central controller 150, evidencing communication capability between the central controller 150 and the CPU 160. The sensed absence of initialization signals indicates absence of polling signals from the central controller 150 providing initialization data to the exercise apparatus. The absence of polling signals from the central controller indicates that communication between the central controller and the CPU cannot presently occur. If no initialization signals have been received, the CPU moves to block 588 and tests signals received from the station input to determine whether a user is present at the station. The user indicates his presence by depressing a key on keyboard 132 of FIG. 4. Of course, other methods of detecting user presence could also be used, such as detecting pressure on hand grips 62 of FIG. 1, or by detecting a monitored heart rate via the heart rate monitor 178 of FIG. 6. If no user is present, the CPU returns to block 584 and functions as described above.

If it is determined in block 588 that a user is present, the CPU moves to block 590 and prompts the user to input his name. The functioning of the input name procedure of block 590 is described more fully hereafter with respect to FIG. 20. Upon receiving the user's name, and identifying the file, the CPU moves to block 592 and performs the function of the station in a stand-alone mode, without communication with the central control station.

Based upon the configuration of the particular station, the performance accomplished in block 592 may comprise obtaining the user's weight if the station comprises a monitor station defining a weight scale, or it may comprise producing a written document if the station is a printer. If the station is a workout system, then exercise of the user will be accomplished. The performance of the monitor, printer and workout modules in the stand-alone mode will be described in more detail hereafter. From block 592, after the exercise session is completed, the CPU returns from block 592 to block 584 and functions in the manner described above.

If it is determined in block 586 that initialization signals to put the local station on-line with the controller 150 have been received from the controller 150, then the CPU moves to block 594 and scrolls messages received from the central controller on the LED readout. After scrolling the messages in block 594, the CPU moves to block 596 and checks to see whether the controller 150 has been shut down. If this is the case, the CPU moves from block 596 to block 582 and functions in the manner described above. If the controller has not been shut down, the CPU moves to block 598 and tests to determine whether a user is present. This test corresponds to that conducted in block 588, described above. If no user is present, the CPU returns to block 594 and functions as described above.

If it is determined in block 598 that a user is present, the CPU moves to block 600 where it requests and checks the identity of the user. Specifically, after prompting the user for his identification code, the CPU requests identification status from the controller 150. The controller 150 checks the identification code from the user against its identification information and indicates whether the code comprises a valid identification. If it does not, the user is again prompted for another identification code and the test continues. If the identification code is determined to be valid, the CPU moves from block 600 to block 602 and performs the function of initializing the new member information. Basically, this entails determining whether the identification received comprises a new member code. If it is a new member code, then appropriate information regarding this user is requested and received from the user. The operation of the new member initialization function will be described in more detail hereafter with reference to FIG. 21.

The CPU next moves to block 604 where it requests user data from the controller 150. This request is in the form of an upload request and is processed by the controller 150 in the manner described previously. Following receipt of the requested data from the controller, the CPU moves to block 606 and performs the function of the station while it is tied to the rest of the system, including the central controller 150. The station function may define, for example, a scale, printer or exercise workout module. Each of these modules will be described hereafter.

Following the system workout the CPU moves to block 608 where it sends the updated user data to the controller 150. This updated user data includes the information developed during operation of the station in block 606. After sending the updated data to the controller 150, the CPU moves from block 608 to block 594 and continues to function in the manner described above.

Referring now to FIG. 20, the operation of the input name function in block 590 of FIG. 19 can be described. This function is accomplished with the station in the stand-alone mode, without communication with the central controller 150. Specifically, the CPU 160 initiates input name operation in block 610 of FIG. 20, from whence the CPU moves to block 612 and assigns the term ENTER NAME to the address identified by PHRASE. The CPU next moves to block 614 and executes the input subroutine in order to prompt the user to enter his name and to receive the name from the user. The operation of the input subroutine will be described hereafter with reference to FIG. 21.

Having received the user's name, the CPU moves to block 616 and compares the name received from the user with the names stored in the database of the station. If the name is in the database, the system moves from block 616 to block 618 and recalls the old file in the station which is identified by that name. If the name is not found in the database, the CPU moves from block 616 to block 620 and initializes a new file in the station which is identified by the name. Having received the name and provided the appropriate file, the CPU moves from either block 618 or block 620 to block 622 from whence it terminates operation of the input name routine of block 590 in FIG. 19.

The input subroutine module indicated at 614 of FIG. 20 can be described by reference to FIG. 21. Here, the CPU initializes the input operation of the input subroutine module at block 624 and then moves to block 626 where it causes the speech output system 164 of FIG. 6 to audibly say the words assigned to the variable "PHRASE". For example, upon executing the input subroutine module in block 614 of FIG. 20, the words ENTER NAME would be audibly reproduced since those terms were assigned to the variable "PHRASE" in block 612 of FIG. 20. Optionally, the words assigned to "PHRASE" may also be scrolled across the LED readout so the user can visually see the words which are being uttered by the station.

The CPU next moves to block 628 where it awaits an input from the user via the keyboard 180 of FIG. 6. This keyboard input is accepted and displayed on the LED readout so that the user can visually see what he has entered in the keyboard. The CPU next moves to block 630 and determines whether the input from the keyboard is complete. If it is not, the CPU returns to block 628 and accepts the next keyboard input in the manner described above. If the input from the keyboard is finished, the CPU moves from block 630 to block 632 and echoes the name which the user has entered by audibly communicating this name to the user via the speech output system 164 of FIG. 6. Optionally, this name can also be visually reproduced in the LED readout.

The CPU next passes to block 634 where it determines whether the name is acceptable. To make this determination, the system waits for an indication from the user that the name is accepted. If the user does not accept the name, the appropriate input is provided and the CPU returns to block 626 and functions as described above. If the name is acceptable, the user so indicates, and the CPU then passes to block 636 and terminates further operation of the input subroutine.

Figure 22:
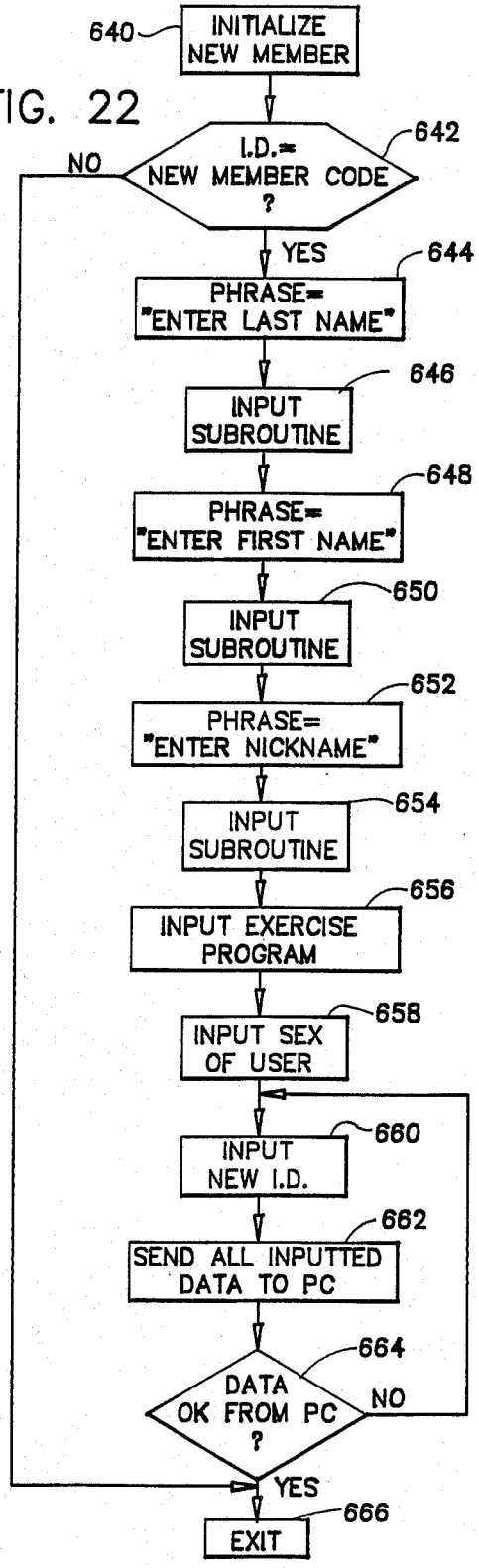

The function of initializing a new member as defined by block 602 of FIG. 19 and corresponding in results to the "ADD A NEW USER" option of block 472 of FIG. 15 can best be described by reference to FIG. 22. Here, with the instructor or user providing input at the station CPU 160, the CPU initiates operation of the initialize new member routine in block 640. The CPU next passes to block 642 where it determines whether the identification numbers provided by the user comprises a new member code. If the identification does comprise a new member code, the CPU passes from block 642 to block 644 and assigns the term ENTER LAST NAME to the variable "PHRASE". The CPU next passes to block 646 and executes the input subroutine which was described with reference to FIG. 21, to receive the last name of the user. The CPU next passes to block 648 and assigns the term ENTER FIRST NAME to the variable "PHRASE". The CPU next passes to block 650 and executes the input subroutine of FIG. 21 to receive the first name of the user.

Figure 21:
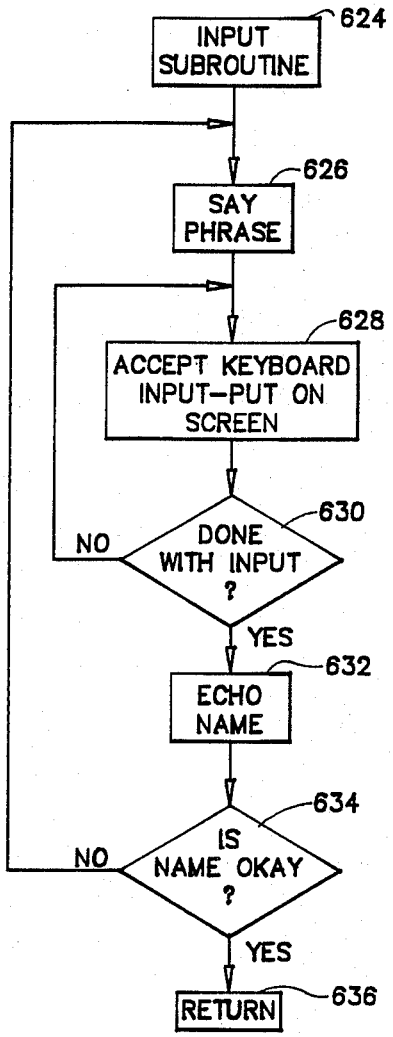

The CPU next passes to block 652 and assigns the term ENTER NICKNAME to the variable "PHRASE", after which it passes to block 654 and executes the input subroutine of FIG. 21 to receive the nickname of the user. This nickname will typically comprise a spelling of the user's name which conforms to the way in which the user's name is to be pronounced. Thus, the "nickname" spelling defines the user's phonetic name, and is used by the system in audibly communicating the user name. The CPU next passes to block 656 wherein the desired exercise program is entered into the station via the keyboard 180 of FIG. 6. This exercise program will typically include the weight to be simulated by the resistance in the system, and the number of repetitions of the exercise to be performed by the user. In the preferred embodiment, this program will be utilized as an option selected by the user if the program automatically selected by the system is not accepted by the user. The process by which the program is automatically selected is explained more fully hereafter.

The CPU next passes from block 656 to block 658 wherein the sex of the user is input to assist in evaluating user performance and in developing recommended exercise programs during user evaluation. The CPU next passes to block 660 where the new user identification is input to the system. Of course, other user information such as age, weight and so forth can be entered by merely expanding this routine to include that information.

Following receipt of the information described above, the CPU moves to block 662 and transmits the inputted data to the central controller 150. From block 662 or, from block 642 if the identification did not define a new member code, the CPU passes to block 664 and awaits indication from the central controller that the data has been received and that it is acceptable. If the data has not been received, or is not acceptable because, for example, the new identification of the user comprises a pre-existing identification code corresponding to another user, then the CPU moves to block 660 and requests another identification code to be input by the user. If the central controller 150 indicates that the data it has received is acceptable, then the CPU passes from block 664 to block 666 and terminates operation of the initialized new member routine.

If the local station is configured to define a scale module, then performance of the station in the stand-alone mode of block 592 in FIG. 19 is accomplished by first prompting the user that the scale is operating. The user stands on the scale and a reading is taken. A previously set zero or reference value is subtracted from the scale reading to obtain the accurate weight, which is then presented on the LED display of the station.

Figure 23:
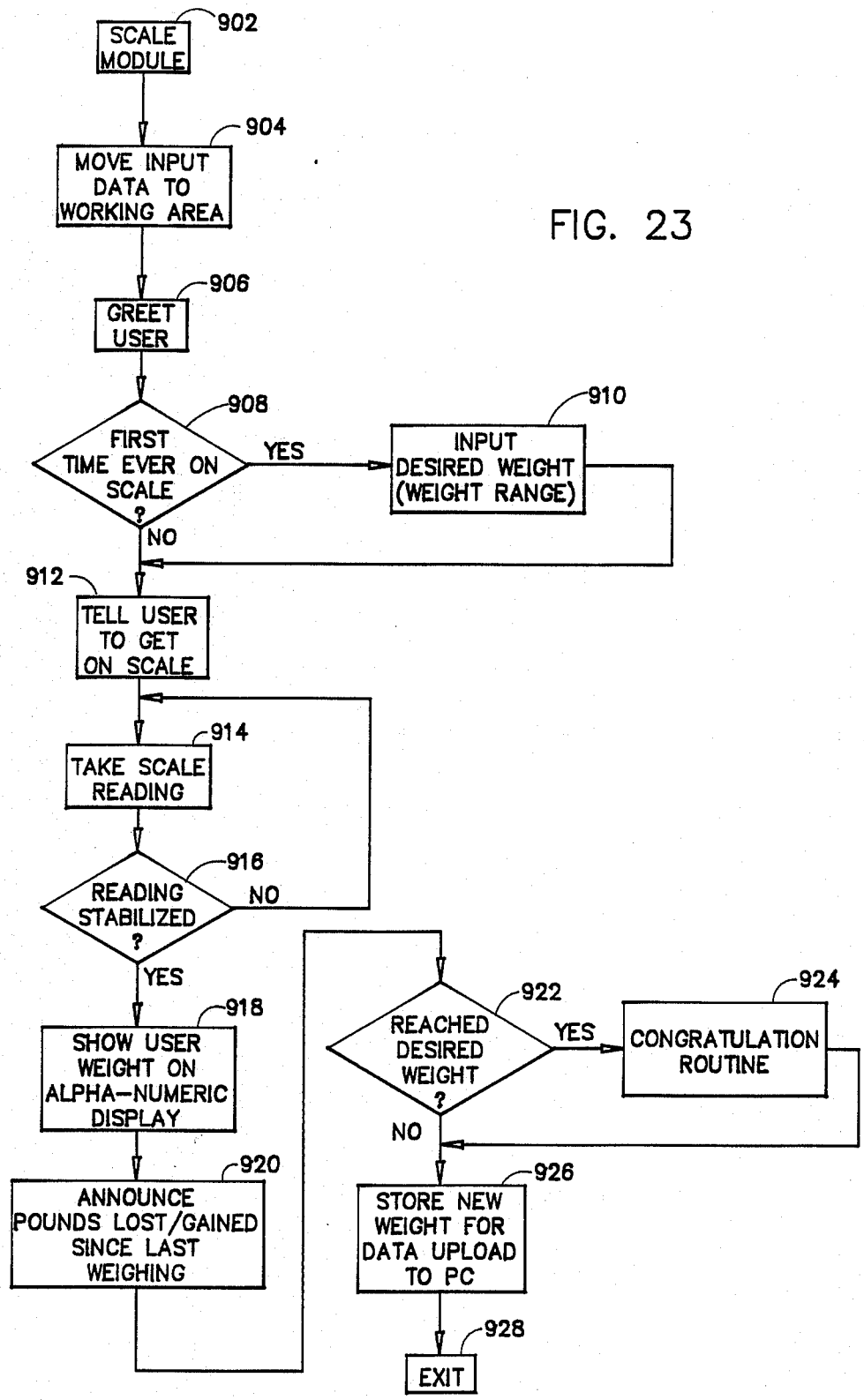

If the system is not in the stand-alone mode, the performance of the scale module station in block 606 of FIG. 19 can best be described by reference to FIG. 23. Specifically, performance is initiated by the CPU in block 902, from whence the CPU moves to block 904 and moves user input data to a working area. The CPU next moves to block 906 and produces a greeting message which is communicated to the user. The CPU next passes to block 908 and examines the input data to determine whether this is the first time the user has ever been on the scale. If this is the first time, no desired weight will be indicated in the input data. Accordingly, the CPU will move from block 908 to block 910 and prompt the user to input a desired weight. After receiving and storing the desired weight from the user in block 910, or from block 908 if this was not the first time on the scale for the user, the CPU moves to block 912 and produces a prompt signal advising the user to step on the scale. With the user on the scale, the CPU passes to block 914 and takes a scale reading. This actually comprises several scale readings taken in rapid succession. The CPU then passes to block 916 and compares the scale readings from block 914 to determine whether the scale has stabilized. If the readings do not fall within a certain threshold level, the CPU returns to block 914 and takes additional scale readings.

If the readings are found to have stabilized in block 916, the CPU moves to block 918 and presents the user's weight on the LED display. The CPU then moves to block 920 where it compares the present weight with the weight of the user at the previous weighing, and then presents an indication of the pounds which have been lost or gained since the previous weighing.

The CPU next passes to block 922 where it compares the current weight with the desired weight value, and determines whether the desired weight has been reached. If the desired weight is reached, the CPU moves to block 924 and produces a congratulatory message which is communicated to the user. From block 924 or, if the desired weight was not reached from block 922, the CPU moves to block 926 and stores the new weight in a location where it will be uploaded to the central controller 150 at the appropriate time. The CPU then passes to block 928 wherein it terminates operation of the scale module routine of FIG. 23.

If the local station comprises a printer module which receives its data from the central controller 150, operation of the printer module in a stand-alone condition such as that indicated at block 592 of FIG. 19 will produce no results. Specifically, since the printer is not in communication with the central controller 150, no communication is possible. Thus, in the stand-alone mode, if a key press is detected by a printer module, a communication will be transmitted to the user advising that "the printer is out of order."

Figure 24:
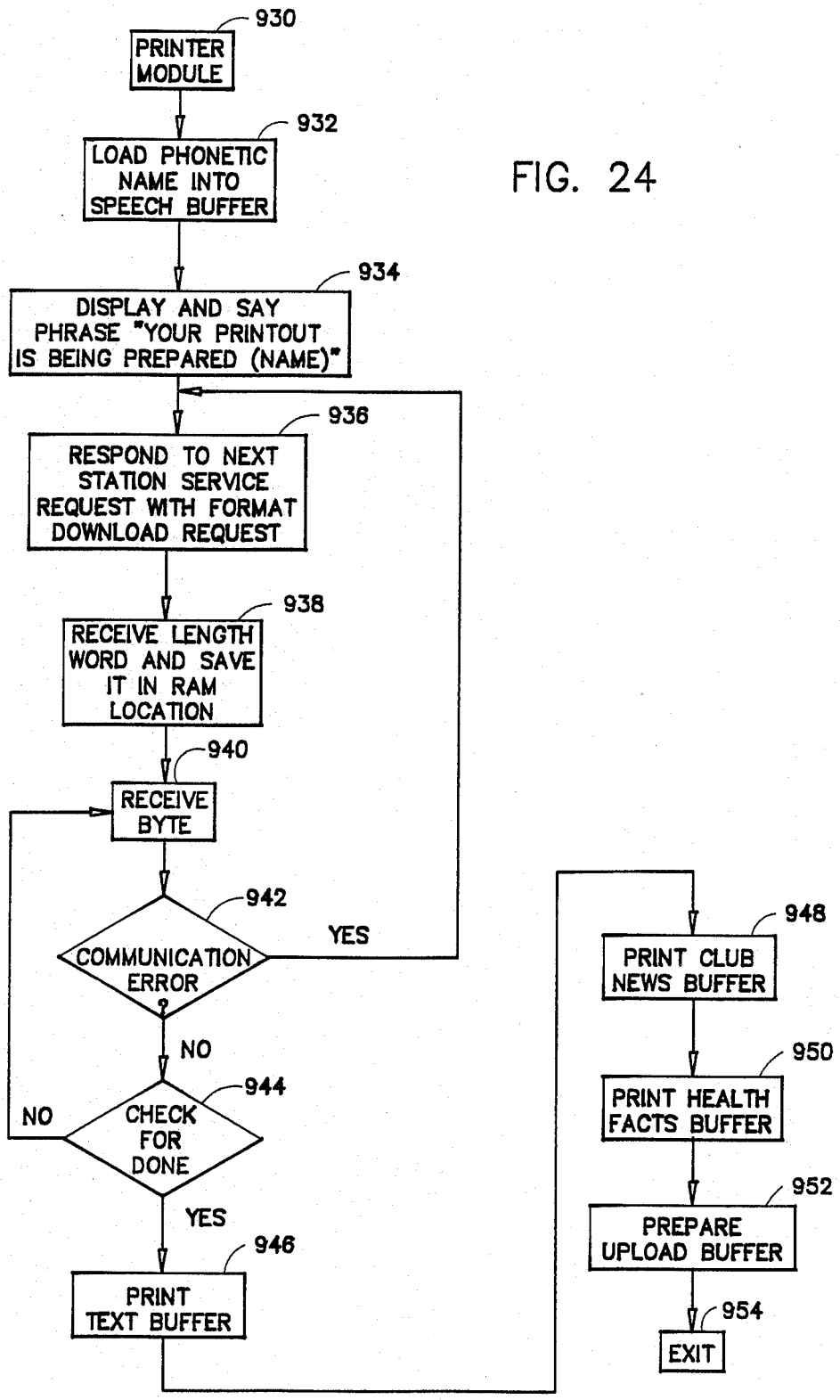

If the local station comprises a printer module which is connected to the CPU 150 in an on-line fashion, then the station performance function of block 606 of FIG. 19 may be described by reference to FIG. 24. Specifically, on-line printer module operation is initiated by the CPU in block 930, after which the CPU moves to block 932 and loads the appropriate phonetic name into the speech buffer. From block 932, the CPU moves to block 934 and both visually displays and audibly reproduces the phrase "your printout is being prepared," followed by the user's name. The CPU then moves to block 936 and responds to the next station service request from the central controller 150 by providing a format download request signal. The CPU then moves to block 938 wherein it receives the length word and saves that information in a RAM location.

The CPU then moves to block 940 where it receives a byte of information from the central controller 150 and retains this information in the text buffer. The CPU next moves to block 942 and compares error check data in the byte of information from controller 150 with a model to determine whether a communication error has occurred. If it is determined that an error has occurred, the CPU moves from block 942 to block 936, and reinitiates the download process by functioning in the manner described above. If no error is detected in block 942, the CPU moves to block 944 and compares the count of the number of bytes received from controller 150 with the length word value received in block 938. If the number of bytes does not equal the length word value, the CPU returns to block 940 and functions as described above.

If the number of bytes is found to equal the length word value, the CPU moves to block 946 and prints the text buffer, following which it moves to block 948 and prints the club news buffer. The CPU then moves to block 950 and prints the health facts buffer. Each of the text buffer, club news buffer, and health facts buffer comprise storage locations containing information such as club news and health information which is of interest to the user.

From block 950, the CPU moves to block 952 and prepares an upload buffer with selected user information such as the user's last name. This information is provided so that data is available for uploading from block 608 of FIG. 19, so that proper system operation is maintained. The CPU then passes to block 954 where it terminates further operation of the printer module of FIG. 24.

If the local station comprises an exercise station, then the workout performed in the stand-alone mode of block 592 of FIG. 19, as well as the workout performed in the normal on-line system mode of block 606 in FIG. 19 can best be described by reference to FIG. 25. Upon initiating performance of the workout routine in block 670 of FIG. 25, the CPU moves to block 672 wherein the weight which is to be simulated by the resistance in the station is established. The functioning of the weight input block 672 will be more fully described hereafter with reference to FIGS. 26–30. After establishing the weight, the CPU moves to block 674 and accomplishes the torque curve determination. This determination is accomplished by multiplying the input weight by selected percentages which define the torque curve. Each of the selected percentages corresponds to the amount of resistance to be applied by the brake in a given segment of the exercise repetition during the exercise program. The torque curve determination of block 674 will be more fully described hereafter with reference FIG. 32. Having determined the torque curve, the CPU passes to block 678 and initializes the components of the station to predetermined conditions specified for beginning the exercise session.

Figure 33:
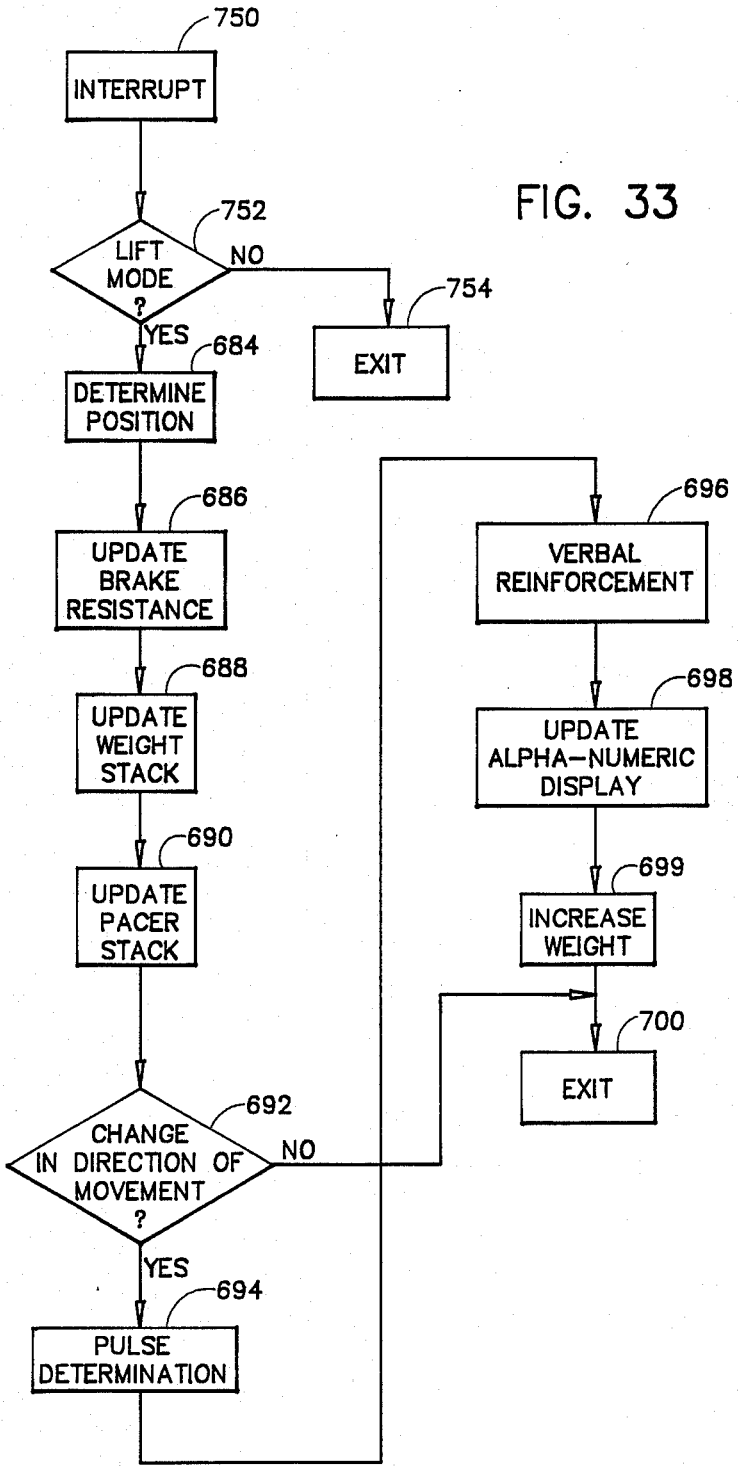

After initiating the exercise session, the CPU moves to block 680 and outputs a reinforcing phrase when an interrupt flag requesting output of the phrase has been set by an interrupt routine to be described hereafter with reference to FIG. 33. The phrase which is output is selected from a lookup table stored in ROM connected to CPU 160, with the selection being based upon performance of the user. For example, if the user is going too fast or too slow, this information will be designated by flags set during operation of the interrupt routine to be described with reference to FIG. 33. Also, if the user is not accomplishing full extension during the exercise cycle, this will be indicated by a flag set during the interrupt routine. The appropriate reinforcing messages are selected based upon the flags which are set.

From block 680, the CPU moves to block 671 where it checks the status of a software timer indicating whether one of the sensors 106 and 108 of FIG. 2 has detected passage of a hole within the past 3 seconds. Upon detection of a hole, the signal from the sensors produces an interrupt signal which initiates operation of the interrupt routine of FIG. 33. This signal also causes reinitialization of the timer which is tested in block 671. Accordingly, if an interrupt has occurred within the past 3 seconds, the CPU will determine in block 671 that a sensor detection has occurred within the designated time period and will return to block 680 to output an appropriate phrase if a flag has been set by the interrupt routine.

If it is determined in block 671 that a sensor has not detected passage of a hole within the past 3 seconds, the CPU will move to block 673 and produce signals which modify the resistance of the brake 64 in a manner which reduces the amount of weight simulated by that brake. The amount of weight reduction is selected based upon desired system operation and upon the goals of the exercise program. In one preferred embodiment, the weight would be reduced by 12½%, or ⅛th of the total amount. Use of this value is particularly convenient when dealing in a hexadecimal number framework of a computer system.

This weight reduction is accomplished based on the assumption that since no passage of holes was detected by the sensors within the designated time period, the amount of weight which was previously selected may be too great to permit the user to move the equipment at the required speed. This problem is possibly overcome by reducing the weight as is accomplished in block 673.

With the weight reduced, the CPU passes to block 675 and produces an audible and optionally visual output indicating that the weight has been reduced, and requesting the user to please continue with the exercise session. The CPU then moves to block 677 where it waits until an interrupt signal is detected, or for 5 seconds, whichever is longer. If an interrupt signal is detected before the 5 second period has elapsed, then the CPU returns to block 680 and functions in the manner described above. If 5 seconds elapse without detection of an interrupt signal which would indicate that the sensors have detected passage of a hole, it is assumed that the user is no longer attempting to use the exercise equipment. Accordingly, under this circumstance, the CPU passes from block 677 to block 679 wherein it disenables operation of the interrupt routine, and verbally and optionally visually communicates to the user the number of repetitions of the exercise which the user has completed.

From block 679, the CPU next moves to block 702 and calculates a rating of the user's performance in the current exercise session. This rating is based on an evaluation of the number of repetitions, the weight used, the percentage of full extension achieved, and the ability of the user to stay in synchronization with the pacer. This information is then communicated to the user. The means by which the rating is accomplished is more fully described hereafter with reference to FIG. 41.

Figure 25:
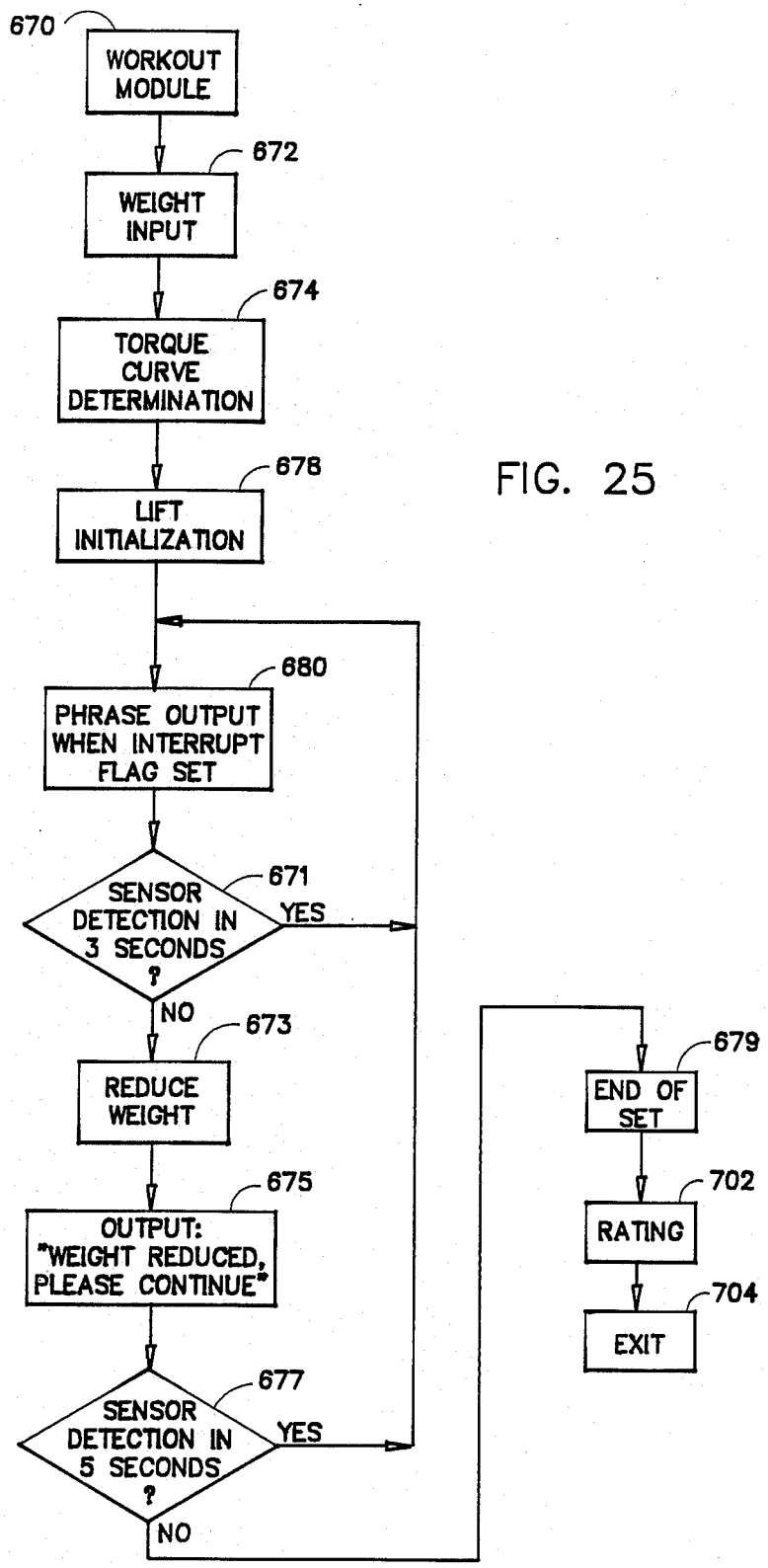

After completing the rating function in block 702 the CPU moves to block 704 and terminates further operation of the workout module of FIG. 25.

The means by which the weight input function of block 672 of FIG. 25 is accomplished can best be described by reference to FIG. 26. The initiation of the weight input routine is accomplished in block 956, from whence the CPU moves to block 958 and moves input data received from the controller 150 and comprising the portion of the user record relating to the specific station into a working area. Specifically, the input data includes information such as individual user demographics, the station exercise program parameters, the number of times the selected program has been used, and past performance data relating to the selected program on the indicated station. From block 958, the CPU moves to block 960 and determines whether the records indicate that the identified user has ever used this station previously. If this is the first time the user has used this station, the CPU moves to block 962 and outputs basic instructions to the user, explaining functioning of features of the station such as operation of the pacer bar, the weight stack and correct procedure for moving the exercise arm in performing exercises on the exercise equipment.

From block 962, the CPU moves to block 964 and performs necessary activities to determine the full extension location of the user. This information is necessary to evaluate the user's performance, and to determine whether the user is fully extending his limbs in the exercise routine. The means for accomplishing the full extension determination of block 964 will be more fully explained hereafter with respect to FIG. 27.

From block 964, the CPU moves to block 966 and initiates a process by which the initial value of weights to be simulated by the magnetic brake are determined. This process involves use of the user's demographic information, as well as an evaluation of his exercise capabilities to establish the initial weight value. The means by which the beginning weights determination is accomplished in block 966 will be explained more fully hereafter with reference to FIGS. 28–30.

Figure 26:
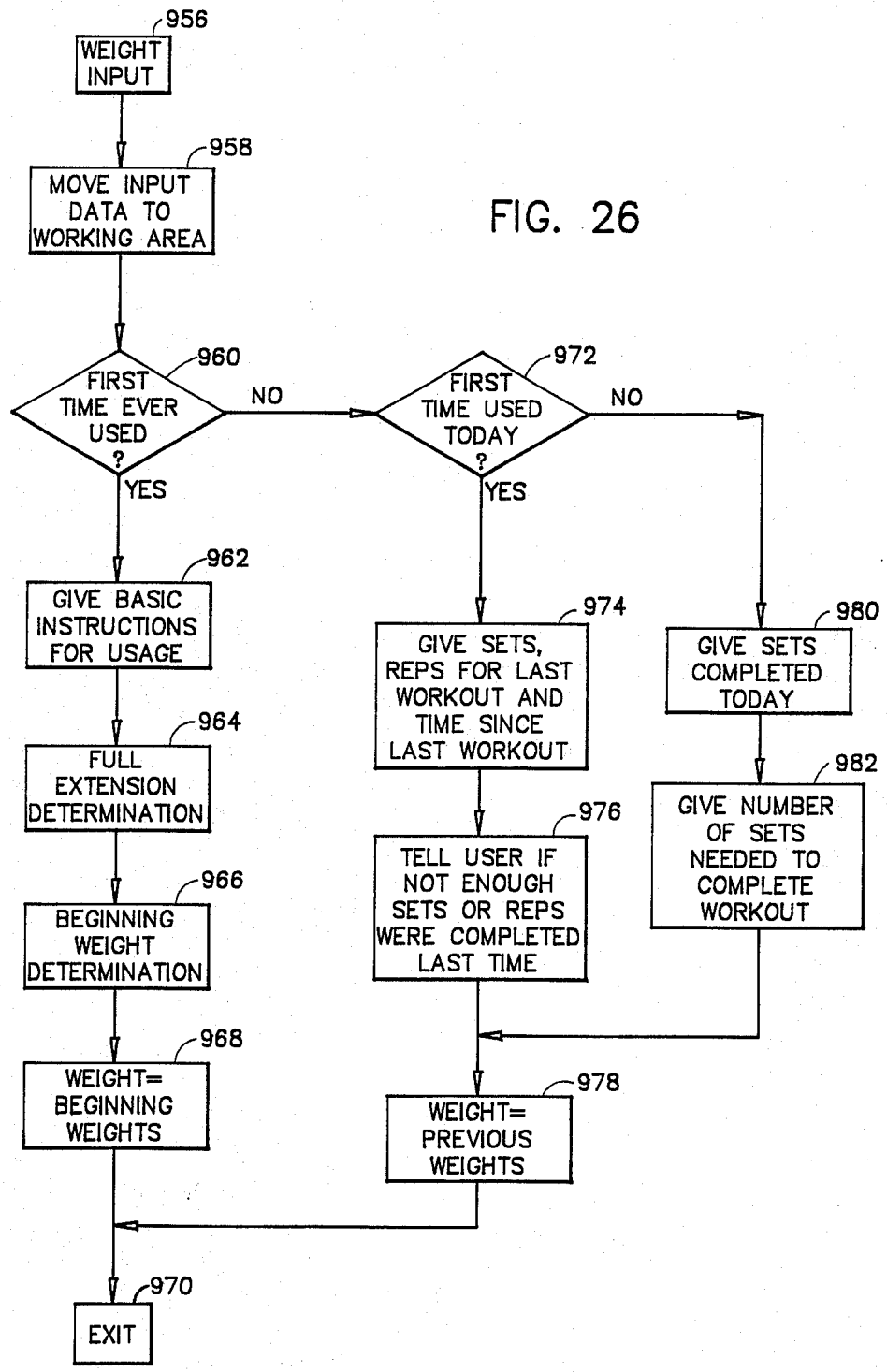

Having determined the initial weight value to be used, the CPU moves from block 966 to block 968 and assigns this beginning weights value to a variable identified as "WEIGHTS." From block 968, the CPU then moves to block 970 and terminates further operation of the weight input routine of FIG. 26.

If it is determined in block 960 that the user has previously used the station, the CPU moves to block 972 and determines whether this is the first time the station has been used by this user today. If this is the first time today, the CPU moves to block 974 and reports to the user the number of sets, and number of repetitions which were accomplished during the last exercise session, and the amount of time which has passed since the last exercise session. The CPU then passes to block 976 and communicates to the user information as to whether the appropriate number of sets or repetitions of the exercise were completed during the last exercise session. The CPU then passes to block 978 and assigns the weight value from the previous exercise session to the variable "WEIGHTS" to establish the weight level to be simulated during the present exercise session by the magnetic brake. The CPU then moves from block 978 to block 970 and terminates further operation of the weight input routine of FIG. 26.

If it is determined in block 972 that it is not the first time the station has been used by this user today, the CPU moves to block 980 and indicates to the user the number of exercise sets which he has completed on that date. The CPU then moves to block 978 and advises the user of the number of the exercise sets needed in order to complete the workout program for that day. The CPU then moves to block 978 and functions in the manner described above.

The means by which the full extension of the user is determined in block 964 of FIG. 26 can best be described by reference to FIG. 27. Initially, the full extension determination is initiated by the CPU in block 984, from whence the CPU moves to block 986 and determines whether this is the type of exercise station wherein the amount of movement of the exercise equipment is related to the user's physical size. For example, the exercise equipment of a leg extension station may be moved through all of its various positions by a person without regard to size. However, equipment such as that in a chest press station can be moved further by a person with a longer reach than by a person having shorter arms or a reduced forward reach. Accordingly, if movement of equipment in the station is not related to the user's physical size, the CPU moves from block 986 to block 988 and assigns a default reach value which is station-dependent, so that full extension is the same for all users of the station. From block 988, the CPU then moves to block 990 where the "REACH VALUE" number is multiplied by a percentage factor based upon the exercise station characteristics, to obtain a value representing a full extension position, which value is assigned to a variable defined as "FULL EXTENSION." The CPU then moves to block 992 and terminates operation of the full extension determination of FIG. 27.

If it is determined in block 986 that movement of equipment in the station is related to the user's physical size, then the CPU moves to block 994 and prompts the user to position the movement arm of the exercise equipment at a start position. With the equipment positioned at this start position, the CPU moves to block 996 and prompts the user to push the movement arm out as far as possible. The CPU then moves to block 998 and utilizes the position sensor equipment to monitor the movement of the arm. When it is determined that movement of the arm has ceased, the CPU moves to block 1000 and saves a value corresponding to the final position ot the movement arm as the "REACH VALUE" for this user. From block 1000, the CPU moves to block 990 and assigns the "REACH VALUE" as multiplied by a percent factor to the "FULL EXTENSION" variable, as discussed previously. The CPU then moves to block 992 and terminates operation of the "FULL EXTENSION" determination routine of FIG. 27.

The means by which the weight values are established for a new user in the beginning weights determination block 966 of FIG. 26 can best be described by reference to FIGS. 28 and 29. Referring initially to FIG. 28, it is seen that the CPU initiates the beginning weights determination at block 1010, after which it moves to block 1012 and sets a flag indicating that the direction of movement (DOM) is up. The CPU then moves to block 1014 and calls the initialize weight routine to be described with reference to FIG. 29, which provides a weight value for the upward direction of movement. The CPU then moves to block 1016 and sets a flag indicating that the direction of movement is downward. Then the CPU then moves to block 1018 and again calls the initialize weight routine of FIG. 29. In this case, the initialize weight routine provides an initial weight value to be used in the downward movement of the exercise equipment. Having established the initial weights, the CPU moves to block 1019 and terminates operation of the beginning weights determination of FIG. 28.

Figures 29, 30:
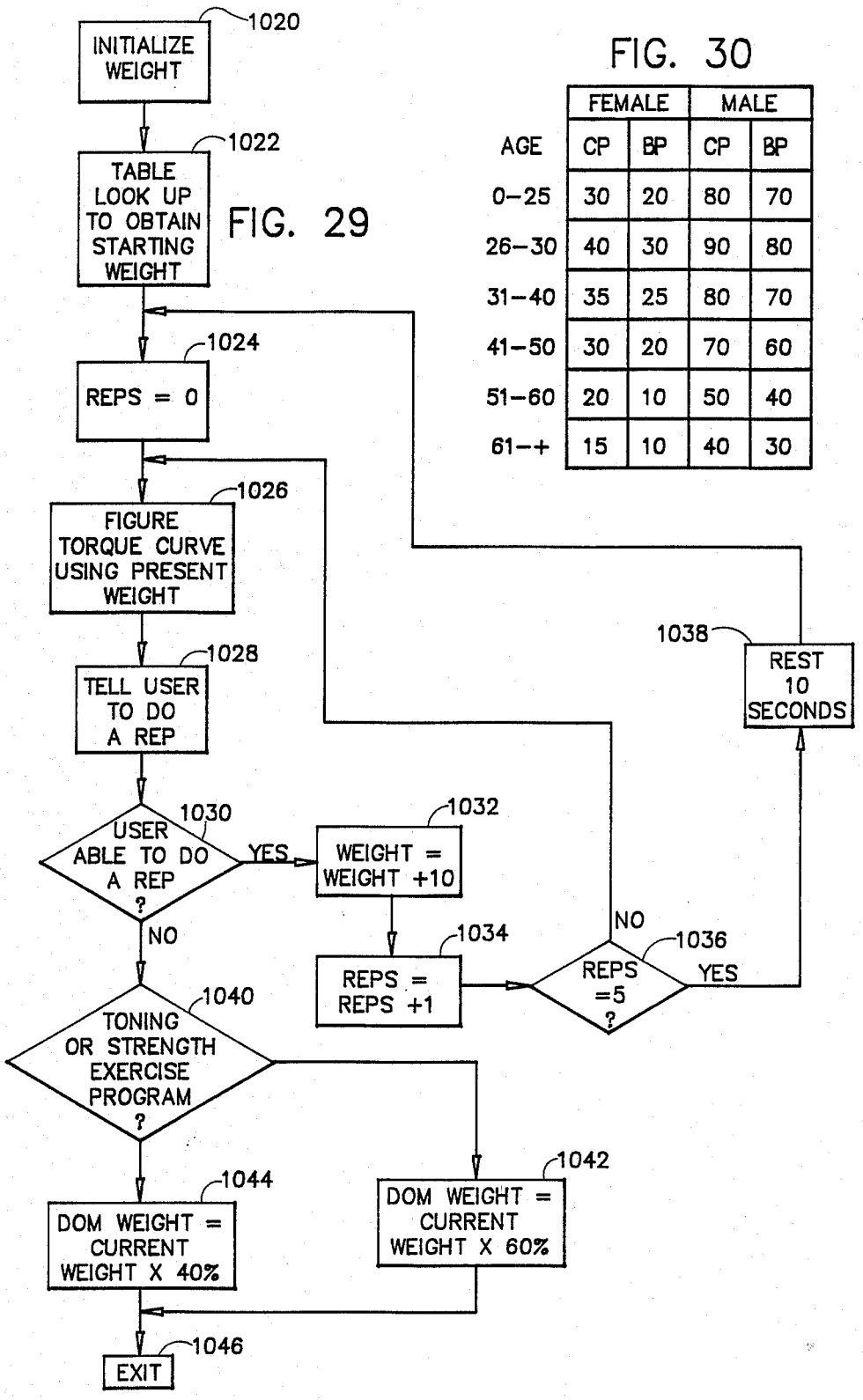

Referring now to FIG. 29, the initialize weight routine of blocks 1014 and 1018 of FIG. 28, is initiated in block 1020 of FIG. 29. The CPU then moves to block 1022 and refers to a table lookup to obtain a starting weight. The weight value selected from the table is based upon information such as age, sex and direction of movement of the equipment. One example of a lookup table for use in block 1022 is illustrated in FIG. 30. This table includes initial weight values for various age ranges, identified according to sex and upward chest press or downward back pull movement of the exercise equipment. For example, from the table of FIG. 30, it is found that a female in the 31–40 age range an initial weight value of 35 pounds for the chest press (CP) movement and 25 pounds for the back pull (BP) movement. A male in this same age range would have an initial weight value of 80 pounds for the chest press movement and 70 pounds for the back pull movement. This table is provided for example purposes only, since such tables would vary depending upon the type of exercise equipment being used, and upon the type of information which is desired to establish the initial weight level.

Having obtained the necessary data from the table, the CPU moves to block 1024 and assigns a variable "REPS" a value of zero. The CPU then moves to block 1026 and uses the current weight value to develop a torque curve for the direction of movement for which the weight is presently being established. The torque curve is determined by multiplying the current weight value by a set of percentages to define particular resistance values for various positions of the exercise equipment. The CPU then moves to block 1028 and prompts the user to do one repetition of the exercise. The CPU then moves to block 1030 and determines whether the user was able to do the repetition. This determination is made by monitoring the position sensing system 66 of FIGS. 1–3 to detect movement of the exercise equipment, and by determining whether full extension was reached based upon the full extension value established in block 964 of the weight input routine of FIG. 26.

If the user was able to do a repetition of the exercise, the CPU moves to block 1032 and assigns to a variable "WEIGHT" the value of WEIGHT+10 POUNDS. The CPU then moves to block 1034 and increments the variable "REPS" by one. The CPU then moves to block 1036 and determines whether the value of "REPS" is equal to five. If the value is not equal to five, the CPU moves to block 1026 and functions in the manner described above. If the value of the "REPS" is equal to five, the CPU moves to block 1038 and permits the user to rest for a period of time such as 10 seconds. This rest period is provided that the user's body can recover somewhat from the efforts and so that the value of the initial weight to be used in the exercise session will not be greatly affected by the user's fatigue.

After the rest period in block 1038, the CPU moves to block 1024 and assigns the value of zero to the variable "REPS," from whence the system continues to function as described above.

If it is determined in block 1030 that the user was not able to do the most recent repetition, then the CPU moves to block 1040 and determines whether the user has selected a toning or strength-building exercise program. Various exercise programs can be provided for the user, based upon the particular goal of the user. For example, a strength-building exercise program may use a greater amount of resistance to increase the weight simulated by the system so that strength is increased more rapidly. On the other hand, toning may utilize somewhat less weight but require more repetitions of a particular exercise. In the example illustrated in block 1040, the two types of exercise programs available are toning or strengthening programs.

If it is determined in block 1040 that the strength program has been selected, the CPU moves to block 1042 and assigns the direction of movement weight value to be the current weight established above multiplied by a particular value such as 60%. The CPU then moves to block 1046 and terminates further operation of the initialize weight routine of FIG. 29.

If it is determined in block 1040 that the toning program was selected, the CPU then moves to block 1044 and assigns the direction of movement weight value to be the current weight value determined above multiplied by a factor such as 40%. The CPU then moves to block 1046 and terminates further operation of the initialize weight routine of FIG. 29.

If the user wishes to select a weight other than the one established in the beginning weights determination block 966 of FIG. 26, he may do so by depressing a "CHANGE WEIGHT" key on keyboard 132 of FIG. 4. The user then enters the desired weight by depressing appropriate keys in this keyboard. The method which the CPU uses to accomplish this change in the weight value is most easily described by reference to FIG. 31. The method is initiated by the CPU in block 710 when a depression of the "CHANGE WEIGHT" key is detected. The CPU then moves to block 712 and sets the initial "up"-weight to a value of zero. The up-weight corresponds to the resistance which will be applied to the exercise equipment while the user's motion of exercise is in the upward direction in the exercise cycle.

From block 712, the CPU moves to block 714 and sets the "down"-weight equal to a value of zero. The down-weight corresponds to the resistance applied to the exercise equipment when the user is moving the equipment in the downward direction during the exercise cycle.

The CPU next moves to block 716 and determines, based on the equipment configuration whether an up-weight value is needed to accomplish the exercise repetition. If up-weight is needed, the CPU passes to block 718 wherein the user is prompted to input the desired weight, and the system waits until a weight value has been received from the user. The CPU next passes to block 720 and compares the up-weight value received from the user with a maximum threshold value. If the up-weight value received from the user exceeds the maximum threshold, the CPU moves to block 722 and sets the up-weight value to the maximum threshold value.

The system moves from block 722, or from block 716 if no up-weight is needed, or from block 720 if the up-weight value does not exceed the maximum threshold weight, to block 724 where it determines whether the station configuration requires a down-weight to accomplish the exercise repetition. If a down-weight is needed, the CPU moves to block 726 and prompts the user to input a down-weight value. Upon receiving a down-weight value from the user, the CPU moves to block 728 and determines whether the down-weight value received from the user exceeds a maximum threshold value. If the maximum threshold value is exceeded, the CPU moves to block 730 and sets the down-weight value to the value of the maximum down-weight threshold.

Figure 31:
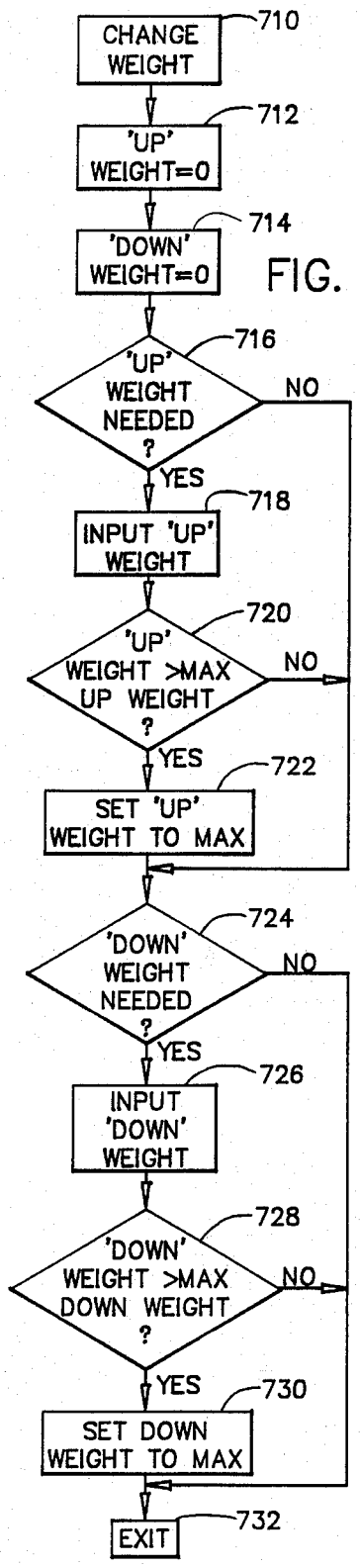

From block 730, or from block 724 if no down-weight was needed, or from block 728 if the down-weight value did not exceed the maximum threshold value, the CPU passes to block 732 and terminates operation of the weight input routine of FIG. 31.

Figure 32:
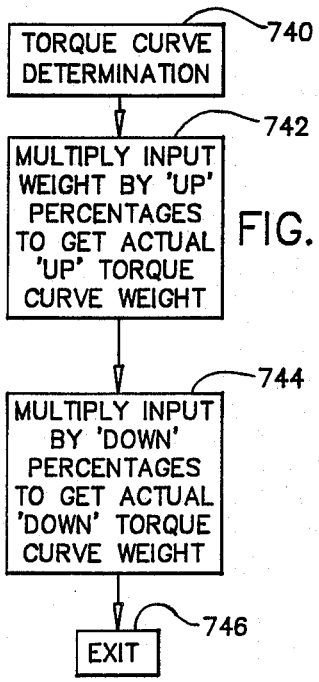

Referring to FIG. 32, the operation of the torque curve determination routine 674 of FIG. 25 can be described. The torque curve determination is initiated in block 740 of FIG. 32, from whence the CPU moves to block 742 and multiplies the up weight value by up percentages which define the torque curve for each position of movement of the exercise equipment. As indicated previously, the equipment movement in the upward and downward directions is divided into a number of segments, with the resistance of each segment being defined by a percentage figure which is representative of the percentage of the full weight value designated by the user. Thus, the amount of weight actually simulated by the resistance along a given segment of the exercise equipment path, corresponds to the full weight designated by the user multiplied by the percentage figure corresponding to the given segment. Thus, in block 742, each of these up percentages corresponding to the segments of the equipment travel path are multiplied by the input weight to obtain the actual up torque curve weight for each of those segments.

The CPU next moves to block 744 and performs the multiplication function described with respect to block 742, but this multiplication function is related to a different group of percentages defining the resistance to be applied in the given segments during downward directed travel of the exercise equipment. After completing the multiplication process of block 744, the CPU moves to block 746 and terminates operation of the torque curve determination routine.

Functioning of the Interrupt routine is now described by reference to FIG. 33. Specifically, operation of the Interrupt routine is initiated in block 750 of FIG. 33, upon receipt of an interrupt signal from either of sensors 106 or 108 of FIG. 2, indicating that the passage of a hole 104 adjacent the sensor has been detected. From block 750, the CPU moves to block 752 and checks a flag set in the lift initialization block 678 of FIG. 25 to determine whether the local station is in the lift mode. If it is determined in block 752 that the station is not in the lift mode, the CPU passes to block 754 and terminates operation of the interrupt routine.

If it is determined in block 752 that the station is in the lift mode, the CPU then passes to block 684 wherein it monitors the position sensing system 66 of FIGS. 1–3, to determine the position of the exercise equipment. The means by which the position is determined in block 684 is more fully described hereafter with reference to FIG. 34.

Upon determining the present position of the exercise equipment, the CPU moves to block 686 and updates the resistance of the magnetic brake to correspond to the resistance value which is specified for this position of the exercise equipment. The method by which the brake resistance is updated in block 686 will be described more fully hereafter with reference to FIG. 35.

The CPU next moves to block 688 and updates the illumination status of the light bars in the weight stack 170 of FIG. 6. The means by which this is accomplished will be described more fully hereafter with reference to FIG. 36. The CPU next moves to block 690 and updates the illumination of light bars in the pacer stack 142 of FIG. 4 and 236 of FIG. 7. The means by which this is accomplished will be more fully described hereafter with reference to FIG. 37.

The CPU next moves to block 692 and determines whether a change in the direction of movement of the exercise equipment has occurred. The occurrence of a change in direction is detected during the determination of equipment position in block 684. In that block, a flag is set when a direction change is detected, with the flag indicating the new direction. This flag is checked in block 692 to determine whether a change in direction of movement of the exercise equipment has occurred.

If the direction of movement has changed, the CPU moves from block 692 to block 694 and determines the pulse of the user by reading pulse data stored in microprocessing unit 262 of FIG. 7 after the information has been sensed by the heart rate monitor 178 of FIG. 6. This pulse data is then stored in an alpha-numeric RAM buffer for display to the user. Following the pulse determination, the CPU moves to block 696 and accomplishes verbal reinforcement techniques by causing audibly-reproduced verbal signals to be communicated to the user. The particular signals to be communicated are selected from a table of signals based upon the performance of the user. The means by which the verbal reinforcement is accomplished are more fully explained hereafter with reference to FIG. 38.

Following verbal reinforcement, the CPU moves to block 698 and updates the alpha-numeric display 166 of FIG. 6 to present the current pulse information, the number of repetitions which have been completed by the user, and optionally to visually scroll the information which was verbally communicated to the user in block 696. The functioning of the update alpha-numeric display feature accomplished in block 698 will be more fully described hereafter with reference to FIG. 39.

From block 698, the CPU moves to block 699 and, if the user has exceeded a designated number of exercise repetitions, increases the simulated weight against which the user is exercising. The conditions under which this weight increase occurs, and the means by which it is accomplished are more fully described hereafter with reference to FIG. 40. From block 699, or from block 692 if no change in direction of movement was detected, the CPU moves to block 700 and returns to the initial workout block 670.

Figure 34:
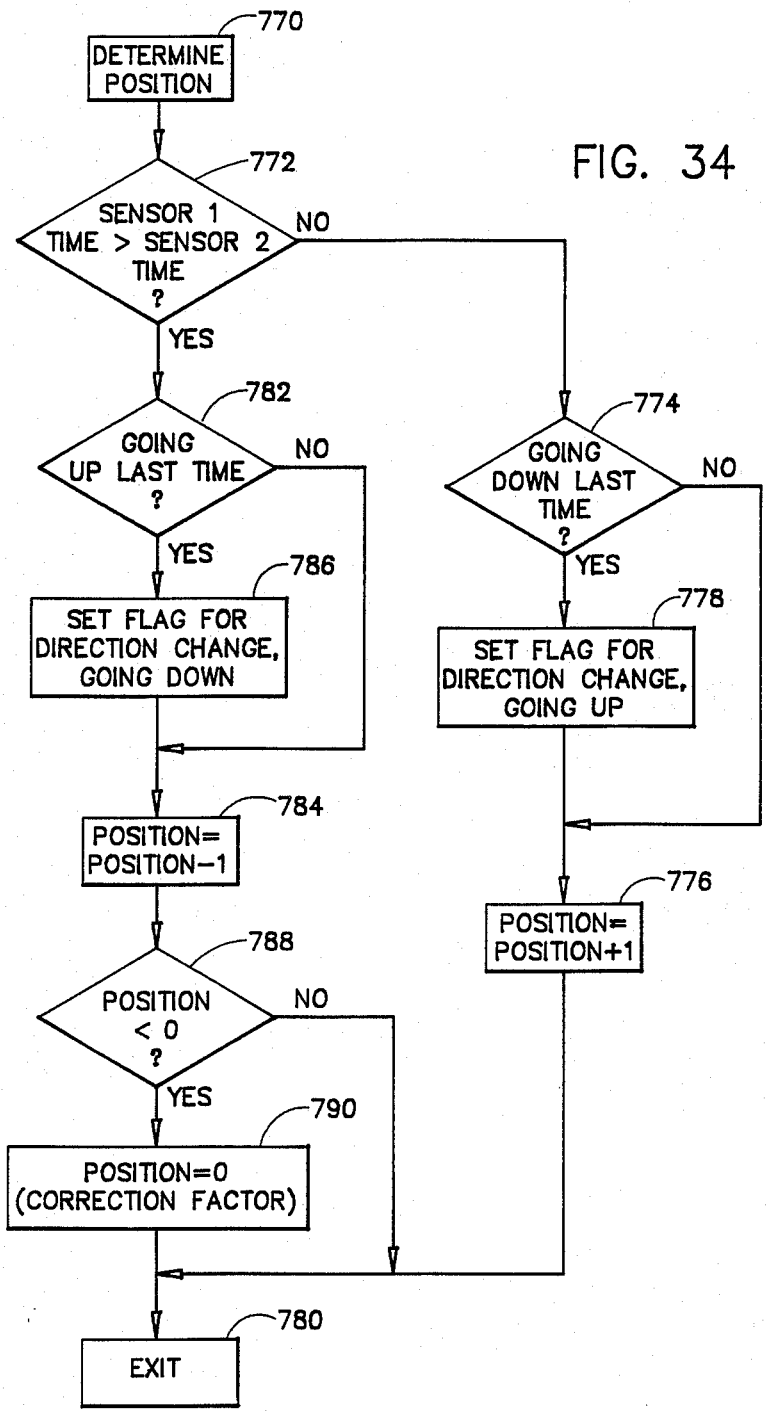

The operation of the determine position routine of block 684 in FIG. 33 is described by reference to FIG. 34. The determine position routine is initiated by the CPU in block 770 of FIG. 34. From block 770, the CPU moves to block 772 and determines whether the time that a hole was detected passing a first sensor such as sensor 106 is greater than the time at which a hole was detected passing a second sensor such as sensor 108 of FIG. 2. These times were previously stored when the interrupt signal was received from the sensors, initiating operation of the interrupt routine of FIG. 33.

If the time at which the hole was detected passing the first sensor 106 was greater than the time at which the hole was detected passing the second sensor 108, this indicates that the direction of movement of the exercise equipment is upward. In this condition the CPU moves from block 772 to block 774 and checks an internal flag to determine whether the exercise equipment was previously going down. If the exercise equipment was going up, the CPU moves from block 774 to block 776 and increments by one the value of a variable POSITION which indicates the position of the exercise equipment. This POSITION value identifies the current segment in the exercise equipment cycle, and defines the appropriate resistance to be applied, as defined by the corresponding segment in the torque curve.

If it is determined in block 774 that the equipment was going down previously, the CPU moves to block 778 and sets an internal flag to indicate that the direction has changed to the going up direction. The CPU then moves from block 778 to block 776 and increments the position value as indicated above. From block 776, the CPU moves to block 780 and terminates operation of the determine position routine of FIG. 34.

If it is determined in block 772 that the time at which a hole was detected passing the first sensor 106 is not greater than the time at which the hole was detected passing the second sensor 108, this would indicate that the equipment is presently moving in a downward direction. In this situation the CPU moves from block 772 to block 782 and examines a flag indicating whether the exercise equipment was previously moving in an upwardly direction. If the equipment was not moving in an upwardly direction, the CPU moves to block 784 and decrements the position value by one. On the other hand, if it is determined in block 782 that the exercise equipment was previously going in an upward direction, the CPU moves to block 786 and sets an internal flag to indicate a direction change, with the exercise equipment currently moving in a downward direction. The CPU then passes from block 786 to block 784 and decrements the position value by one number.

From block 784, the CPU moves to block 788 and determines whether the value of the position variable is less than zero. If the value is not less than zero, the CPU moves to block 780 and terminates operation of the determine position routine. If the position value is found to be less than zero in block 788, the CPU moves to block 790 and assigns the value of zero to the position variable. This is done as a correction means to prevent the value of the position from going negative. From block 790, the CPU passes to block 780 and terminates operation of the determine position routine.

Figure 35:
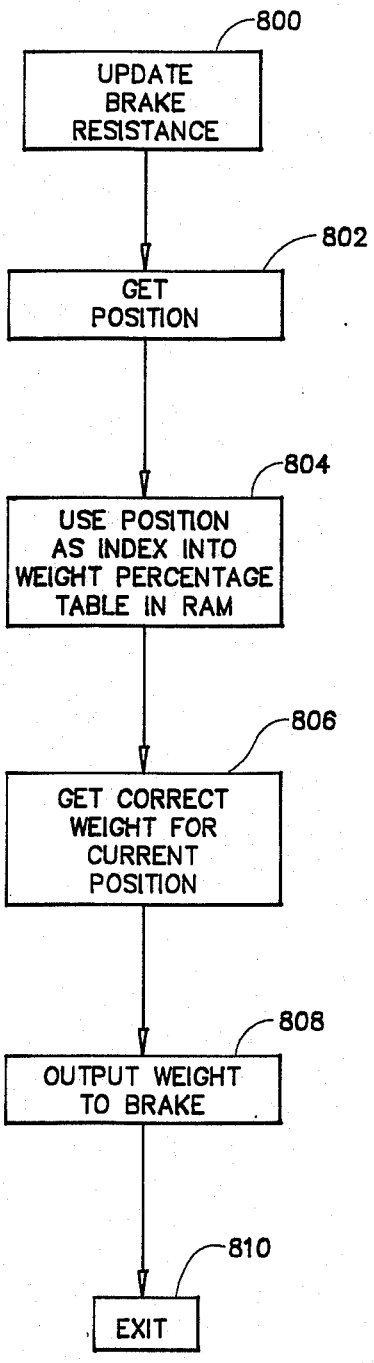

By reference to FIG. 35, it is possible to describe the operation of the update brake resistance routine defined in block 686 of FIG. 33. Here, the CPU initiates operation of the update brake resistance in block 800 of FIG. 35. From block 800, the CPU moves to block 802 and retrieves the position of the exercise equipment as indicated by the position value determined in block 684 of FIG. 33. Having retrieved the position value, the CPU moves to block 804 and uses the position value as an index to a weight percentage table stored in the random access memory of the station. The weight percentage table defines the torque curve described previously. Having retrieved the weight percentage value corresponding to the current position of the equipment, the CPU moves to block 806 and multiplies this weight percentage by the indicated weight value for the particular equipment direction. The CPU next passes to block 808 and outputs to the brake the weight value calculated in block 806, thereby adjusting the brake as necessary to create the desired resistance value on the exercise equipment. From block 808, the CPU moves to block 810 and terminates operation of the update brake resistance routine.

Figure 36:
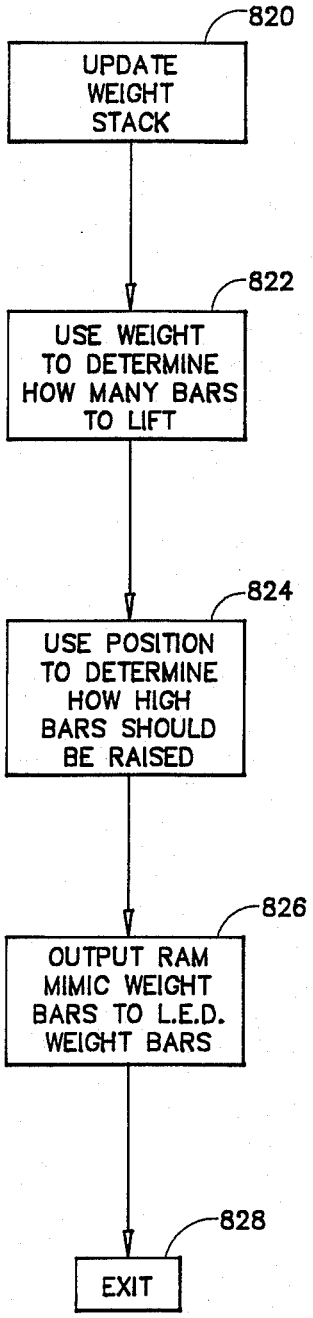

The update weight stack routine of block 688 in FIG. 33 is best described by reference to FIG. 36 wherein the routine is initiated in block 820. From block 820, the CPU moves to block 822 and compares the designated weight value to a table indicating how many light bars on the weight stack should be illuminated to represent the designated weight. For example, each light bar may designate a 25 pound weight. If the designated weight is 100 pounds, the table in block 822 will indicate that four light bars should be illuminated to represent the 100 pounds being lifted.

The CPU next moves to block 824 and references the current position value to determine how high the bars should be raised. Again, a table indicating the height of the illuminated light bars with respect to the height of the weight stack is provided, with the height of the bars being determined by the position of the equipment at the current time. Thus, the height of the bars is selected from the table based upon the current position value.

The CPU next moves to block 826 and outputs the number of bars to be illumninated and the height of the illuminated bars to the LED weight stack system 170 of FIG. 6, causing the appropriate light bars in the weight stack to be illuminated. From block 826, the CPU moves to block 828 and terminates operation of the update weight stack routine.

The weight stack provides a representation of the weight being moved by the user's force. This stack also assists in the pacing activities of the present system, since the user seeks to cause the weight stack to move up and down in conjunction with the pacer light. However, a fixed amount of weight may not permit optimized use of the system. For example, as the user continues in the exercise session, parameters such as fatigue may reduce his ability to maintain a constant pace. Accordingly, with the pace held substantially constant, the amount of weight which is simulated by the resistance is reduced under certain circumstances so that the user may maintain the appropriate pace and aerobic or other desired exercising conditions. The conditions under which the weight is reduced were described previously with reference to FIG. 25.

It is noted that in a two-directional unit, failure may occur in only one direction and not the other. In this situation, only the direction of failure will have the weight amount reduced by the process of FIG. 25. If a subsequent failure occurs in the same exercise set, further weight reductions will be made until the user is able to complete the exercise set. In this same system, if an exerciser exceeds the assigned number of repetitions by more than one repetition, the weight will be incremented by a selected amount such as 12½%, each successive repetition and a record will be kept indicating that the user has exceeded the required number of repetitions. The process for accomplishing the weight increase is performed in the interrupt routine of FIG. 33 and will be described more fully hereafter with reference to FIG. 40. Coaching tips for later communication to the user are developed based on these types of performance.

In one preferred embodiment of the invention, the amount of weight reduction which occurs during the exercise period is based upon a percentage of the number of repetitions of the exercise which have been performed. In another preferred embodiment, this percentage is adjusted based upon the sex of the user, and upon other user demographic information such as age and designated physical condition. In that system, for example, it is acknowledged that if the user has not been involved in an ongoing exercise program, his ability to execute a large number of repetitions at a constant pace would be reduced from one who has been exercising for an extended period of time. Accordingly, as the less experienced user begins to tire, the weight assigned to his exercise session would be reduced at a somewhat greater percentage than the more experienced user. The actual formula for varying the weight depends upon the type of exercise being performed. However, for purposes of example, in a standard shoulder-press and pull-down exercise program, with a completion length of twenty repetitions, an inexperienced user would have weight reduced by 6% in each repetition where the average pace of the prior three repetitions is designated as too slow. For the more experienced user, this percentage reduction would be in the amount of 3% per repetition.

These weight control options are handled in conjunction with the updating of the position of the pacer bars, which is performed in the update pacer stack routine of block 690 of the interrupt routine of FIG. 33. The actions of the system in block 690 can best be described by reference to FIG. 37. The CPU initiates the update pacer stack routine in block 830 of FIG. 37 and then passes to block 832 where it sets the value of weight to be used in the upward direction. As was described above, this weight value relates to the particular repetition of the exercise which is currently being performed.

Having established the desired up-weight for this repetition, the CPU moves to block 834 and establishes a down-weight by use of the same types of criteria as was discussed above. The CPU next moves to block 836 and looks at internal flags to determine whether the pacer lights are moving in an upward or downward direction. If the flags detected in block 836 indicate that the pacer lights are going in an upward direction, the CPU moves to block 838 and determines whether, based upon the given pacer rate, it is time to move the pacer up by lighting the light bar which is next above the currently lit bar in the pacer stack. If it is not yet time to move the pacer light up, the CPU moves to block 840 and terminates operation of the update pacer stack routine.

If it is determined in block 838 that it is time to move the pacer light up, the CPU moves to block 842 and provides an indication that the light bar directly above the presently lit bar is to be illuminated, while the presently lit bar is to be turned off. This information is stored in a RAM mimic memory area until processing is complete.

From block 842, the CPU moves to block 844 and determines whether the newly designated light bar is positioned at the top of the pacer stack. If it is not, the CPU moves to block 846 and outputs the contents of the pacer RAM mimic to the pacer bar, causing the appropriate light bar to be illuminated.

If it is determined in block 844 that the light bar to be illuminated is at the top of the pacer stack, the CPU moves to block 848 and sets a pacer direction flag to indicate that the pacer is now moving in a downward direction. From block 848, the CPU moves to block 846 and outputs the contents of the RAM mimic to the pacer bar, causing illumination of the appropriate light bar.

If it is determined in block 836 that the pacer is not going up, then the CPU moves to block 850 and determines whether it is time to move the pacer light downward based upon the pacer rate. If it is not yet time to move the pacer light downward, then the CPU moves from block 850 to block 840 and terminates operation of the update pacer stack routine.

If it is determined in block 850 that it is time to move the pacer down, then the CPU moves to block 852 and indicates in the RAM mimic that the illuminated light bar should be moved down one position. The CPU then moves to block 854 and determines whether the light bar to be illuminated is at the bottom of the pacer stack. If it is not at the bottom, the CPU moves to block 856 and outputs the contents of the pacer RAM mimic to the pacer bar, causing illumination of the appropriate light bar.

If it is determined in block 854 that the illuminated light bar is at the bottom of the pacer stack, the CPU moves to block 858 and determines whether the topmost light bar of the weight stack is also at its lowest position, indicating that the light bars of the weight stack are also at the bottom of their run. If this is the case, the CPU moves to block 860 and changes the pacer direction flag to indicate that the pacer is moving in an upward direction. The CPU then moves to block 856 and performs in the manner described previously with respect to that block.

In block 858, if it is determined by comparing the pacer light with the topmost weight stack light that the light bars of the weight stack are not at the bottom, the CPU moves to block 862 and determines whether the light bars of the weight stack which represent the user's exercise position indicate that the user is halfway along the upward stroke of the next repetition of the exercise. If this is the case, the CPU moves to block 864 and sets a pace flag to indicate that the user is exercising at a rate which is faster than the pacer. The CPU then passes from block 864 to block 856 and outputs the pacer RAM mimic to the pacer bar as described previously.

From block 862, if it is determined that the user is not halfway along the upward stroke of the next repetition, the CPU moves to block 866 and determines whether the light bar of the pacer stack has been waiting at the bottom stack for one-fourth of the period of the pacer rate. It is noted that in one preferred embodiment, when the pacer reaches the bottom of the pacer stack, if the user's exercise position has not caused the LED'S of the weight stack to reach the bottom of that stack, the pacer will wait for the user to catch up. This keeps the user from getting so far out of synchronization with the pacer signal that it becomes impossible for him to catch the pacer, or it becomes confusing as to where he is with respect to the pacer.

If it is determined that the pacer has waited at the bottom of the pacer stack for the appropriate period of time, then the CPU moves to block 868 and sets a pace flag to indicate that the user is exercising at a rate slower than the desired rate. On the other hand, if the pacer has not been at the bottom for the selected time, then the CPU moves to block 856 and functions as described above.

The use of the pacer as described above provides a means for assisting the user to maintain a more constant exercise repetition rate, and thus enables the user to achieve a more stable and continuous aerobic or other desired condition. The use of the pacer as described also permits ongoing evaluation of the user's performance, with this evaluation being immediately reportable to the user so that he may appropriately adjust his exercising efforts to maintain the desired exercising condition.

The evaluation of the user, and the associated communication of information to assist the user in achieving his desired exercise effort is at least partially accomplished by use of verbal reinforcement as indicated at block 696 of FIG. 33. The means by which verbal reinforcement is accomplished may be described with reference to FIG. 38. Specifically, the CPU initiates verbal reinforcement in block 870 of FIG. 38. From block 870, the CPU moves to block 871 wherein it checks the flag which was set in block 786 of FIG. 34 to determine whether the direction of movement of the movable arm of the exercise equipment is going down. If it is determined in block 871 that the movable arm is going down, the CPU moves to block 872 wherein the CPU determines whether the position of the arm established in block 684 of the interrupt routine of FIG. 33 comprises a value which is less than the full extension value established in block 990 of FIG. 27, multiplied by a selected percentage such as 75%. This percentage multiplier is used to define a region about the full extension position of the arm which will be considered a full extension of the arm by the user during his exercise period. If the value of the position variable is less than the adjusted full extension value, then the user has not adequately extended the arm. Accordingly, the CPU moves to block 873 and sets a flag to cause the phrase output of "FULL EXTENSION!" to be produced in block 680 of the workout module of FIG. 25. With the flag set in block 873, the CPU moves to block 874 and terminates operation of the verbal reinforcement routine.

If it is determined in block 872 that the value of the position variable is not less than the adjusted full extension value, the CPU moves to block 875 and obtains a random number by means of a conventional random number selection process. The CPU then moves to block 876 where it determines whether the random number is evenly divisible by 8. If the number is divisible by 8, the CPU moves to block 877 and sets a flag causing the phrase output in block 680 of the workout module in FIG. 25 to produce a random phrase output which encourages the user. The use of the test in block 876 to determine whether the random number is evenly divisible by 8, results in the random phrase output enabled in block 877 to be provided randomly, on the average of once every eight repetitions of the exercise cycle. From block 877, the CPU moves to block 874 and terminates further operation of the verbal reinforcement routine.

If it is determined in block 876 that the random number is not evenly divisible by 8, the CPU moves to block 878 and sets a flag causing the phrase output in block 680 of FIG. 25 to communicate the number of repetitions which have just been completed by the user in his current exercise set. The CPU then moves to block 874 and terminates operation of the verbal reinforcement routine.

Figure 37:
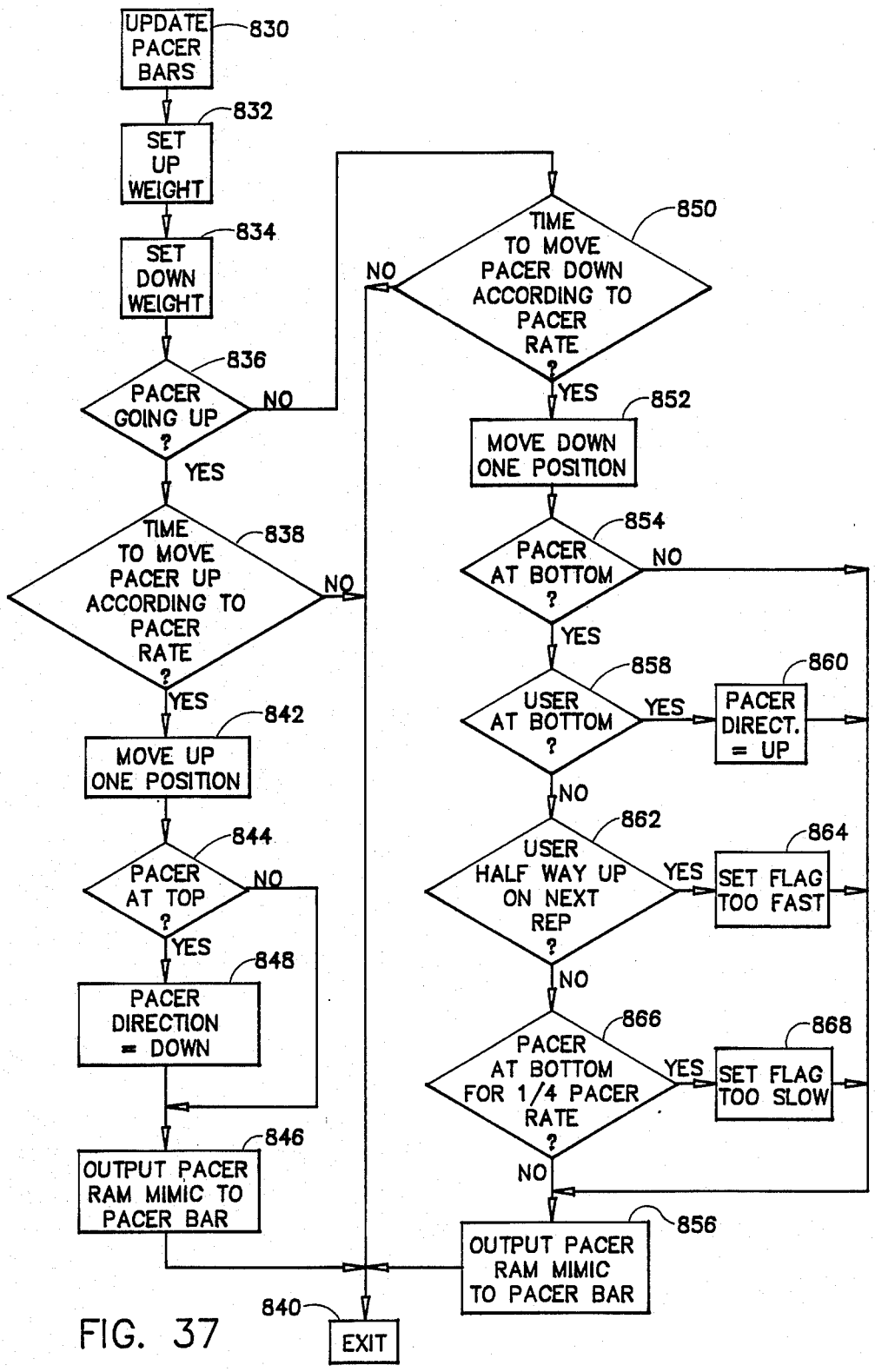
Figure 38:
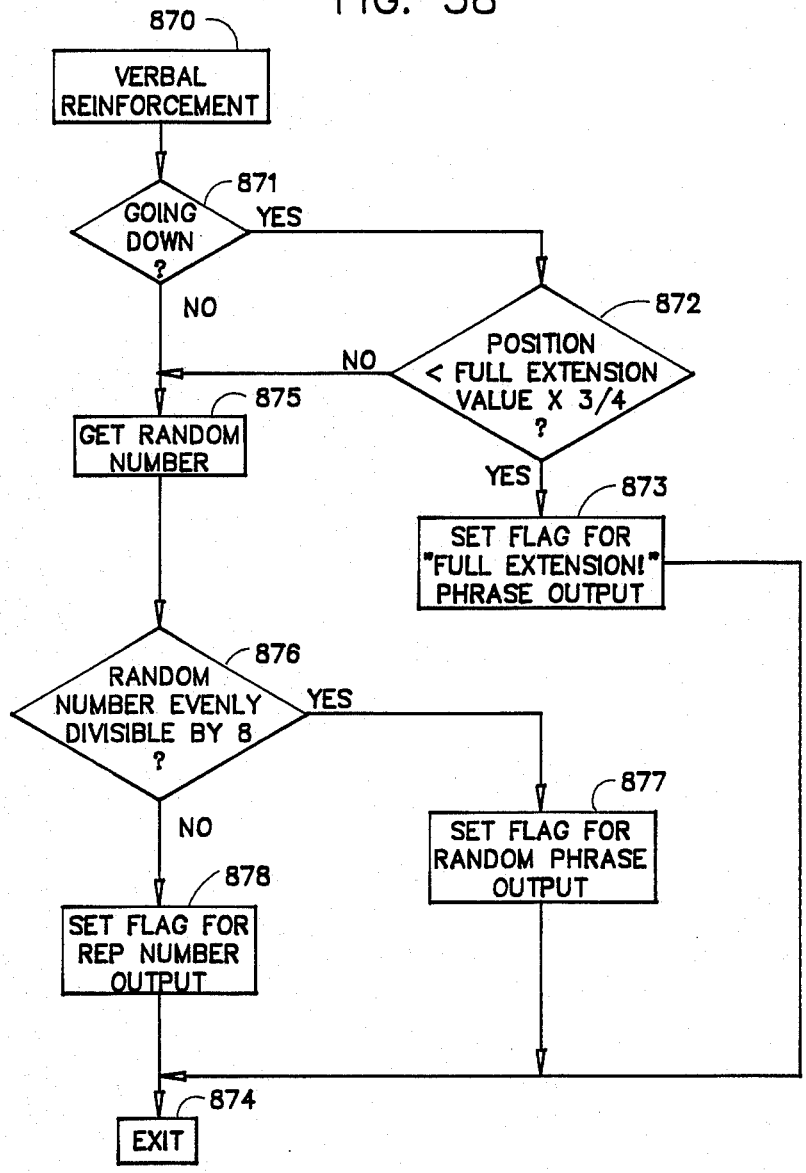

The information communicated to the user in block 680 of FIG. 25 is based upon detection of flags such as those set in blocks 864 and 868 of FIG. 37, and those set in blocks 873, 877 and 878 of FIG. 38. That information comprises a collection of instructions which are stored in table format at the local station. The information is organized within the table according to its relation to a given exercise condition so that, for example, instructions to a user who is going too fast are located in one portion of the table, while instructions advising the user that he is going too slow are located in another portion of the table. These comments can take several forms, and are randomly accessed within each portion of the table so that the user receives various different statements directed to a particular characteristic of his performance.

In addition to containing information based strictly on the evaluation of the performance of the exercise, information relating to the amount of weight selected by the user, and the number of repetitions accomplished by the user is also contained within the table.

The alpha-numeric display is updated in block 698 of FIG. 33. The means by which this updating is accomplished can best be described by reference to FIG. 39. In order to update the alpha-numeric display, the CPU begins in block 880 and then moves to block 882 where it determines whether the user has been accomplishing normal lifting. If the user has been accomplishing normal lifting, the CPU moves to block 884 and outputs, on the LED display 166 of FIG. 6, the number of repetitions which have been accomplished, the weight at which the repetitions were accomplished, and the heart rate of the user. The weight at which the repetition was accomplished may change with the current repetition, as that weight is changed in order to maintain the desired pace, as was described previously. Of course, the heart rate may also change, especially in the earlier period of the exercise session when the user is getting up to an aerobic condition.

If it is determined in block 882 that the user is not accomplishing normal lifting, the CPU moves to block 886 and checks the various flags set in the interrupt routine of FIG. 33, and outputs on the LED display an appropriate error message such as TOO SLOW, TOO FAST, or NOT FULL EXTENSION. From either of block 884 or 886, the CPU moves to block 888 and terminates operation of the update alpha-numeric display routine.

The increase in the simulated weight produced in block 699 of the interrupt routine of FIG. 33 is accomplished by a method which can be more fully described with reference to FIG. 40. Specifically, the increase weight function is initiated in block 881 of FIG. 40, from whence the CPU moves to block 883 and determines whether the number of repetitions of the exercise which have been performed by the user are greater than the number of repetitions which were previously defined as being needed to complete an exercise set. If the number of repetitions completed are not greater than the number of repeititions needed to complete the set, the CPU moves from block 883 to block 885 and terminates operation of the increase weight routine.

If it is determined in block 883 that the number of repetitions completed is greater than the number of repetitions needed for the set, the CPU moves to block 887 and checks the flag indicating whether the exercise arm is going up. If the flag indicates the exercise arm is going up, the CPU moves to block 889 and produces a control signal increasing the resistance applied by brake 64 to the movement of the exercise arm in the downward direction. This increase in resistance simulates an increase in the weight against which the user is exercising. The amount of weight increase is preferably based on a percentage of the current weight value. In one preferred embodiment, the weight is increased in block 889 by an amount equal to 12½% of the prior weight value. Of course, any desired percentage increase may be selected in order to accomplish the purposes for which the weight increase is intended. For example, in one presently preferred embodiment, the weight increase is utilized to both inform the user that he has exceeded the number of repetitions necessary to complete his exercise set, and also to provide a basis for determining an amount of weight to be added to future exercise sessions for this particular user.

From block 889, the CPU moves to block 885 and terminates further operation of the increase weight routine.

If it is determined in block 887 that the exercise arm is going up, then the CPU moves to block 891 and increases the amount of resistance applied by brake 64 against the upward movement of the exercise arm. This resistance increase simulates an increase in the weight against which the user is exercising while moving the exercise arm in the upward direction.

Similar to the basis for determining the percentage of increase in the weight applied in the downward movement direction of the equipment arm in block 889, the increase in weight accomplished in block 891 is also based on a percentage of the previous weight value, and is selected in accordance with the goals of the user's exercise program and/or the operating parameters selected for use of the exercise station. After increasing the "up" weight in block 891, the CPU moves to block 885 and terminates further operation of the increase weight routine.

Following completion of the exercise session, the station provides a rating of the user's performance. This rating is accomplished in block 702 of FIG. 25, and may be more fully explained by reference to FIG. 41. The rating routine is initiated by the CPU in block 890 from whence the CPU moves to block 892 and determines the rating value based upon criteria such as the number of repetitions completed, the weight which was specified in the exercising session, and the percentage of full extension achieved by the user, as well as the extent to which the user maintained the desired pace of the repetitions.

In one preferred embodiment, the rating is based on a scale from 1-to-10. If the user acheived the desired number of repetitions at the selected weight and maintained the desired pace while acheiving full extensions, he receives a rating of 10. If the user did not acheive the desired number of repetitions, the rating is reduced by the percentage of the number of the repetitions less than the desired number as compared to the desired number of repetitions. The rating is also reduced based upon the average weight used in the exercise session as compared to the desired weight. Again, the percentage of full extension also serves as a multiplier which reduces the rating. In addition, the percentage of repetitions which were completed at either slow or fast rates with respect to the pacer also defines a number which is used modify the rating value.

In one preferred embodiment, the rating information may be used in conjunction with the past performance history and demographics of the user to determine proposed changes to the exercise program. For example, if the user has achieved a rating of 10 for a given number of exercise sessions in a row, the system recommends that the amount of weight used by the user be increased by a selected percentage, such as 15%. On the other hand, if the user has not obtained a rating of 10 within the past three exercise sessions, the recommendation is made that the amount of weight be reduced by a selected amount, such as 15%. The percentage factor additionally is impacted by the physical condition of the user, the sex of the user, and other such considerations. Additionally, the reasons why the change in weight is suggested can be conveyed to the user to help the user determine if the recommendation should be accepted.

From block 892, the CPU passes to block 894 and determines whether this is the first set of the given exercise. If it is the first set, the CPU moves to block 896 and advises the user both audibly as well as visually through the use of the LED display 166 of FIG. 6 as to the user's rating. If it is not the first set of exercises in the exercise session, the CPU passes from block 894 to block 898 and calculates the rating average for all of the sets of the exercise session. This could include those sets comprising an exercise session on the current local station, and it could also include those sets performed on other local exercise stations during the user's current, total exercise session. The means for providing information from numerous local stations is described more fully hereafter. The CPU then passes to block 896 and advises the user of the average rating value calculated in block 898. The CPU also communicates to the user any recommended weight change and preferably also provides an explanation to the user as to why the resistance presented by the brake 64 should be changed. The CPU may also provide discussion of other problems detected during the exercise session, such as an explanation of the detrimental effects of the differences between the actual and the desired arm positions as a function of time. For example, the statements may describe the basis for detection of differences in actual and derived arm position, and the detrimental effects, due to failure to fully move the arm; failure to smoothly move the arm; and failure to fully move the arm within the desired time. From block 896, the CPU moves to block 900 and terminates operation of the rating routine.

With the various exercise stations essentially tied together via the central controller 150, it is also possible to monitor and instruct the user based on his overall performance on several stations. For example, one preferred embodiment of the system compares the number of sets completed with the value of sets to be completed in a given session. If the user does not finish all sets, he is so advised and, if he does not then complete the sessions, his record is marked so that coaching comments regading this may be given later. Similarly, if the user skips one or more exercise stations in executing his program, the central processor 150 notes this and advises the user. If the user still skips the stations, his record is marked so that appropriate coaching instructions are later communicated to him. These operations are accomplished in the tied station performance block 606 of FIG. 19.

In summary, the invention described herein comprises a significant improvement over the prior art by overcoming long-existent problems in the industry through (1) providing an exercise system which assists the user through each repetition of the exercise with a minimum amount of overshooting and undershooting of the amount of force necessary to be exerted by the user; (2) providing an exercise system which paces the user on individual repetitions and which adjusts the resistance against which the exercising person applies force, so that the user may maintain a desired exercise condition which maximizes the benefits of the exercise program; (3) providing an exercise system which provides on-line, real time evaluation of the performance of the user, as well as instructions on how to improve his performance; (4) an exercise system which additionally provides a rating at the end of an exercise period based upon the present performance of the user, the past performance, and other selected user demographics; (5) providing an exercise system which uses the present and past user performance history in addition to demographic data for developing changes to the user's exercise program; (6) providing an exercise system which uses both visual and audio communications media for communicating information to the user and for reinforcing his exercise efforts during the exercise session; (7) providing such an exercise system which also provides education information to the user regarding areas affecting his health and fitness plan, such as diet and personal hygiene tips; (8) providing an exercise system which includes a number of exercise stations which are in comunication with a central controller for receiving updated instructions and information on the user from the central controller; and (9) providing such an exercise system having a central controller which makes information regarding performance of exercises at a first station available, along with associated user data, to any other station connected to the central controller, and which coordinates performance of an exercise session involving use of more than one exercise station.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An excerise apparatus, comprising:

a resistance means;

means for enabling an individual to perform work against said resistance means in receptive cycles;

means for measuring multiple performance parameters of the individual;

means for designating at least one desired performance parameter value for performing throughout one of the cycles; and means for visually assisting the individual to regulate at least one of his performance parameters to conform to the desired performance parameter value throughout at least one cycle;

the means for designating at least one desired performance parameter value comprising pacing means for visually guiding the individual's performance at a desired rate throughout said at least one cycle, the means for assisting the individual comprising a visual display system providing a visual signal which moves in accordance with movement of the means for enabling an individual to perform work, and the visual display system is positioned near the pacing means so that movement of the visual signal is conformable to movement of the pacing means;

the pacing means and the visual display system each comprising a plurality of light bars positioned in adjacent configuration so that illumination of light bars in the visual display system can track illumination of light bars in the pacing means; and the light bars comprising the visual display system being configured to simulate a weight stack in conventional weight-pulley excercise equipment.

2. The exercise apparatus of claim 1, wherein the number of illuminated light bars comprising the visual display system vary in number with the resistance of the resistance means.

3. An exercise apparatus as defined in claim 1 wherein the visual display system includes means for correlating the position of the visual signal to the amount of limb extension of the individual as he or she uses the means for enabling to perform work against the resistance means.

4. An exercise apparatus as defined in claim 1 further comprising means responsive to the measuring means and to demographic data of the user for automatically adjusting the resistance means to vary the amount of work required by the user in performing the repetitive exercise cycles.

5. An exercise apparatus as defined in claim 1 further comprising means responsive to the measuring means and to demographic information of the user for evaluating user performance and for communicating evaluation results and instructions to the user.

6. An exercise apparatus as defined in claim 1 further comprising:

a central controller which is connectable to a plurality of other exercise apparatus;

means in the central controller for storing user exercise information;

means for receiving user performance information from an exercise apparatus used by the user;

means for updating the user exercise information in the central controller based on said user performance information; and means for communicating the updated user exercise information from the central controller to any of said plurality of exercise apparatus.

7. An exercise apparatus as defined in claim 6 further comprising means in each exercise apparatus for audibly communicating information to a user of the exercise apparatus, wherein said audibly communicating means of a first exercise apparatus communicates the information by means of an audible voice having voice characteristics which are different from those of the audibly communicating means of a second exercise apparatus.

8. An exercise apparatus as defined in claim 7 wherein the voice characteristics of the first exercise apparatus which are different from the voice characteristics of the second apparatus comprise at least one selected from among characteristics of pitch, inflection, accent, and sex.

9. An exercise apparatus for providing an exercise program having paced exercise repetitions, comprising:

at least one movement arm providing a body engaging member adapted to be contacted by a portion of a user's body, and to be moved therewith and means mounting the movement arm for movement in both first and second directions;

a brake coupled to the movement arm so as to apply resistance to the movement of said arm by the user;

a first light stack providing an illuminated portion which visually characterizes movement of the movement arm;

a second light stack providing an illuminated portion and positioned adjacent the first light stack to provide a visual pacing signal for pacing the illuminated portion of the first light stack, and thereby continuously pacing movement of said movement arm throughout each repetition of an exercise cycle;

means for changing the illuminated portion of the second light stack to provide a visual pacing signal defining at least a first rate of movement for the movement arm in said first direction, and at least a second rate of movement for the movement arm in said second direction; and means responsive to the relative positions of the illuminated portion of the visual pacing signal and the illuminated portion of the first light stack for advising the user of the difference in said relative positions and for communicating to said user coaching instructions relating to said difference in relative positions.

10. An exercise apparatus as defined in claim 9, further comprising means responsive to relative positions of the visual pacing signal and the illuminated portion of the first light stack for at least momentarily reducing rate of the visual pacing signal in at least one of said first and second directions when the difference in said relative positions exceeds a selected amount.

11. An exercise apparatus as defined in claim 9 further comprising means for changing the illuminated portion in the first light stack to correlate to the amount of limb extension of the user as he moves the movement arm.

12. An exercise apparatus as defined in claim 9, further comprising:

a sensor system for determining position of the movement arm; and a controller system connected to the brake and responsive to the sensor system and to demographic information of the user for automatically adjusting resistance applied by the brake.

13. An exercise apparatus as defined in claim 12 wherein the controller system comprises means for evaluating user performance of an exercise program based on user demographics, and for updating resistance values of the brake for future exercise programs, based on said user performance and user demographics.

14. An exercise system comprising:

at least one exercise station having a movement arm adapted to be contacted by a portion of a user's body and to be moved therewith;

at least one magnetic brake connected to the movement arm to provide resistance against movement of said arm;

at least one central processing unit associated with each exercise station and electrically connected to the magnetic brake to control the resistance provided by said brake;

at least one sensor for monitoring position of the movement arm;

at least one visual display for indicating position of the movement arm;

at least one visual pacer signal positioned adjacent the visual display to pace movement of the movement arm throughout each repetition of an exercise; and a central controller electrically connected to a plurality of exercise stations for modifying a user's exercise program based on demographics and prior performance of the user and on user performance information received from one of said plurality of exercise stations, and for communicating the modified exercise program to another of said plurality of said exercise stations.

15. An exercise apparatus as defined in claim 14, further comprising:

means in the central controller for maintaining a record of which of the plurality of exercise stations are used by a user in performing an exercise program;

means for comparing said record with exercise program information indicating which exercise stations the user should use in his exercise program; and means for advising the user of those exercise stations identified in said exercise program information which were skipped in the user's performance of the exercise program.

16. An exercise apparatus as defined in claim 14 further comprising means in each exercise apparatus for audibly communicating information to a user of the exercise apparatus, wherein said audibly communicating means of a first exercise apparatus communicates the information by means of an audibly voice having voice characteristics which are different from those of the audibly communicating means of a second exercise apparatus.

17. An exercise apparatus as defined in claim 16 wherein the voice characteristics of the first exercise apparatus which are different from the voice characteristics of the second apparatus comprise at least one selected from among characteristics of pitch, inflection, accent, and sex.

18. An exercise apparatus comprising:

means for storing an exercise program assigned to a selected user;

means for storing personal information of the selected user;

resistance means mounted for movement for providing in each of two opposite directions resistance movable in response to user applied force in an amount based on the exercise program;

means for monitoring user exercise rate of movement of the resistance means and comparing this against a selected rate throughout a repetition of an exercise in the exercise program;

means responsive to the monitoring means for adjusting, during execution of the exercise program, the amount of resistance provided by the resistance means in one of said two opposite directions, wherein said resistance is adjusted by an amount based upon user performance rate in a repetition of the exercise;

means for advising the user of the change in resistance; and means for providing to the user coaching instructions relating to the user's performance in connection with the change in resistance.

19. An exercise apparatus as defined in claim 18 further comprising means responsive to current user performance, to selected personal information of the user, and to past user performance for automatically modifying said exercise program.

20. An exercise apparatus as defined in claim 19 wherein the means for providing coaching instructions comprise visual communications means and audio communications means which function in combination to communicate the information to the user.

21. An exercise apparatus as defined in claim 18, further comprising:

means designating user's full limb extension position with respect to a given exercise station;

means for monitoring extent of a user's limb extension during performance of an exercise session;

means responsive to the limb extension monitoring means for adjusting the amount of resistance provided by the resistance means;

means for advising the user of the change in resistance; and means for providing to the user coaching instructions relating to the user's performance in connection with the change in resistance.

22. An exercise system, comprising:

a resistance means;

means for enabling a user to perform work against the resistance means;

means for monitoring selected user parameters to define user performance during use of the exercise system in an exercise program;

means for storing user prior performance information and selected user demographic information; and means responsive to the monitored user parameters, to prior user performance information and to selected user demographics for providing a rating of the user performance of an exercise session.

23. An exercise system as defined in claim 22 further comprising means for providing evaluation and instruction information based on the rating, and upon selected user demographic information.

24. An exercise system as defined in claim 23 wherein the means for providing evaluation and instruction information comprises a central controller having access to evaluation and instruction information and electrically connected to receive the user performance and rating information and to provide evaluation and instruction information based on said user performance rating and selected user demographics.

25. An exercise system as defined in claim 24 further comprising means for providing to the central controller educational information for selective communication to the user.

26. An exercise system as defined in claim 25 wherein said educational information comprises educational information selected on the basis of the user's exercise program, demographic data and exercise performance history.

27. An exercise system as defined in claim 23 further comprising means for communicating the rating, evaluation and instruction information to the user.

28. An exercise system as defined in claim 27 wherein the means for communicating comprise:

an audio system for providing audible reproduction of the information in verbal format; and a visual display system for presenting the information in visibly perceptible form and in combination with the audio system.

29. An exercise system as defined in claim 28 wherein visual system includes an electronically controlled, simulated human face which is operated in synchronism with the audio system to simulate appearance of a human face which is speaking as the audible information is communicated to the user.

30. An exercise system comprising:

a plurality of exercise stations, each station including:

a resistance means;

means for enabling a user to perform work against the resistance means;

means for monitoring selected parameters to define user performance during use of the exercise system in an exercise program;

a central controller which is connectable to any of said plurality of exercise stations;

means in the central controller for storing user exercise information;

means in the central controller for receiving user performance information from an exercise station;

means for updating user exercise information for a selected user in the central controller based on user performance information for said selected user, received from a local station; and means for communicating the updated user exercise information from the central controller to any of said plurality of exercise stations.

31. An exercise system as defined in claim 30 further comprising:

means in the central controller for maintaining a record of which of the plurality of exercise stations are used by a user in performing an exercise program;

means for comparing said record with exercise program information indicating which exercise stations the user should use in his exercise program; and means for advising the user of those exercise stations identified in said exercise program information which were skipped in the user's performance of the exercise program.

32. An exercise system as defined in claim 31 wherein the means for updating user exercise information modifies said user exercise information in response to the comparison of the user exercise program information with the record of stations used by the user, to reflect skipped exercise stations.

33. An exercise apparatus for use in an exercise system having a central controller which communicates with said exercise apparatus, said exercise apparatus comprising:

a resistance means for providing a source of resistance in the exercise apparatus;

means for enabling a user to perform work against said resistance as part of an exercise program;

means for monitoring selected parameters during user performance of exercises on the exercise apparatus;

means for evaluating the monitored parameters and for developing user performance information in response to the evaluation of the monitored parameters and independent of the central controller;

means for receiving signals from the central controller;

means coupled to the receiving means for sensing whether communication with the central controller can occur; and means for storing the monitored parameters and the user performance information during times when communication with the central controller cannot occur.

34. An exercise apparatus as defined in claim 33 wherein the central controller periodically polls the exercise apparatus and wherein the sensing means senses when communication with said central controller cannot occur by absence of polls providing initialization data to the exercise apparatus.

35. An exercise apparatus as defined in claim 33 further comprising means in the exercise apparatus for storing user demographic information and prior performance information of prior users of the exercise apparatus.

36. An exercise apparatus as defined in claim 33 wherein the means for evaluating includes means for controlling operation of the exercise apparatus to accomplish user performance of an exercise session on the exercise apparatus independent of the central controller.

37. An exercise apparatus as defined in claim 33 further comprising:

means for providing a pacing indicator to guide the user in exercising at a desired rate throughout a cycle of an exercise;

means for indicating actual exercise rate throughout said exercise cycle; and wherein the monitoring means is responsive to the means for providing a pacing indicator and the means for indicating actual exercise rate for providing information representing difference between the pacing indicator rate and the actual rate at any time, for use in developing user performance information.

38. An exercise apparatus as defined in claim 33 further comprising:

means for defining user limb extension levels representing amount of extension of the user's limbs in performance of selected portions of a cycle of an exercise; and wherein the means for monitoring comprises:

means for detecting actual user limb extension levels at said selected portions of said exercise cycle during actual user performance of the exercise; and means for providing information representing difference between the defined limb extension levels and the actual limb extension levels, for developing user performance information.

39. An exercise apparatus comprising:

a movement arm adapted to be connected by a portion of a user's body and to be moved therewith;

a resistance means coupled to the movement arm so as to apply resistance to the movement arm by the user;

means for defining user limb extension levels representing amount of extension of the user's limbs, as a function of position of the movement arm;

means for monitoring position of the movement arm; and means responsive to the monitoring means for providing information representing difference between the defined limb extension levels and actual limb extension levels existing during performance of an exercise by the user.

40. An exercise apparatus as defined in claim 39 wherein the means for providing information comprise:

means for identifying actual position of the movement arm; and means for comparing the actual position of the movement arm with the limb extension levels for corresponding movement arm positions to produce said difference information.

41. An exercise apparatus as defined in claim 39 further comprising means for advising the user of the difference between the actual and defined limb extension levels.

42. An exercise apparatus as defined in claim 41 wherein the means for advising the user additionally comprises means for instructing the user on performance changes recommended in view of the difference between the actual and defined limb extension levels.

43. An exercise apparatus comprising:

a movement arm adapted to be contacted by a portion of a user's body and to be moved in response to extension of a portion of the user's body;

means for defining an extension range comprising an acceptable range of movement arm positions during a selected portion of a cycle of a given exercise;

means for determining whether movement arm position is within the extension range during the selected portion of the exercise cycle; and means for advising the user when the movement arm position is not within the extension range during said selected portion of the exercise cycle.

44. An exercise apparatus as defined in claim 43 further comprising means for communicating user reinforcement information when the movement arm position is within the extension range during said selected portion of the exercise cycle.

45. An exercise apparatus as defined in claim 44 further comprising means for communicating educational information relating to user performance of the exercise to the user, and wherein the means for advising and the means for communicating reinforcement and educational information each comprise at least one form of communication media selected from among visual communication media and audio communication media.

46. An exercise apparatus as defined in claim 43 wherein the means for advising the user comprises means for providing an audible voice signal having selected voice characteristics.

47. An exercise apparatus as defined in claim 46 wherein the selected voice characteristics are detectable by a user and are different from voice characteristics of an audible voice signal from another exercise apparatus, so that said user can differentiate the audible voice signal of the exercise apparatus he is using from said voice signal of said other exercise apparatus.

48. An exercise apparatus as defined in claim 47 wherein the selected voice characteristics which are different from the voice characteristics of the other exercise apparatus comprise at least one selected from among the characteristics of pitch, inflection, accent, and sex.

49. An exercise system comprising:

at least one exercise station, each station including:

a movable exercise arm to be engaged by a user;

a resistance means connected to said movable arm; and means for determining position of said movable arm at any time and producing a signal indicative thereof;

means for determining actual position of said movable arm as a function of time;

means for defining a desired position of said movable arm at any time;

means for comparing the actual position of said movable arm as a function of time with a desired position as a function of time;

means for producing an output indicating a measure of any difference between the actual and desired positions as a function of time; and means for explaining a basis for the difference between the actual and desired arm positions as a function of time with respect to the user's movement of the movable arm.

50. An exercise system as defined in claim 49 further comprising means for explaining detrimental effects of the difference between the actual and the desired arm positions as a function of time.

51. An exercise system as defined in claim 50 further comprising:

a central computer capable of receiving communications and having a printer;

each exercise station further comprising:

means for communicating said position signal to said central computer; and wherein said means for explaining the difference basis and said means for explaining the detrimental effects comprises said central computer.

52. An exercise system as defined in claim 49 wherein said means for explaining the difference basis comprises means for explaining any differences due to conditions including failure to fully move the arm, failure to smoothly move the arm, and failure to fully move the arm within the desired time.

53. An exercise system as defined in claim 49 wherein the resistance means includes a signal indicative of the resistance and further comprising:

means for counting number of repetitions of movement of said arm;

means for evaluating the number of repetitions, the resistance presented by the resistance means, and the position of the arm as a function of time; and means for producing an output indicating a suggestion to change the resistance presented by the resistance means based on said evaluation of repetitions, resistance, and position.

54. An exercise system as defined in claim 53 further comprising means for explaining why the resistance presented by the resistance means should be changed.

55. An exercise system comprising:

at least one exercise station, each station including:

a movable exercise arm to be engaged by the user;

a resistance means connected to said movable arm; and means for defining a desired position of said movable arm at any time and producing a desired position signal indicative thereof;

means for monitoring the desired position signal and the movement of the exercise arm and for determining any difference; and means for instructing the user on the proper technique for moving said movable arm based upon any such differences.

56. An exercise system as defined in claim 55 further comprising:

means for determining the actual position of said movable arm as a function of time;

means for comparing the actual position of said moveable arm as a function of time with the desired position as a function of time; and means for instructing the user during the movement that the previous movement was too slow, too fast, or too short.

57. An exercise system as defined in claim 56 wherein said instruction means are verbal means.

58. An exercise system as defined in claim 56 wherein said instruction means are visual means.

59. An exercise system as defined in claim 56 wherein said instructions means are verbal and visual means.

60. An exercise system as defined in claim 55 wherein said instruction means is verbal means.

61. An exercise system as defined in claim 55 wherein said instruction means are visual means.

62. An exercise system as defined in claim 55 wherein said instructions means are verbal and visual means.

63. An exercise system comprising:

at least one exercise station on which a user performs an exercise program having means to communicate program results of the user for a completed exercise session;

means for measuring the user's weight and communicating said weight;

means for storing said communicated program results for each station and said user weight;

means for obtaining and storing the user's physical information and work activity;

means for analyzing the user's program to determine energy expended by the user during the exercise session;

means for determining the energy expended by the user during future exercise sessions;

means for determining energy expended by the user during activities other than exercise sessions; and means for analyzing the user's energy consumption and weight information to determine if the user is within acceptable range of a desired weight control plan and informing the user of deviations from said desired weight control plan.

64. An exercise system as defined in claim 63 further comprising means for suggesting diet plans to align the user's energy consumption and weight information with the desired weight control program.

65. An exercise system as defined in claim 64 wherein the diet suggestion means includes suggesting individual meal plans.

66. An exercise system comprising:

at least two exercise stations with means for communicating that a user has successfully used the station and means for displaying information to the user, and wherein said exercise stations are intended to be used by said user in a predetermined sequence; and a central computer communicating with each exercise station, wherein the central computer tracks the user's progress through the exercise stations and communicates with the station the user is using to indicate that the user has missed a station in the predetermined sequence, which station then informs the user of this missed station.

67. A method of defining and controlling an exercise program performed by a user against a resistance means, the method comprising the steps of:

providing a pacing signal for guiding the user throughout a cycle of an exercise at a desired rate;

sensing performance of the user throughout at least one cycle of an exercise;

providing a feedback signal indicating the user's current performance rate, said feedback signal being substantially similiar to form to the pacing signal so that said feedback signal and said pacing signal are readily comparable by the user, allowing the user to conform his exercise rate throughout the cycles of the exercise to the rate of the pacing signal establishing selected performance criteria;

automatically adjusting, during the user's performance of the exercise program, resistance applied by the resistance means, said adjustment being made in response to the sensed performance of the user as compared to the selected performance criteria;

advising the user of the change in resistance; and providing the user coaching instructions relating to the user's performance in connection with the change in resistance.

68. A method of determining a future user resistance level for an exercise apparatus having a resistance means, comprising:

providing a record of selected demographic information of the user;

selecting a first resistance level based upon the selected demographic information;

monitoring performance of the user through at least one repetition of an exercise applied against the resistance means set at the first resistance level;

incrementing the resistance level if the user completes a repetition of the exercise;

monitoring performance of the user through at least one repetition of an exercise applied against the incremented resistance level; and determining the incremental resistance level at which the user is unable to perform a repetition of the exercise.

69. The method of claim 68, further comprising:

setting future resistance levels as a function of the incremental resistance level at which the user was unable to perform a repetition of the exercise.

70. A method of defining and controlling an exercise program performed by a user against a resistance means, the method comprising the steps of:

providing a pacing signal for guiding the user throughout a cycle of an exercise at a desired rate;

sensing performance of the user throughout at least one cycle of an exercise;

providing a feedback signal indicating the user's current performance rate, said feedback signal being substantially similiar to form to the pacing signal so that said feedback signal and said pacing signal are readily comparable by the user, allowing the user to conform his exercise rate throughout the cycles of the exercise to the rate of the pacing signal;

providing a record of prior user performance of the exercise program;

developing proposed changes to the program based upon the prior performance record, the current performance information and selected demographics of the user; and communicating the proposed changes to the user.

71. A method of defining and controlling an exercise program as defined in claim 70 further comprising the step of providing the user with instructional information relating to the user's performance of the exercise program.

72. A method of defining and controlling an exercise program as defined in claim 70 wherein the step of providing a record of prior user performance comprises the steps of:

collecting user performance information from any of a plurality of exercise stations which communicate to a central control station;

organizing the collected user performance information in a record; and providing this record to any of said exercise stations.

73. A method of defining and controlling an exercise program performed by a user against a resistance means, the method comprising the steps of:

providing a record of selected demographic information of the user;

establishing an initial level of resistance to be applied by the resistance means;

sensing performance of the user throughout at least one repetition of an exercise; and automatically adjusting the level of resistance applied by the resistance means based upon the sensed performance of the user and upon the selected demographic information.

74. A method of automatically defining and controlling an exercise program in an electronically controlled exercise system having a central controller and a plurality of exercise stations which are in communication with the central controller, the method comprising the steps of:

maintaining in the central controller a record of which of the plurality of exercise stations were used by a user in performing an exercise program;

comparing in said central controller said record with exercise program information indicating which exercise stations the user should use in his exercise program; and sending a signal from the central controller to the user advising said user of those exercise stations identified in the exercise program information which were skipped in the user's performance of the exercise program.

75. A method of automatically defining and controlling an exercise program as defined in claim 74 further comprising the steps of:

providing a record of user performance; and modifying the record of user performance to indicate stations skipped.

76. A method of automatically defining and controlling an exercise program comprising the steps of:

enabling a user to perform work against a resistance means;

monitoring selected user parameters to define user performance of the exercise program;

storing user prior performance information and selected user demographic information; and providing a rating of user performance of the exercise program based upon said monitored selected user parameters, user prior performance information, and selected user demographics.

77. A method of automatically defining and controlling an exercise program as defined in claim 76 further comprising the step of providing evaluation and instruction information to the user based on the rating, and upon selected user demographic information.

78. An exercise apparatus, comprising:

resistance developing means for providing a resistance against which a user applies force;

means for setting a first resistance of said resistance development means at a defined resistance level and means for thereafter incrementing said resistance; and means for determining the incremental resistance at which the user is unable to continue to overcome the incremental resistance developed by said resistance developing means.

79. The exercise apparatus of claim 78, further comprising:

means for setting future resistance levels as a function of the incremental resistance level at which the user is unable to overcome incremental resistance.

80. A method of defining and controlling an exercise program performed by a user against a resistance means of an exercise apparatus in an exercise system having a central controller which communicates with said exercise apparatus, the method comprising the steps:

enabling a user to perform work against the resistance means;

monitoring selected paramaters during user performance of exercises;

evaluating the monitored parameters and developing user performance information in response to the evaluation of the monitored parameters and independent of the central controller;

receiving signals from the central controller;

sensing whether communication with the central controller can occur; and storing the monitored parameters and the user performance information during times when communication with the central controller cannot occur.

81. A method of defining and controlling an exercise program performed by a user as defined in claim 80 wherein the step of sensing when communication with the central controller cannot occur comprises the step of sensing an absence of polls providing initialization data to the exercise apparatus.

82. A method of defining and controlling an exercise program performed by a user as defined in claim 80 further comprising the step of controlling operation of the exercise apparatus to accomplish user performance of an exercise session on the exercise apparatus independent of the central controller.

83. A method of defining and controlling an exercise program performed by a user as defined in claim 80 further comprising the steps of:

defining user limb extension levels representing amount of extension of the user's limbs in performance of selected portions of a cycle of an exercise; and detecting actual user limb extension levels at said selected portions of said exercise cycle during actual user performance of the exercise; and providing information representing difference between the defined limb extension levels and the actual limb extension levels, for use in developing user performance information.

84. A method of defining and controlling an exercise program performed by a user against a resistance means, the method comprising the steps of:

providing a movement arm adapted to be contacted by a portion of a user's body and to be moved therewith against the resistance means;

defining user limb extension levels representing amount of extension of the user's limbs, as a function of position of the movement arm;

monitoring position of the movement arm; and providing information representing difference between the defined limb extension levels and actual limb extension levels existing during performance of an exercise by the user.

85. A method of defining and controlling an exercise program as defined in claim 84 wherein the step of providing information comprises the steps of:

identifying actual position of the movement arm in said selected portions of the exercise cycle; and comparing the actual position of the movement arm with the limb extension levels for corresponding movement arm positions to produce said difference information.

86. A method of defining and controlling an exercise program as defined in claim 84 further comprising the step of advising the user of the difference between the actual and defined limb extension levels.

87. A method of defining and controlling an exercise program as defined in claim 86 wherein the step of advising the user additionally comprises the step of instructing the user on performance changes recommended in view of the difference between the actual and defined limb extension levels.

88. A method of defining and controlling an exercise program performed by a user in conjunction with a movement arm which is adapted to be contacted by a portion of a user's body and to be moved in response to extension of a portion of the user's body, the method comprising the steps of:

defining an extension range comprising an acceptable range of movement arm positions during a selected portion of a cycle of a given exercise;

determining whether movement arm position is within the extension range during the selected portion of the exercise cycle; and advising the user when the movement arm position is not within the extension range during said selected portion of the exercise cycle.

89. A method of defining and controlling an exercise program as defined in claim 88 further comprising the steps of communicating user reinforcement information when the movement arm position is within the extension range during said selected portion of the exercise cycle.

90. A method of defining extension values for a user of an exercise program in an exercise station having a movement arm adapted to be contacted by a portion of the user's body and to be moved in response to extension of a portion of the user's body, the method comprising steps of:

positioning the movement arm at a desired starting location;

instructing the user to move the movement arm as far away from the user's body as possible;

monitoring movement of the movement arm;

storing values representative of movement arm position at selected portion of the exercise cycle; and selecting the stored value corresponding to the movement arm position most distant from the user's body.

91. A method of defining extension values as defined in claim 90 further comprising the step of:

multiplying the selected value by a selected percentage factor to define a full extension value for the given user.

92. A method of defining and controlling an exercise program performed by a user on at least one exercise station having means to communicate program results of the user following a completed exercise session, the method comprising the steps of:

measuring the user's weight;

storing the communicated program results for each exercise station, and said user weight;

obtaining and storing the user's physical information and work activity;

analyzing the user's exercise program to determine energy expended by the user during an exercise session;

determining the amount of energy expended by the user during future exercise sessions;

determining energy expended by the user during activities other than exercise sessions;

analyzing the user's energy consumption and weight information to determine if the user is within acceptable range of a desired weight control plan; and informing the user of deviations from said desired weight control plan.

93. A method of defining and controlling an exercise program as defined in claim 92 further comprising the step of suggesting diet plans to align the user's energy consumption and weight information with the desired weight control program.

94. A method of defining and controlling an exercise program as defined in claim 93 wherein the step of suggesting diet plans comprises the step of suggesting individual meal plans.

95. An exercise apparatus, comprising:

a movement arm adapted to be contacted by a portion of a user's body and to be moved therewith;

a resistance means coupled to the movement arm so as to apply resistance to the movement arm by the user; and means for determining user limb full extension limits and representing the limit of full extension of the user's limbs as a function of position of the movement arm.

96. The exercise apparatus of claim 95, wherein the resistance means is set at a minimal resistance level when user limb extension limits are determined.

* * * * *